US005751304A

United States Patent [19]

Hirabayashi et al.

[11] Patent Number: 5,751,304

[45] Date of Patent: May 12, 1998

[54] INK JET RECORDING HAVING TEMPERATURE CONTROL FUNCTION

[75] Inventors: Hiromitsu Hirabayashi, Yokohama; Naoji Otsuka, Kawasaki; Kentaro Yano, Yokohama; Hitoshi Sugimoto, Kawasaki; Miyuki Matsubara, Tokyo; Kiichiro Takahashi, Yokohama; Osamu Iwasaki, Tokyo, all of Japan

[73] Assignee: Canon Kabushiki Kaisha, Tokyo, Japan

[21] Appl. No.: 471,473

[22] Filed: Jun. 6, 1995

Related U.S. Application Data

[62] Division of Ser. No. 921,832, Jul. 30, 1992, abandoned.

[30] Foreign Application Priority Data

| | | | |
|---|---|---|---|
| Aug. 1, 1991 | [JP] | Japan | 3-193177 |
| Aug. 1, 1991 | [JP] | Japan | 3-193187 |
| Aug. 2, 1991 | [JP] | Japan | 3-194139 |
| Dec. 26, 1991 | [JP] | Japan | 3-345052 |
| Dec. 26, 1991 | [JP] | Japan | 3-345060 |
| Jan. 31, 1992 | [JP] | Japan | 4-016526 |

[51] Int. Cl.[6] ..... B41J 2/05

[52] U.S. Cl. ..... 347/17; 347/14; 347/23

[58] Field of Search ..... 347/14, 17, 23

[56] References Cited

U.S. PATENT DOCUMENTS

| | | | |
|---|---|---|---|
| 4,313,124 | 1/1982 | Hara | 347/56 |
| 4,345,262 | 8/1982 | Shirato et al. | 347/56 |
| 4,459,600 | 7/1984 | Sato et al. | 347/56 |
| 4,463,359 | 7/1984 | Ayata et al. | 347/56 |
| 4,490,728 | 12/1984 | Vaught et al. | 347/56 |
| 4,558,333 | 12/1985 | Sugitani et al. | 347/56 |
| 4,719,472 | 1/1988 | Arakawa | 347/17 |
| 4,723,129 | 2/1988 | Endo et al. | 347/56 |
| 4,740,796 | 4/1988 | Endo et al. | 347/56 |
| 4,791,435 | 12/1988 | Smith et al. | 347/17 |
| 4,910,528 | 3/1990 | Firl et al. | 347/17 |
| 5,006,866 | 4/1991 | Someya | 347/17 |
| 5,485,179 | 1/1996 | Otsuka et al. | 347/14 |
| 5,485,182 | 1/1996 | Takayanagi et al. | 347/17 |
| 5,502,469 | 3/1996 | Watanabe | 347/14 |

FOREIGN PATENT DOCUMENTS

| | | |
|---|---|---|
| 0390202 | 10/1990 | European Pat. Off. . |
| 0418818 | 3/1991 | European Pat. Off. . |
| 3612469 | 10/1986 | Germany . |
| 59-123670 | 7/1984 | Japan . |
| 59-138461 | 8/1984 | Japan . |
| 60-230859 | 11/1985 | Japan . |
| 62-117754 | 5/1987 | Japan . |
| 3024972 | 2/1991 | Japan . |
| 3227643 | 10/1991 | Japan . |

*Primary Examiner*—Joseph W. Hartary

*Attorney, Agent, or Firm*—Fitzpatrick, Cella, Harper & Scinto

[57] ABSTRACT

An ink jet recording apparatus executes recording with a recording head, provided in a main body, for ejecting ink. The apparatus includes a head temperature detection member provided for the recording head, a reference temperature detection member provided for the main body, and a timer means for counting time. The apparatus further includes a correction amount determination section for determining a correction amount of a head temperature detected by the head temperature detection member based on a detected value of the head temperature detection member and a detected value of the reference temperature detection member at a predetermined time counted by the timer means. A calibration section is provided for calibrating a head temperature detected by the head temperature detection member based on the correction amount.

18 Claims, 63 Drawing Sheets

$P_1$ : PRE-PULSE ($=T_1$) (PWM)
$P_2$ : INTERVAL ($=T_2-T_1$)
$P_3$ : MAIN PULSE ($=T_3-T_2$)
Vop : OPERATIONAL VOLTAGE

FIG. 12A

INK TEMP-PREPULSE TABLE (1)

| PREPULSE NO. | 1 | 2 | 3 | 4 | 5 | 6 | 7 | 8 | 9 | 10 | 11 |
|---|---|---|---|---|---|---|---|---|---|---|---|
| INK TEMP [℃] | <36 | 36 ~ 38 | 38 ~ 40 | 40 ~ 42 | 42 ~ 44 | 44 ~ 46 | 46 ~ 48 | 48 ~ 50 | 50 ~ 52 | 52 ~ 54 | ≧54 |
| PREPULSE WIDTH [μsec] | 1.87 | 1.68 | 1.49 | 1.31 | 1.12 | 0.93 | 0.75 | 0.56 | 0.37 | 0.19 | 0.19 |

FIG. 12B

INK TEMP-PREPULSE TABLE (2)

| PREPULSE NO. | 1 | 2 | 3 | 4 | 5 | 6 | 7 | 8 | 9 | 10 | 11 |
|---|---|---|---|---|---|---|---|---|---|---|---|
| INK TEMP [℃] | <36 | 36 ~ 38 | 38 ~ 40 | 40 ~ 42 | 42 ~ 44 | 44 ~ 46 | 46 ~ 48 | 48 ~ 50 | 50 ~ 52 | 52 ~ 54 | ≧54 |
| PREPULSE WIDTH [μsec] | 2.05 | 1.87 | 1.68 | 1.49 | 1.31 | 1.12 | 0.93 | 0.75 | 0.56 | 0.37 | 0.19 |

FIG. 12C

INK TEMP-PREPULSE TABLE (3)

| PREPULSE NO. | 1 | 2 | 3 | 4 | 5 | 6 | 7 | 8 | 9 | 10 | 11 |
|---|---|---|---|---|---|---|---|---|---|---|---|
| INK TEMP [℃] | <36 | 36 ~ 38 | 38 ~ 40 | 40 ~ 42 | 42 ~ 44 | 44 ~ 46 | 46 ~ 48 | 48 ~ 50 | 50 ~ 52 | 52 ~ 54 | ≧54 |
| PREPULSE WIDTH [μsec] | 1.68 | 1.49 | 1.31 | 1.12 | 0.93 | 0.75 | 0.56 | 0.37 | 0.19 | 0.19 | 0.19 |

FIG. 13

DESCENT TEMP TABLE
(INCREASED TEMP REMAINDER TO REF TEMP) UNIT $\times 10^{-3}$ deg

| ELAPSE TIME (sec) | POWER RATIO DURING REF TIME PERIOD (%) | | | | | | | | | |
|---|---|---|---|---|---|---|---|---|---|---|
| | ~10 | ~20 | ~30 | ~40 | ~50 | ~60 | ~70 | ~80 | ~90 | ~100 |
| 0.02 | 50 | 100 | 150 | 200 | ⓒ250 | 300 | 350 | 400 | 450 | 500 |
| 0.04 | 46 | 93 | 139 | 184 | 230 | 277 | 322 | ⓑ369 | 416 | 462 |
| 0.06 | 43 | ⓐ 85 | 128 | 170 | 212 | 256 | 297 | 341 | 384 | 426 |
| 0.08 | 39 | 79 | 119 | 157 | 196 | 236 | 275 | 314 | 354 | 394 |
| 0.10 | 36 | 73 | 109 | 145 | 181 | 218 | 253 | 290 | 327 | 363 |
| 0.12 | 33 | 67 | 101 | 134 | 167 | 201 | 234 | 268 | 302 | 335 |
| 0.14 | 31 | 62 | 93 | 123 | 154 | 186 | 216 | 247 | 279 | 310 |
| 0.16 | 29 | 57 | 86 | 114 | 142 | 171 | 199 | 228 | 258 | 286 |
| 0.18 | 26 | 53 | 79 | 105 | 132 | 158 | 184 | 211 | 238 | 264 |
| 0.20 | 24 | 49 | 73 | 97 | 121 | 146 | 170 | 194 | 219 | 244 |
| 0.22 | 22 | 45 | | | | | | | 202 | 225 |
| 5.04 | 0 | 0 | 0 | 0 | 0 | 0 | 0 | 0 | 1 | |
| 5.06 | 0 | 0 | 0 | 0 | 0 | 0 | 0 | 0 | 0 | 1 |
| 5.08 | 0 | 0 | 0 | 0 | 0 | 0 | 0 | 0 | 0 | 1 |
| 5.10 | 0 | 0 | 0 | 0 | 0 | 0 | 0 | 0 | 0 | 1 |
| 5.12 | 0 | 0 | 0 | 0 | 0 | 0 | 0 | 0 | 0 | 0 |

| FIG. 15A | FIG. 15B |
|---|---|

FIG. 20

| | | HEAD TEMP ΔT | | | | | | | | | | | | |
|---|---|---|---|---|---|---|---|---|---|---|---|---|---|---|
| | | 0~2.5 | 2.5~5 | 5~9 | 9~13 | 13~17 | 17~21 | 21~25 | 25~29 | 29~33 | 33~37 | 37~41 | 41~45 | 45~49 |
| POWER RATIO (APPLIED ENERGY TO HEAD/ UNIT TIME) | 0~10 | 0 | -0.005 | -0.010 | -0.018 | -0.025 | -0.030 | -0.038 | -0.050 | -0.063 | -0.075 | | -1.00 | |
| | 10~20 | 0.005 | 0 | -0.004 | -0.009 | -0.015 | -0.023 | -0.030 | -0.040 | -0.052 | -0.065 | | -0.40 | |
| | 20~30 | 0.008 | 0.004 | 0 | -0.004 | -0.008 | -0.014 | -0.022 | -0.030 | -0.041 | -0.055 | | -0.10 | |
| | 30~40 | 0.015 | 0.008 | 0.004 | 0 | -0.004 | -0.008 | -0.014 | -0.022 | -0.030 | -0.045 | | -0.07 | |
| | 40~50 | 0.025 | 0.014 | 0.008 | 0.004 | 0 | -0.004 | -0.008 | -0.014 | -0.022 | -0.035 | | -0.05 | |
| | 50~60 | 0.035 | 0.022 | 0.014 | 0.008 | 0.004 | 0 | -0.004 | -0.008 | -0.014 | -0.025 | | -0.04 | |
| | 60~70 | 0.045 | 0.030 | 0.022 | 0.014 | 0.008 | 0.004 | 0 | -0.004 | -0.008 | -0.015 | | -0.03 | |
| | 70~80 | 0.055 | 0.041 | 0.030 | 0.022 | 0.014 | 0.008 | 0.004 | 0 | -0.004 | -0.008 | | -0.02 | |
| | 80~90 | 0.065 | 0.052 | 0.040 | 0.030 | 0.023 | 0.015 | 0.009 | 0.004 | 0 | -0.005 | | -0.01 | |
| | 90~100 % | 0.075 | 0.063 | 0.050 | 0.038 | 0.030 | 0.025 | 0.018 | 0.010 | 0.005 | 0 | | -0.007 | |
| | | | | | | | | | | | | | -0.005 | |
| | 500 % | 1.50 | 1.20 | 1.00 | 0.80 | 0.70 | 0.60 | 0.40 | 0.20 | 0.10 | 0.05 | 0.005 | | |
| | | | | | | | | | | | | | | |

FIG. 29

| DUTY (%) / ELAPSE TIME | 100 | 97.5 | 95.0 | 92.5 | DECREASE BY ··· 2.5% FOR EACH ··· CONTINUED STAGE | 0.0 |
|---|---|---|---|---|---|---|
| 0.1sec | 13.7 | 13.4 | 13.1 | 12.8 | | 0.0 |
| 0.2sec | 4.0 | 3.5 | 3.0 | 2.6 | | 0.0 |
| 0.3sec | 2.5 | 2.3 | 2.1 | 2.0 | | 0.0 |
| 0.4sec | 1.8 | 1.8 | 1.8 | 1.7 | | 0.0 |
| 0.5sec | 1.5 | 1.5 | 1.5 | 1.5 | | 0.0 |
| 0.6sec | 1.2 | 1.2 | 1.2 | 1.2 | | 0.0 |
| 0.7sec | 0.9 | 0.8 | 0.8 | 0.8 | | 0.0 |
| 0.8sec | 0.7 | 0.7 | 0.7 | 0.6 | | 0.0 |
| 0.9sec | 0.6 | 0.6 | 0.6 | 0.5 | | 0.0 |
| 1.0sec | 0.5 | 0.5 | 0.5 | 0.4 | | 0.0 |
| 1.1sec | 0.4 | 0.4 | 0.4 | 0.4 | | 0.0 |
| 1.2sec | 0.3 | 0.3 | 0.3 | 0.3 | | 0.0 |
| 1.3sec | 0.2 | 0.2 | 0.2 | 0.2 | | 0.0 |
| 1.4sec | 0.1 | 0.1 | 0.1 | 0.1 | | 0.0 |
| 1.5sec | 0.1 | 0.1 | 0.1 | 0.1 | | 0.0 |

FIG. 30

| | ELAPSE TIME | DUTY (%) | M1 | M2 | M3 | M4 | . . . | M15 |
|---|---|---|---|---|---|---|---|---|
| (a) | 0.1 sec | 100 | 13.7 | 4.0 | 2.5 | 1.8 | . . . | 0.1 |
| (b) | 0.2 sec | 100 | 4.0 + 13.7 = 17.7 | 2.5 + 4.0 = 6.5 | 1.8 + 2.5 = 4.3 | 1.5 + 1.8 = 3.3 | . . . | 0.0 + 0.1 = 0.1 |
| (c) | 0.3 sec | 95 | 6.5 + 13.1 = 19.6 | 4.3 + 3.0 = 7.3 | 3.3 + 2.1 = 5.4 | 2.7 + 1.8 = 4.5 | . . . | 0.0 + 0.1 = 0.1 |
| (d) | 0.4 sec | 0 | 7.3 + 0.0 = 7.3 | 5.4 + 0.0 = 5.4 | 4.5 + 0.0 = 4.5 | 3.6 + 0.0 = 3.6 | . . . | 0.0 + 0.0 = 0.0 |

FIG. 32

| ELAPSE TIME \ DUTY (%) | 100 | 97.5 | 95.0 | 92.5 | ···DECREASE BY 2.5% FOR EACH··· CONTINUED STAGE | 0.0 |
|---|---|---|---|---|---|---|
| 0.1sec | 12.4 | 12.2 | 12.0 | 11.7 | | 0.0 |
| 0.2sec | 6.3 | 6.0 | 5.7 | 5.5 | | 0.0 |
| 0.3sec | 3.4 | 3.0 | 2.8 | 2.5 | | 0.0 |
| 0.4sec | 2.2 | 1.8 | 1.5 | 1.4 | | 0.0 |
| 0.5sec | 1.8 | 1.5 | 1.3 | 1.1 | | 0.0 |
| ⋮ | ⋮ | ⋮ | ⋮ | ⋮ | ····· | ⋮ |
| 59.5sec | 0.2 | 0.2 | 0.1 | 0.1 | | 0.0 |
| 59.6sec | 0.1 | 0.1 | 0.1 | 0.1 | | 0.0 |
| 59.7sec | 0.1 | 0.1 | 0.1 | 0.1 | | 0.0 |
| 59.8sec | 0.1 | 0.1 | 0.1 | 0.1 | | 0.0 |
| 59.9sec | 0.1 | 0.1 | 0.1 | 0.0 | | 0.0 |
| 60.0sec | 0.1 | 0.0 | 0.0 | 0.0 | | 0.0 |

FIG. 34

| DUTY (%) / ELAPSE TIME | 100 | 95 | 90 | 85 | DECREASE BY ···5.0% FOR EACH··· CONTINUED STAGE | 0.0 |
|---|---|---|---|---|---|---|
| 5sec | 60.4 | 57.2 | 54.0 | 50.8 | | 0.0 |
| 10sec | 18.1 | 15.8 | 12.2 | 8.9 | | 0.0 |
| 15sec | 8.5 | 6.8 | 5.2 | 4.4 | | 0.0 |
| ⋮ | ⋮ | ⋮ | ⋮ | ⋮ | ····· | ⋮ |
| 50sec | 2.1 | 1.8 | 1.7 | 1.6 | | 0.0 |
| 55sec | 1.3 | 1.0 | 0.9 | 0.9 | | 0.0 |
| 60sec | 0.5 | 0.4 | 0.3 | 0.3 | | 0.0 |

FIG. 35

| $T_R$ | $T_T$ | $T_R$ | $T_T$ | $T_R$ | $T_T$ | $T_R$ | $T_T$ |
|---|---|---|---|---|---|---|---|
| 0.0℃ | 35.5℃ | 17.5℃ | 26.0℃ | 35.0℃ | 15.0℃ | 52.5℃ | 15.0℃ |
| 0.5℃ | 35.5℃ | 18.0℃ | 26.0℃ | 35.5℃ | 15.0℃ | 53.0℃ | 15.0℃ |
| 1.0℃ | 35.5℃ | 18.5℃ | 25.5℃ | 36.0℃ | 15.0℃ | 53.5℃ | 15.0℃ |
| 1.5℃ | 35.5℃ | 19.0℃ | 25.5℃ | 36.5℃ | 15.0℃ | 54.0℃ | 15.0℃ |
| 2.0℃ | 35.5℃ | 19.5℃ | 25.0℃ | 37.0℃ | 15.0℃ | 54.5℃ | 15.0℃ |
| 2.5℃ | 35.5℃ | 20.0℃ | 24.5℃ | 37.5℃ | 15.0℃ | 55.0℃ | 15.0℃ |
| 3.0℃ | 35.5℃ | 20.5℃ | 24.5℃ | 38.0℃ | 15.0℃ | 55.5℃ | 15.0℃ |
| 3.5℃ | 35.5℃ | 21.0℃ | 24.0℃ | 38.5℃ | 15.0℃ | 56.0℃ | 15.0℃ |
| 4.0℃ | 35.5℃ | 21.5℃ | 24.0℃ | 39.0℃ | 15.0℃ | 56.5℃ | 15.0℃ |
| 4.5℃ | 35.5℃ | 22.0℃ | 23.5℃ | 39.5℃ | 15.0℃ | 57.0℃ | 15.0℃ |
| 5.0℃ | 35.5℃ | 22.5℃ | 23.5℃ | 40.0℃ | 15.0℃ | 57.5℃ | 15.0℃ |
| ⋮ | | | | | | | |
| 11.5℃ | 30.5℃ | 29.0℃ | 19.0℃ | 46.5℃ | 15.0℃ | 64.0℃ | 15.0℃ |
| 12.0℃ | 30.0℃ | 29.5℃ | 18.5℃ | 47.0℃ | 15.0℃ | 64.5℃ | 15.0℃ |
| 12.5℃ | 29.5℃ | 30.0℃ | 18.0℃ | 47.5℃ | 15.0℃ | 65.0℃ | 15.0℃ |
| 13.0℃ | 29.0℃ | 30.5℃ | 18.0℃ | 48.0℃ | 15.0℃ | 65.5℃ | 15.0℃ |
| 13.5℃ | 28.5℃ | 31.0℃ | 17.5℃ | 48.5℃ | 15.0℃ | 66.0℃ | 15.0℃ |
| 14.0℃ | 28.5℃ | 31.5℃ | 17.0℃ | 49.0℃ | 15.0℃ | 66.5℃ | 15.0℃ |
| 14.5℃ | 28.0℃ | 32.0℃ | 17.0℃ | 49.5℃ | 15.0℃ | 67.0℃ | 15.0℃ |
| 15.0℃ | 27.5℃ | 32.5℃ | 16.5℃ | 50.0℃ | 15.0℃ | 67.5℃ | 15.0℃ |
| 15.5℃ | 27.0℃ | 33.0℃ | 16.0℃ | 50.5℃ | 15.0℃ | 68.0℃ | 15.0℃ |
| 16.0℃ | 27.0℃ | 33.5℃ | 16.0℃ | 51.0℃ | 15.0℃ | 68.5℃ | 15.0℃ |
| 16.5℃ | 26.5℃ | 34.0℃ | 15.5℃ | 51.5℃ | 15.0℃ | 69.0℃ | 15.0℃ |
| 17.0℃ | 26.5℃ | 34.5℃ | 15.0℃ | 52.0℃ | 15.0℃ | 69.5℃ | 15.0℃ |

$T_R$ : SURROUNDING TEMPERATURE $T_T$ : TARGET TEMPERATURE a : EQUILIBRIUM TEMP
Δt : INCREASED TEMP

FIG. 38

| HEAT SOURCE / THERMAL TIME CONSTANT | EJECTION HEATER | | SUB-HEATER | |
|---|---|---|---|---|
| | SHORT | LONG | SHORT | LONG |
| REQUIRED CALCULATION INTERVAL | 0.05sec | 1.00sec | 0.05sec | 1.00sec |
| DATA HOLD TIME | 0.80sec | 512sec | 0.80sec | 512sec |

FIG. 39

| | 0.0% ~ | 2.5% ~ | 5.0% ~ | 7.5% ~ | 10.0% ~ | 12.5% ~ | 87.5% ~ | 90.0% ~ | 92.5% ~ | 95.0% ~ | 97.5% ~ |
|---|---|---|---|---|---|---|---|---|---|---|---|
| 0.05sec~ | 0.00 | 0.89 | 1.56 | 2.22 | 2.89 | 3.66 | 14.11 | 14.21 | 14.32 | 14.42 | 14.53 |
| 0.10sec~ | 0.00 | 0.43 | 0.62 | 0.41 | 1.01 | 1.24 | 4.89 | 4.93 | 4.97 | 5.00 | 5.04 |
| 0.15sec~ | 0.00 | 0.20 | 0.25 | 0.30 | 0.35 | 0.42 | 1.70 | 1.71 | 1.72 | 1.74 | 1.75 |
| 0.20sec~ | 0.00 | 0.09 | 0.10 | 0.11 | 0.12 | 0.14 | 0.59 | 0.59 | 0.60 | 0.60 | 0.61 |
| 0.25sec~ | 0.00 | 0.04 | 0.05 | 0.07 | 0.08 | 0.09 | 0.17 | 0.17 | 0.17 | 0.17 | 0.17 |
| 0.30sec~ | 0.00 | 0.04 | 0.05 | 0.07 | 0.08 | 0.09 | 0.17 | 0.17 | 0.17 | 0.17 | 0.17 |
| 0.35sec~ | 0.00 | 0.04 | 0.05 | 0.07 | 0.08 | 0.09 | 0.17 | 0.17 | 0.17 | 0.17 | 0.17 |
| 0.40sec~ | 0.00 | 0.04 | 0.05 | 0.07 | 0.08 | 0.09 | 0.17 | 0.17 | 0.17 | 0.17 | 0.17 |
| 0.45sec~ | 0.00 | 0.04 | 0.05 | 0.07 | 0.08 | 0.09 | 0.17 | 0.17 | 0.17 | 0.17 | 0.17 |
| 0.50sec~ | 0.00 | 0.04 | 0.05 | 0.07 | 0.08 | 0.09 | 0.17 | 0.17 | 0.17 | 0.17 | 0.17 |
| 0.55sec~ | 0.00 | 0.04 | 0.05 | 0.07 | 0.08 | 0.09 | 0.17 | 0.17 | 0.17 | 0.17 | 0.17 |
| 0.60sec~ | 0.00 | 0.04 | 0.05 | 0.07 | 0.08 | 0.09 | 0.17 | 0.17 | 0.17 | 0.17 | 0.17 |
| 0.65sec~ | 0.00 | 0.04 | 0.05 | 0.07 | 0.08 | 0.09 | 0.17 | 0.17 | 0.17 | 0.17 | 0.17 |
| 0.70sec~ | 0.00 | 0.04 | 0.05 | 0.07 | 0.08 | 0.09 | 0.17 | 0.17 | 0.17 | 0.17 | 0.17 |
| 0.75sec~ | 0.00 | 0.04 | 0.05 | 0.07 | 0.08 | 0.09 | 0.17 | 0.17 | 0.17 | 0.17 | 0.17 |
| 0.80sec~ | 0.00 | 0.04 | 0.05 | 0.07 | 0.08 | 0.09 | 0.17 | 0.17 | 0.17 | 0.17 | 0.17 |
| 0.85sec~ | 0.00 | 0.00 | 0.00 | 0.00 | 0.00 | 0.00 | 0.00 | 0.00 | 0.00 | 0.00 | 0.00 |

FIG. 40

| | 0.0% ~ | 2.5% ~ | 5.0% ~ | 7.5% ~ | 10.0% ~ | 12.5% ~ | 87.5% ~ | 90.0% ~ | 92.5% ~ | 95.0% ~ | 97.5% ~ |
|---|---|---|---|---|---|---|---|---|---|---|---|
| 1sec ~ | 0.00 | 0.15 | 0.27 | 0.39 | 0.52 | 0.62 | 2.65 | 2.68 | 2.75 | 2.75 | 2.79 |
| 3sec ~ | 0.00 | 0.08 | 0.16 | 0.24 | 0.32 | 0.37 | 0.79 | 0.80 | 0.81 | 0.81 | 0.82 |
| 5sec ~ | 0.00 | 0.07 | 0.09 | 0.11 | 0.13 | 0.17 | 0.48 | 0.49 | 0.49 | 0.50 | 0.50 |
| 7sec ~ | 0.00 | 0.12 | 0.14 | 0.16 | 0.18 | 0.20 | 0.70 | 0.70 | 0.71 | 0.71 | 0.72 |
| 9sec ~ | 0.00 | 0.06 | 0.11 | 0.15 | 0.20 | 0.22 | 0.43 | 0.43 | 0.43 | 0.44 | 0.44 |
| 11sec ~ | 0.00 | 0.05 | 0.07 | 0.09 | 0.11 | 0.13 | 0.38 | 0.39 | 0.39 | 0.39 | 0.40 |
| 21sec ~ | 0.00 | 0.04 | 0.05 | 0.06 | 0.07 | 0.08 | 0.17 | 0.17 | 0.17 | 0.17 | 0.17 |
| 41sec ~ | 0.00 | 0.03 | 0.04 | 0.05 | 0.06 | 0.06 | 0.17 | 0.17 | 0.17 | 0.17 | 0.17 |
| 61sec ~ | 0.00 | 0.02 | 0.03 | 0.04 | 0.05 | 0.05 | 0.10 | 0.10 | 0.10 | 0.11 | 0.11 |
| 81sec ~ | 0.00 | 0.01 | 0.02 | 0.03 | 0.04 | 0.04 | 0.06 | 0.06 | 0.06 | 0.06 | 0.06 |
| 101sec ~ | 0.00 | 0.02 | 0.02 | 0.02 | 0.03 | 0.03 | 0.06 | 0.06 | 0.06 | 0.06 | 0.06 |
| 151sec ~ | 0.00 | 0.01 | 0.01 | 0.01 | 0.02 | 0.02 | 0.03 | 0.03 | 0.03 | 0.03 | 0.03 |
| 301sec ~ | 0.00 | 0.01 | 0.01 | 0.01 | 0.01 | 0.01 | 0.02 | 0.02 | 0.02 | 0.02 | 0.02 |
| 512sec ~ | 0.00 | 0.00 | 0.00 | 0.00 | 0.00 | 0.00 | 0.00 | 0.00 | 0.00 | 0.00 | 0.00 |

FIG. 41

| | 0.0% ~ | 20.0% ~ | 40.0% ~ | 60.0% ~ | 80.0% ~ |
|---|---|---|---|---|---|
| 0.05sec~ | 3.57 | 7.00 | 6.26 | 10.10 | 11.64 |
| 0.10sec~ | 2.25 | 4.20 | 4.10 | 6.24 | 7.16 |
| 0.15sec~ | 1.45 | 2.52 | 2.69 | 3.85 | 4.40 |
| 0.20sec~ | 0.93 | 1.51 | 1.76 | 2.38 | 2.71 |
| 0.25sec~ | 0.10 | 0.23 | 0.06 | 2.14 | 2.10 |
| 0.30sec~ | 0.15 | 0.24 | 0.24 | 0.55 | 0.68 |
| 0.35sec~ | 0.00 | 0.24 | 0.24 | 0.55 | 0.68 |
| 0.40sec~ | 0.00 | 0.24 | 0.24 | 0.55 | 0.68 |
| 0.45sec~ | 0.00 | 0.24 | 0.24 | 0.55 | 0.68 |
| 0.50sec~ | 0.00 | 0.24 | 0.24 | 0.55 | 0.68 |
| 0.55sec~ | 0.00 | 0.24 | 0.24 | 0.55 | 0.68 |
| 0.60sec~ | 0.00 | 0.24 | 0.24 | 0.55 | 0.68 |
| 0.65sec~ | 0.00 | 0.24 | 0.24 | 0.55 | 0.68 |
| 0.70sec~ | 0.00 | 0.24 | 0.24 | 0.55 | 0.68 |
| 0.75sec~ | 0.00 | 0.24 | 0.24 | 0.55 | 0.68 |
| 0.80sec~ | 0.00 | 0.24 | 0.24 | 0.55 | 0.68 |
| 0.85sec~ | 0.00 | 0.00 | 0.00 | 0.00 | 0.00 |

FIG. 42

| | 0.0% ~ | 2.5% ~ | 5.0% ~ | 7.5% ~ | 10.0% ~ | 12.5% ~ | 15.5% ~ | 87.5% ~ | 90.0% ~ | 92.5% ~ | 95.0% ~ | 97.5% ~ |
|---|---|---|---|---|---|---|---|---|---|---|---|---|
| 1sec~ | 0.00 | 0.11 | 0.14 | 0.18 | 0.21 | 0.27 | 0.33 | 1.74 | 1.83 | 1.91 | 2.00 | 2.08 |
| 3sec~ | 0.00 | 0.14 | 0.13 | 0.12 | 0.12 | 0.16 | 0.20 | 0.66 | 0.67 | 0.67 | 0.68 | 0.68 |
| 5sec~ | 0.00 | 0.02 | 0.04 | 0.06 | 0.08 | 0.09 | 0.10 | 0.40 | 0.41 | 0.41 | 0.41 | 0.42 |
| 7sec~ | 0.00 | 0.03 | 0.07 | 0.10 | 0.13 | 0.14 | 0.15 | 0.51 | 0.54 | 0.56 | 0.58 | 0.60 |
| 9sec~ | 0.00 | 0.06 | 0.07 | 0.08 | 0.08 | 0.11 | 0.13 | 0.35 | 0.36 | 0.36 | 0.36 | 0.37 |
| 11sec~ | 0.00 | 0.04 | 0.04 | 0.05 | 0.06 | 0.07 | 0.08 | 0.30 | 0.31 | 0.32 | 0.32 | 0.33 |
| 21sec~ | 0.00 | 0.02 | 0.03 | 0.04 | 0.04 | 0.05 | 0.06 | 0.14 | 0.14 | 0.14 | 0.14 | 0.14 |
| 41sec~ | 0.00 | 0.02 | 0.02 | 0.03 | 0.04 | 0.04 | 0.04 | 0.13 | 0.13 | 0.13 | 0.14 | 0.14 |
| 61sec~ | 0.00 | 0.02 | 0.02 | 0.02 | 0.03 | 0.03 | 0.04 | 0.08 | 0.08 | 0.09 | 0.09 | 0.09 |
| 81sec~ | 0.00 | 0.01 | 0.01 | 0.02 | 0.02 | 0.02 | 0.03 | 0.06 | 0.05 | 0.05 | 0.05 | 0.05 |
| 101sec~ | 0.00 | 0.01 | 0.01 | 0.02 | 0.02 | 0.02 | 0.02 | 0.04 | 0.04 | 0.05 | 0.05 | 0.05 |
| 151sec~ | 0.00 | 0.01 | 0.01 | 0.01 | 0.01 | 0.01 | 0.01 | 0.02 | 0.02 | 0.02 | 0.02 | 0.02 |
| 301sec~ | 0.00 | 0.00 | 0.00 | 0.01 | 0.01 | 0.01 | 0.01 | 0.01 | 0.01 | 0.01 | 0.01 | 0.01 |
| 512sec~ | 0.00 | 0.00 | 0.00 | 0.00 | 0.00 | 0.00 | 0.00 | 0.00 | 0.00 | 0.00 | 0.00 | 0.00 |

FIG. 44

| TEMP DIFFERENCE | SET-UP | PRE-HEAT | INTERVAL | MAIN | WEIGHT |
|---|---|---|---|---|---|
| -52.5℃～ | 0.905μsec | 0.000μsec | 0.000μsec | 4.525μsec | 60% |
| -49.5℃～ | 0.905μsec | 0.000μsec | 0.000μsec | 4.525μsec | 60% |
| -46.5℃～ | 0.905μsec | 0.000μsec | 0.000μsec | 4.525μsec | 60% |
| -43.5℃～ | 0.905μsec | 0.000μsec | 0.000μsec | 4.525μsec | 60% |
| -40.5℃～ | 0.905μsec | 0.000μsec | 0.000μsec | 4.525μsec | 60% |
| -37.5℃～ | 0.905μsec | 0.000μsec | 0.000μsec | 4.525μsec | 60% |
| -34.5℃～ | 0.905μsec | 0.000μsec | 0.000μsec | 4.525μsec | 60% |
| -31.5℃～ | 0.905μsec | 0.000μsec | 0.000μsec | 4.525μsec | 60% |
| -28.5℃～ | 0.905μsec | 0.000μsec | 0.000μsec | 4.887μsec | 64% |
| -25.5℃～ | 0.905μsec | 0.000μsec | 0.000μsec | 5.068μsec | 68% |
| -22.5℃～ | 0.905μsec | 0.000μsec | 0.000μsec | 5.249μsec | 72% |
| -19.5℃～ | 0.905μsec | 0.000μsec | 0.000μsec | 5.611μsec | 76% |
| -16.5℃～ | 0.905μsec | 0.000μsec | 0.000μsec | 5.972μsec | 80% |
| -13.5℃～ | 0.905μsec | 0.000μsec | 0.000μsec | 5.973μsec | 84% |
| -10.5℃～ | 0.905μsec | 0.000μsec | 0.000μsec | 6.335μsec | 88% |
| -7.5℃～ | 0.905μsec | 0.000μsec | 0.000μsec | 6.516μsec | 92% |
| -4.5℃～ | 0.905μsec | 0.000μsec | 0.000μsec | 6.697μsec | 96% |
| -1.5℃～ | 0.905μsec | 0.000μsec | 0.000μsec | 7.059μsec | 100% |
| 1.5℃～ | 0.905μsec | 1.991μsec | 0.543μsec | 5.068μsec | 100% |
| 4.5℃～ | 0.905μsec | 1.991μsec | 0.905μsec | 5.068μsec | 100% |
| 7.5℃～ | 0.905μsec | 1.991μsec | 1.448μsec | 5.068μsec | 100% |
| 10.5℃～ | 0.905μsec | 1.991μsec | 1.991μsec | 5.068μsec | 100% |
| 13.5℃～ | 0.905μsec | 1.991μsec | 1.991μsec | 5.068μsec | 100% |
| 16.5℃～ | 0.905μsec | 1.991μsec | 1.991μsec | 5.068μsec | 100% |
| 19.5℃～ | 0.905μsec | 1.991μsec | 1.991μsec | 5.068μsec | 100% |
| 22.5℃～ | 0.905μsec | 1.991μsec | 1.991μsec | 5.068μsec | 100% |
| 25.5℃～ | 0.905μsec | 1.991μsec | 1.991μsec | 5.068μsec | 100% |
| 28.5℃～ | 0.905μsec | 1.991μsec | 1.991μsec | 5.068μsec | 100% |
| 31.5℃～ | 0.905μsec | 1.991μsec | 1.991μsec | 5.068μsec | 100% |
| 34.5℃～ | 0.905μsec | 1.991μsec | 1.991μsec | 5.068μsec | 100% |
| 37.5℃～ | 0.905μsec | 1.991μsec | 1.991μsec | 5.068μsec | 100% |

FIG. 46

| TEMP DIFFERENCE | LONG | SHORT |
|---|---|---|
| 0℃ | 0.0sec | 0msec |
| 1℃ | 0.0sec | 0msec |
| 2℃ | 0.0sec | 0msec |
| 3℃ | 0.0sec | 0msec |
| 4℃ | 0.0sec | 0msec |
| 5℃ | 0.0sec | 0msec |
| 6℃ | 0.0sec | 0msec |
| 7℃ | 0.0sec | 0msec |
| 8℃ | 0.0sec | 0msec |
| 9℃ | 0.0sec | 0msec |
| 10℃ | 0.0sec | 0msec |
| 11℃ | 0.0sec | 0msec |
| 12℃ | 0.0sec | 0msec |
| 13℃ | 0.0sec | 0msec |
| 14℃ | 0.1sec | 10msec |
| 15℃ | 0.2sec | 20msec |
| 16℃ | 0.4sec | 40msec |
| 17℃ | 0.5sec | 50msec |
| 18℃ | 0.6sec | 60msec |
| 19℃ | 0.7sec | 70msec |
| 20℃ | 0.8sec | 80msec |
| 21℃ | 0.9sec | 90msec |
| 22℃ | 1.1sec | 110msec |
| 23℃ | 1.2sec | 120msec |
| 24℃ | 1.3sec | 130msec |
| 25℃ | 1.4sec | 140msec |
| 26℃ | 1.5sec | 150msec |
| 27℃ | 1.7sec | 160msec |
| 28℃ | 1.8sec | 180msec |
| 29℃ | 1.9sec | 190msec |
| 30℃ | 2.0sec | 200msec |
| 31℃ | 2.0sec | 200msec |
| 32℃ | 2.0sec | 200msec |
| 33℃ | 2.0sec | 200msec |
| 34℃ | 2.0sec | 200msec |
| 35℃ | 2.0sec | 200msec |
| 36℃ | 2.0sec | 200msec |
| 37℃ | 2.0sec | 200msec |
| 38℃ | 2.0sec | 200msec |
| 39℃ | 2.0sec | 200msec |

FIG. 49

| PRESUMED HEAD TEMP (℃) | PULSE WIDTH (μsec) |
|---|---|
| 20 ~ 30 | 7.0 |
| 30 ~ 40 | 6.5 |
| 40 ~ 50 | 6.0 |
| 50 ~ | 5.5 |

FIG. 50

| PRESUMED HEAD TEMP (℃) | 1 ~ 16 NOZZLES | 17 ~ 48 NOZZLES | 49 ~ 64 NOZZLES |
|---|---|---|---|
| 20 ~ 30 | 10 | 8 | 10 |
| 30 ~ 40 | 10 | 7 | 10 |
| 40 ~ 50 | 10 | 6 | 10 |
| 50 ~ | 10 | 5 | 10 |

| PRESUMED HEAD TEMP (°C) | Y, M, C | Bk |
|---|---|---|
| 20 ~ 30 | 16 | 24 |
| 30 ~ 40 | 14 | 21 |
| 40 ~ 50 | 12 | 18 |
| 50 ~ | 10 | 15 |

| SURROUNDING TEMP (℃) | TARGET TEMP (℃) |
|---|---|
| ~ 12 | 35 |
| 12 ~ 15 | 34 |
| 15 ~ 18 | 33 |
| 18 ~ 21 | 33 |
| 21 ~ 24 | 33 |
| 24 ~ 27 | 32 |
| 27 ~ 30 | 32 |
| 30 ~ | 32 |

FIG. 61A

| PWM RANK | DIFFERENCE (℃) | INTERVAL TIME T2 (μsec) |
|---|---|---|
| 1 | ~ -18 | 8.0 |
| 2 | -18 ~ -16 | 6.0 |
| 3 | -16 ~ -14 | 4.5 |
| 4 | -14 ~ -12 | 3.5 |
| 5 | -12 ~ -10 | 3.0 |
| 6 | -10 ~ -8 | 2.5 |
| 7 | -8 ~ -6 | 2.0 |
| 8 | -6 ~ -4 | 1.5 |
| 9 | -4 ~ -2 | 1.0 |
| 10 | -2 ~ | 0.0 |

FIG. 61B

| PWM RANK | DIFFERENCE (℃) | PRE-PULSE TIME T1 (μsec) |
|---|---|---|
| 1 | ~ -18 | 3.0 |
| 2 | -18 ~ -16 | 2.5 |
| 3 | -16 ~ -14 | 2.0 |
| 4 | -14 ~ -12 | 1.5 |
| 5 | -12 ~ -10 | 1.2 |
| 6 | -10 ~ -8 | 1.0 |
| 7 | -8 ~ -6 | 0.7 |
| 8 | -6 ~ -4 | 0.4 |
| 9 | -4 ~ -2 | 0.2 |
| 10 | -2 ~ | 0.0 |

FIG. 63

| | PRE-PULSE T1 | INTERVAL TIME T2 | MAIN PULSE T3 |
|---|---|---|---|
| PWM1 | 2. 0μsec | 0. 0μsec | 5. 0μsec |
| PWM2 | 2. 0μsec | 2. 0μsec | 5. 0μsec |
| PWM3 | 2. 0μsec | 4. 0μsec | 5. 0μsec |
| PWM4 | 2. 0μsec | 6. 0μsec | 5. 0μsec |

FIG. 65

| T2 \ T1 | 2. 0μsec | 2. 5μsec | 3. 0μsec |
|---|---|---|---|
| 0μsec | 100% | 100% | 100% |
| 2μsec | 117% | 122% | 128% |
| 5μsec | 125% | 133% | 142% |
| 8μsec | 130% | 140% | 150% |

FIG. 73

| INTERVAL (μsec) | MAIN PULSE VALUE (μsec) |
|---|---|
| 5.5 | 5.0 |
| 5.0 | 4.0 |
| 4.5 | 3.5 |
| 4.0 | 3.0 |
| 3.0 | 2.5 |
| 2.0 | 2.25 |
| 1.0 | 2.0 |
| 0.0 | 3.0 |

FIG. 74

| PRE-PULSE VALUE (μsec) | MAIN PULSE VALUE (μsec) |
|---|---|
| 0 | 5.0 |
| 0.5 | 4.0 |
| 1.0 | 3.5 |
| 1.5 | 3.0 |
| 2.0 | 2.5 |
| 2.5 | 2.25 |
| 3.0 | 2.0 |
| 3.5 | 1.90 |

PULSE WIDTH (T11 TO T15) [μsec] FOR METHOD A

PULSE WIDTH (T1) [μsec] FOR METHOD C

PULSE WIDTH (T2) [μsec] FOR METHOD B

INK JET RECORDING HAVING TEMPERATURE CONTROL FUNCTION

This application is a division of application Ser. No. 07/921,832 filed July 30, 1992 abandoned.

BACKGROUND OF THE INVENTION

1. Field of the Invention

The present invention relates to an ink jet recording apparatus for stably performing recording by ejecting an ink from a recording head to a recording medium and also to a temperature calculation method for calculating a temperature drift of the recording head.

2. Related Background Art

In the recent industrial fields, various products for converting input energy into heat, and utilizing the converted heat energy have been developed. In most of such products utilizing the heat energy, the relationship between the time and the temperature of an object obtained based on the input energy is an important control item.

A recording apparatus such as a printer, a copying machine, a facsimile machine, or the like records an image consisting of dot patterns on a recording medium such as a paper sheet, a plastic thin film, or the like on the basis of image information. The recording apparatuses can be classified into an ink jet type, a wire dot type, a thermal type, a laser beam type, and the like. Of these types, the ink jet type apparatus (ink jet recording apparatus) ejects flying ink (recording liquid) droplets from ejection orifices of a recording head, and attaches the ink droplets to a recording medium, thus attaining recording.

In recent years, a large number of recording apparatuses are used, and have requirements for high-speed recording, high resolution, high image quality, low noise, and the like. As a recording apparatus which can meet such requirements, the ink jet recording apparatus is known. In the ink jet recording apparatus for performing recording by ejecting an ink from a recording head, stabilization of ink ejection and stabilization of an ink ejection quantity required for meeting the requirements are considerably influenced by the temperature of the ink in an ejection unit. More specifically, when the temperature of the ink is too low, the viscosity of the ink is abnormally decreased, and the ink cannot be ejected with normal ejection energy. On the contrary, when the temperature is too high, the ejection quantity is increased, and the ink overflows on a recording sheet, resulting in degradation of image quality.

For this reason, in the conventional ink jet recording apparatus, a temperature sensor is arranged on a recording head unit, and a method of controlling the temperature of the ink in the ejection unit on the basis of the detection temperature of the recording head to fall within a desired range, or a method of controlling ejection recovery processing is employed. As the temperature control heater, a heater member joined to the recording head unit, or ejection heaters themselves in an ink jet recording apparatus for -performing recording by forming flying ink droplets by utilizing heat energy, i.e., in an apparatus for ejecting ink droplets by growing bubbles by film boiling of the ink, are often used. When the ejection heaters are used, they must be energized or powered on so as not to produce bubbles.

In a recording apparatus for obtaining ejection ink droplets by forming bubbles in a solid state ink or liquid ink using heat energy, the ejection characteristics vary depending on the temperature of the recording head. Therefore, it is particularly important to control the temperature of the ink in the ejection unit and the temperature of the recording head, which considerably influences the temperature of the ink.

However, it is very difficult to measure the ink temperature in the ejection unit, which considerably influences the ejection characteristics as the important factor upon temperature control of the recording head, since the detection temperature of the sensor drifts beyond the temperature drift of the ink necessary in control because the ejection unit is also a heat source, and since the ink itself moves. For this reason, even if the temperature sensor is merely arranged near the recording head to measure the temperature of the ink upon ejection with high precision, it is rather difficult to measure the temperature drift of the ink itself.

As one means for controlling the temperature of the ink, an ink jet recording apparatus for indirectly realizing stabilization of the ink temperature by stabilizing the temperature of the recording head is proposed. U.S. Pat. No. 4,910,528 discloses an ink jet printer, which has a means for stabilizing the temperature of the recording head upon recording according to the predicted successive driving amount of ejection heaters with reference to the detection temperature of the temperature sensor arranged very close to the ejection heaters. More specifically, a heating means of the recording head, an energization means to the ejection heaters, a carriage drive control means for maintaining the temperature of the recording head below a predetermined value, a carriage scan delay means, a carriage scan speed decreasing means, a change means for a recording sequence of ink droplet ejection from the recording head, and the like are controlled according to the predicted temperature, thereby stabilizing the temperature of the recording head.

However, the ink jet printer disclosed in U.S. Pat. No. 4,910,528 may pose a problem such as a decrease in recording speed since it has priority to stabilization of the temperature of the recording head.

On the other hand, since a temperature detection member for the recording head, which is important upon temperature control of the recording head, normally suffers from variations, the detection temperatures often vary in units of recording heads. Thus, a method of calibrating or adjusting the temperature detection member of the recording head before delivery of the recording apparatus, or a method of providing a correction value of the temperature detection member to the recording head itself, and automatically correcting the detection temperature when the head is attached to the recording apparatus main body, is employed.

However, in the method of calibrating or adjusting the temperature detection member before delivery of the recording apparatus, when the recording head must be exchanged, or contrarily, when an electrical circuit board of the main body must be exchanged, the temperature detection member must be re-calibrated or re-adjusted, and jigs for re-calibration or re-adjustment must be prepared. In order to provide the correction value to the recording head itself, the correction value must be measured in units of recording heads, and a special memory means must be provided to the recording head. In addition, the main body must have a detection means for reading the correction value, resulting in demerits in terms of cost and the arrangement of the apparatus.

In the method of using the ejection heaters in temperature control, two major methods are proposed. One method is a method of simply using the ejection heaters in the same manner as a temperature keeping heater. In this method, short pulses, which do not cause production of bubbles, are continuously applied to the ejection heaters in a non-print state, e.g., in a standby state wherein no recording operation is performed, thereby keeping the temperature. The other method is a method based on multi-pulse PWM (pulse width modulation) control. In this method, in place of keeping the temperature in the non-print state such as the standby state, two pulses per ejection are applied to each heater, so that the temperature of the ink at a boundary portion with the heater is increased by the first pulse, and a bubble is produced by the next pulse, thus performing ejection. In order to change the ejection quantity in this method, the pulse width of the first pulse which is ON first is varied within a bubble non-production range to increase the energy quantity to be input to the heater, thereby increasing the temperature of the ink located at an interface portion with the heater.

However, the above-mentioned method, which is executed for the purpose of stabilizing the ejection quantity, has the following problems to be solved.

In the method using the temperature keeping heater, the entire head having a large heat capacity must be kept at a predetermined temperature by the temperature keeping heater, and extra energy therefor must be input. In addition, the temperature rise requires much time, and results in wait time in the first print operation. Furthermore, in a portable recording apparatus, since a battery must also be used for keeping the temperature, the maximum print count is undesirably decreased. When the temperature keeping heater and ejection heaters are simultaneously turned on, a large current must instantaneously flow through a power supply, a flexible cable, and the like, thus increasing cost and disturbing a compact structure.

In the method using the multi-pulse PWM control, since the pulse width of the second pulse for bubble production is fixed, and that of the first pulse is varied to vary the energy quantity to be input to the head so as to vary the ejection quantity, energy larger than normal must be supplied to the head in order to obtain the maximum ejection quantity. Therefore, although real-time characteristics can be remarkably improved as compared to the method using the temperature keeping heater, a further improvement is required for instantaneous power and the load on the battery.

It is also required to record a halftone image by controlling the ink ejection quantity according to a halftone signal. However, in the above-mentioned ejection quantity control, the ejection quantity variation range is not sufficient, and is required to be further widened.

SUMMARY OF THE INVENTION

The present invention has been made to solve the above-mentioned problems, and has as its object to provide an ink jet recording apparatus, which predicts the ink temperature in an ejection unit with high precision, and stabilizes ejection so as to correspond to the ink temperature drift.

It is another object of the present invention to provide an ink jet recording apparatus, which does not require special jigs upon exchange of a recording head or an electrical circuit board, and can precisely detect the temperature of the recording head without causing complicated processes and without an increase in cost depending on measurement of a correction value of the recording head and addition of reading means to an apparatus main body.

It is still another object of the present invention to provide a temperature calculation method for precisely calculating the temperature drift of an object without arranging a temperature sensor to the object.

It is still another object of the present invention to provide a recording apparatus, which can detect the temperature of the recording head without providing a temperature sensor to the recording head, and also to provide a recording apparatus, which can stabilize an ejection quantity, an ejection operation, and a recording operation.

It is still another object of the present invention to provide a recording apparatus, which can control the temperature of a recording head to fall within a desired range even when the print ratio is changed.

It is still another object of the present invention to provide an ink jet recording apparatus, which can stabilize an ejection quantity, and can widen a variation range of the ejection quantity even when a high-speed driving operation is performed.

In order to achieve the above objects, according to the present invention, there is provided an ink jet recording apparatus comprising a recording head for ejecting an ink from an ejection unit to cause a change in temperature in a recording period, temperature keeping means for maintaining a temperature of the recording head at a predetermined keeping temperature higher than an upper limit of a surrounding temperature range in which recording is possible, temperature prediction means for predicting an ink temperature in the ejection unit in the recording period prior to recording, and ejection stabilization means for stabilizing ink ejection from the ejection unit according to the ink temperature in the ejection unit predicted by the temperature prediction means.

According to the present invention, there is also provided an ink jet recording apparatus comprising a recording head for ejecting an ink from an ejection unit to cause a change-in temperature in a recording period, temperature keeping means for maintaining a temperature of the recording head at a predetermined keeping temperature higher than an upper limit of a surrounding temperature range in which recording is possible, surrounding temperature detection means for detecting a surrounding temperature in the recording period, temperature prediction means for predicting an ink temperature in the ejection unit in the recording period prior to recording using the surrounding temperature detected by the surrounding temperature detection means, and ejection stabilization means for stabilizing ink ejection from the ejection unit according to the ink temperature in the ejection unit predicted by the temperature prediction means.

According to the present invention, there is also provided an ink jet recording apparatus comprising a head temperature detection member provided to a recording head for ejecting an ink, a reference temperature detection member provided to a main body, and calibration means for calibrating a head temperature detected by the head temperature detection member at a predetermined timing on the basis of a reference temperature detected by the reference temperature detection means.

According to the present invention, there is also provided a temperature calculation method for detecting a temperature of an object, which varies according to input energy, comprising the steps of calculating, as a discrete value, a change in temperature of the object upon elapse of unit time on the basis of the energy input to the object in unit time, and accumulating the discrete values upon elapse of unit time to calculate the change in temperature of the object.

According to the present invention, there is also provided an ink jet recording apparatus for performing recording by supplying heat energy according to a driving pulse to an ink to form a bubble based on film boiling, and ejecting the ink from a recording head onto a recording medium on the basis of formation of the bubble, comprising driving means for supplying a pre-driving pulse that does not cause ink ejection and a main driving pulse that causes the ink ejection to have a rest period between the two pulses upon ejection of one ink droplet, and rest period control means for prolonging the rest period to conduct the heat energy by the pre-driving pulse, thereby increasing an ink region associated with formation of the bubble based on film boiling.

According to the present invention, there is also provided an ink jet recording apparatus for performing recording by supplying heat energy according to a driving pulse to an ink to form a bubble based on film boiling, and ejecting the ink from a recording head onto a recording medium on the basis of formation of the bubble, comprising driving means for supplying at least one driving pulse to the recording head upon ejection of one ink droplet, and driving pulse control means for limiting energy of an ejection driving pulse that causes ink ejection of the driving pulse supplied from the driving means after film boiling is started by heat energy supplied according to the ejection driving pulse.

BRIEF DESCRIPTION OF THE DRAWINGS

FIGS. 12A, 12B and 12C show ink temperature—pre-pulse conversion tables for ejection quantity control;

FIG. 13 shows a descent temperature table used in temperature prediction control;

FIG. 20 shows a temperature prediction table;

FIG. 29 shows a temperature calculation table according to the 19th embodiment of the present invention;

FIGS. 30(*a*), 30(*b*), 30(*c*) and 30(*d*) are views showing temperature calculation processes of the 19th embodiment;

FIG. 32 shows a temperature calculation table according to the 20th embodiment of the present invention;

FIG. 34 shows a temperature calculation table according to the 21st embodiment of the present invention;

FIG. 35 shows a target temperature table used in the 22nd embodiment;

FIG. 38 is a table showing the required calculation interval and the data hold time for performing a temperature calculation;

FIGS. 39, 40, 41 and 42 are calculation tables when ejection heaters or sub-heaters are used as a heat source and a time constant is determined by a short or long range member group;

FIG. 44 is a PWM table showing pulse widths corresponding to temperature differences between the target temperature and the head temperatures;

FIG. 46 is a table showing sub-heater driving control times corresponding to temperature differences between the target temperature and the head temperatures;

FIG. 49 is a table showing the relationship between the presumed head temperature and the pulse width;

FIG. 50 is a table showing the relationship between the presumed head temperature and a pre-ejection;

FIGS. 61A and 61B are tables showing the relationship between the temperature difference and the interval time of multi-pulse PWM control;

FIG. 63 is a table showing multi-pulse PWM setting values;

FIG. 65 is a table showing the relationship between modulation of the main pulse and interval time, and the ejection quantity change rate in multi-pulse PWM control;

FIG. 73 is a table showing the relationship between the interval time and the main pulse width;

FIG. 74 is a table showing the relationship between the pre-pulse width and the main pulse width;

DESCRIPTION OF THE PREFERRED EMBODIMENTS

Figure 1:
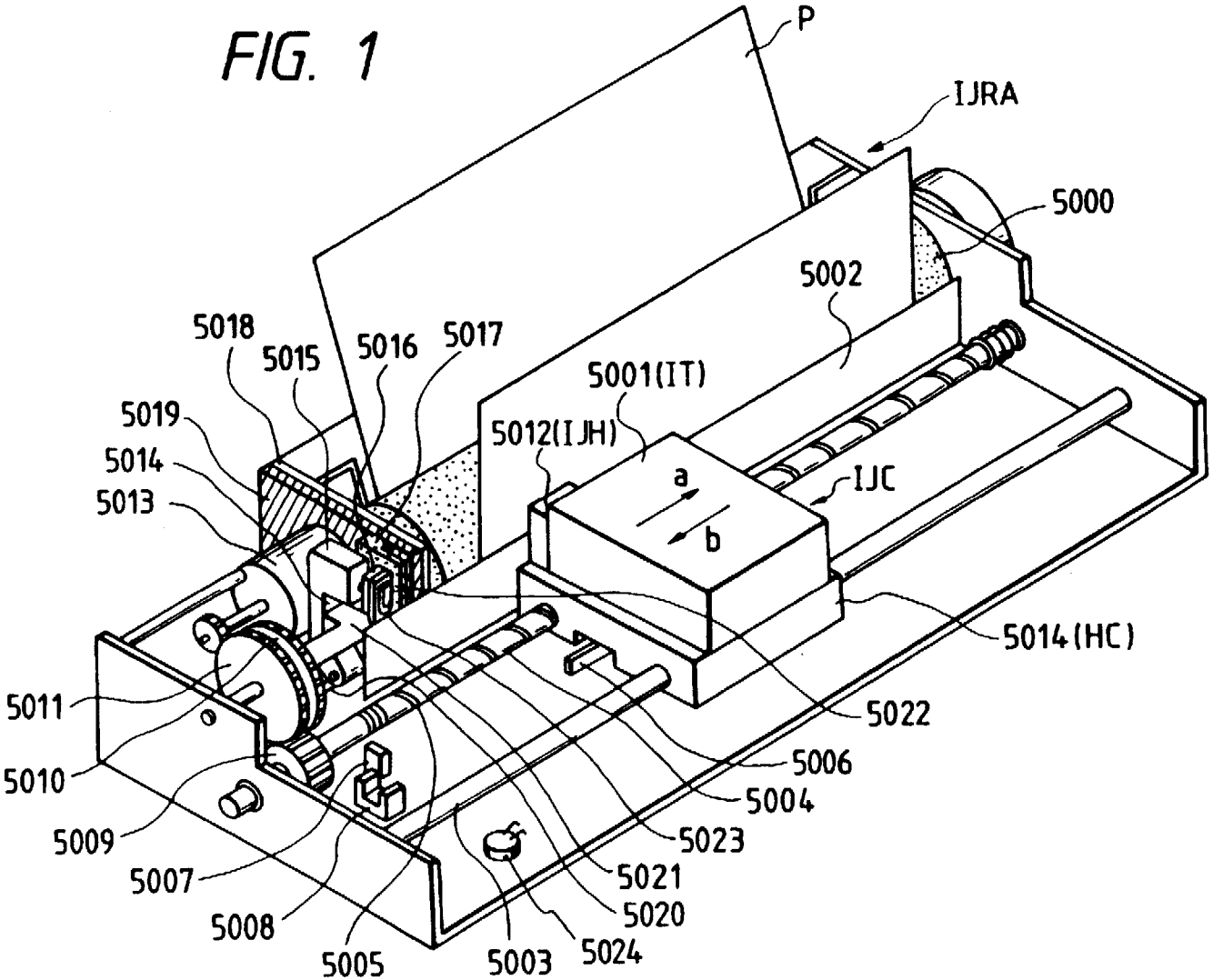
FIG. 1 is a perspective view showing an arrangement of a preferable ink jet recording apparatus which can embody or adopt the present invention.
Figure 2:
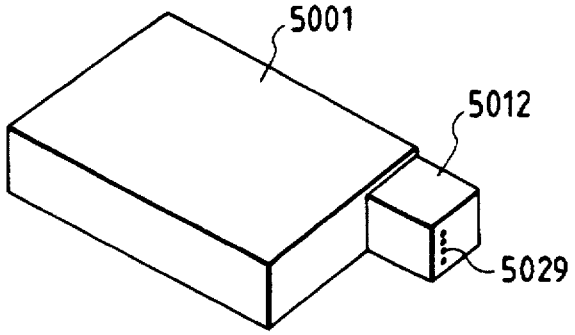
FIG. 2 is a perspective view showing an exchangeable cartridge.

The preferred embodiments of the present invention will be described in detail hereinafter with reference to the accompanying drawings. FIG. 1 is a perspective view showing an arrangement of a preferable ink jet recording apparatus IJRA, which can embody or adopt the present invention. In FIG. 1, a recording head (IJH) 5012 is coupled to an ink tank (IT) 5001. As shown in FIG. 2, the ink tank 5001 and the recording head 5012 form an exchangeable integrated cartridge (IJC). A carriage (HC) 5014 is used for mounting the cartridge (IJC) to a printer main body. A guide 5003 scans the carriage in the sub-scan direction.

A platen roller 5000 scans a print medium P in the main scan direction. A temperature sensor 5024 measures the surrounding temperature in the apparatus. The carriage 5014 is connected to a printed board (not shown) comprising an electrical circuit (the temperature sensor 5024, and the like) for controlling the printer through a flexible cable (not shown) for supplying a signal pulse current and a head temperature control current to the recording head 5012.

FIG. 2 shows the exchangeable cartridge, which has nozzle portions 5029 for ejecting ink droplets. The details of the ink jet recording apparatus IJRA with the above arrangement will be described below. In the recording apparatus IJRA,. the carriage HC has a pin (not shown) to be engaged with a spiral groove 5005 of a lead screw 5004, which is rotated through driving power transmission gears 5011 and 5009 in cooperation with the normal/reverse rotation of a driving motor 5013. The carriage HC can be reciprocally moved in directions of arrows a and b. A paper pressing plate 5002 presses a paper sheet against the platen roller 5000 across the carriage moving direction. Photocouplers 5007 and 5008 serve as home position detection means for detecting the presence of a lever 5006 of the carriage HC in a corresponding region, and switching the rotating direction of the motor 5013. A member 5016 supports a cap member 5022 for capping the front surface of the recording head. A suction means 5015 draws the interior of the cap member by vacuum suction, and performs a suction recovery process of the recording head 5012 through an opening 5023 in the cap member.

A cleaning blade 5017 is supported by a member 5019 to be movable in the back-and-forth direction. The cleaning blade 5017 and the member 5019 are supported on a main body support plate 5018. The blade is not limited to this shape, and a known cleaning blade can be applied to this embodiment, as a matter of course. A lever 5021 is used for starting the suction operation in the suction recovery process, and is moved upon movement of a cam 5020 to be engaged with the carriage HC. The movement control of the lever 5021 is made by a known transmission means such as a clutch switching means for transmitting the driving force from the driving motor.

The capping, cleaning, and suction recovery processes can be performed at corresponding positions upon operation of the lead screw 5005 when the carriage HC reaches a home position region. This embodiment is not limited to this as long as desired operations are performed at known timings.

Figure 3:
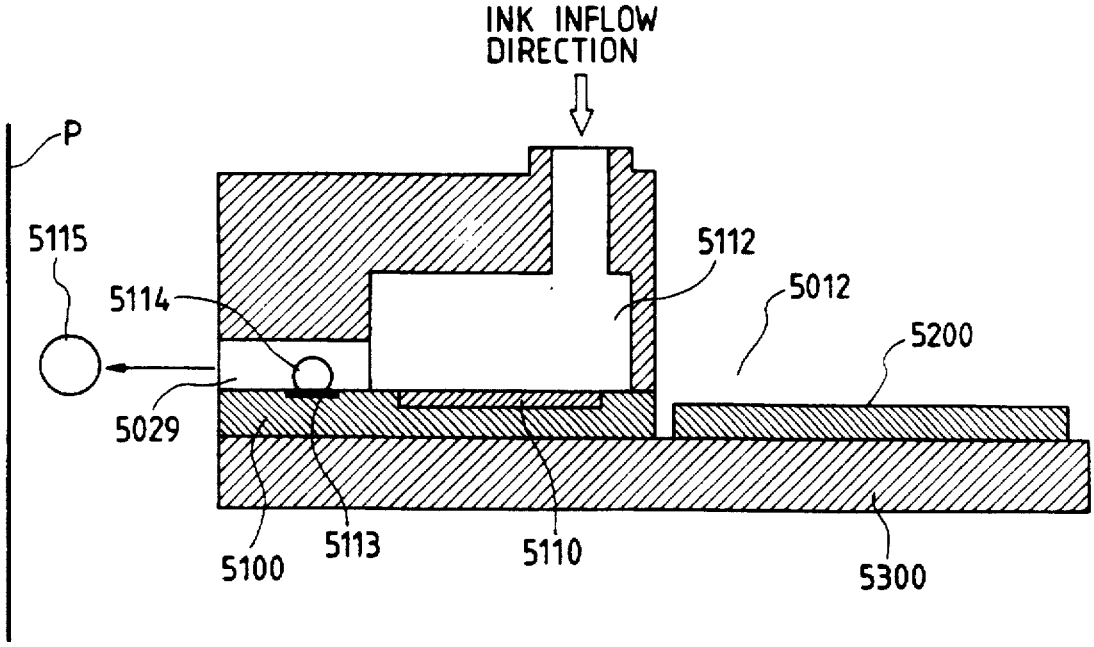
FIG. 3 is a sectional view of a recording head.

FIG. 3 shows the details of the recording head 5012. A heater board 5100 formed by a semiconductor manufacturing process is arranged on the upper surface of a support member 5300. A temperature control heater (temperature rise heater) 5110, formed by the same semiconductor manufacturing process, for keeping and controlling the temperature of the recording head 5012, is arranged on the heater board 5100. A wiring board 5200 is arranged on the support member 5300, and is connected to the temperature control heater 5110 and ejection (main) heaters 5113 through, e.g., bonding wires (not shown). The temperature control heater 5110 may be realized by adhering a heater member formed in a process different from that of the heater board 5100 to, e.g., the support member 5300.

A bubble 5114 is produced by heating an ink by the corresponding ejection heater 5113. An ink droplet 5115 is ejected from the corresponding nozzle portion 5029. The ink to be ejected flows from a common ink chamber 5112 into the recording head.

Figure 4:
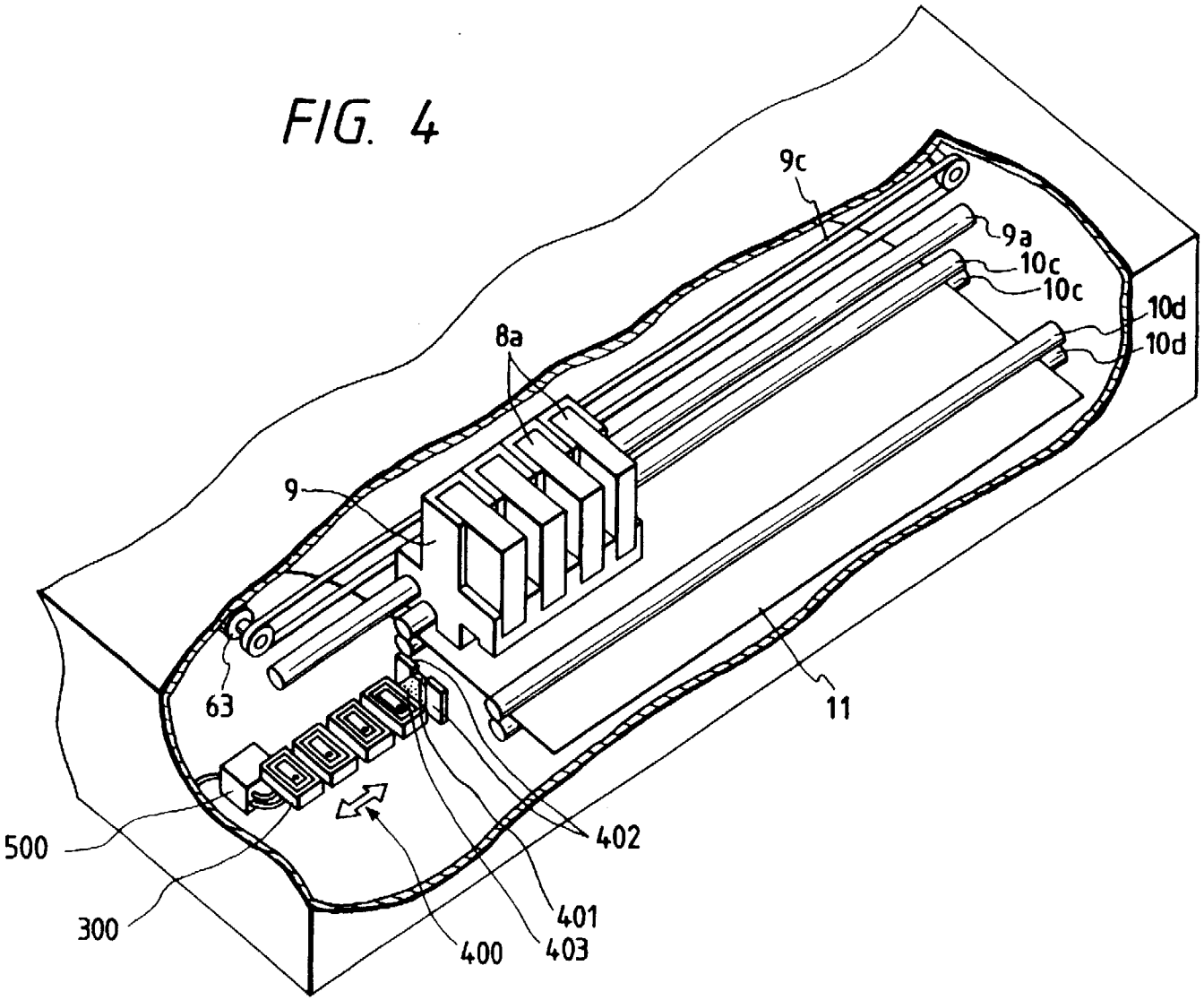
FIG. 4 is a perspective view of a carriage thermally coupled to the recording head.

An embodiment of the present invention will be described below with reference to the accompanying drawings. FIG. 4 is a schematic view of an ink jet recording apparatus which can adopt the present invention. In FIG. 4, an ink cartridge 8*a* has an ink tank portion as its upper portion, and recording heads 8*b* (not shown) as its lower portion. The ink cartridge 8*a* is provided with a connector for receiving, e.g., signals for driving the recording heads 8*b*. A carriage 9 aligns and carries four cartridges (which store different color inks, e.g., black, cyan, magenta, and yellow inks). The carriage 9 is provided with a connector holder, electrically connected to the recording heads 23, for transmitting, e.g., signals for driving recording heads.

The ink jet recording apparatus includes a scan rail 9*a*, extending in the main scan direction of the carriage 9, for slidably supporting the carriage 9, and a drive belt 9*c* for transmitting a driving force for reciprocally moving the carriage 9. The apparatus also includes pairs of convey rollers 10*c* and 10*d*, arranged before and after the recording positions of the recording heads, for clamping and conveying a recording medium, and a recording medium 11 such as a paper sheet, which is urged against a platen (not shown) for regulating a recording surface of the recording medium 11 to be flat. At this time, the recording head 8*b* of each ink jet cartridge 8*a* carried on the carriage 9 projects downward from the carriage 9, and is located between the convey rollers 10*c* and 10*d* for conveying the recording medium. The ejection orifice formation surface of each recording head faces parallel to the recording medium 11 urged against the guide surface of the platen (not shown). Note that the drive belt 9*c* is driven by a main scan motor 63, and the pairs of convey rollers 10*c* and 10*d* are driven by a sub-scan motor 64 (not shown).

In the ink jet recording apparatus of this embodiment, a recovery system unit is arranged at the home position side (at the left side in FIG. 4). The recovery system unit includes cap units 300 arranged in correspondence with the plurality of ink jet cartridges 8*a* each having the recording head 8*b*. Upon movement of the carriage 9, the cap units 300 can be slid in the right-to-left direction and be also vertically movable. When the carriage 9 is located at the home position, the cap units 300 are coupled to the corresponding recording heads 8*b* to cap them, thereby preventing an ejection error of the ink in the ejection orifices of the recording heads 8*b*. Such an ejection error is caused by evaporation and hence an increased viscosity and solidification of the attached inks.

The recovery system unit also includes a pump unit 500 communicating with the cap units 300. When the recording head 8*b* causes an ejection error, the pump unit 500 is used for generating a negative pressure in the suction recovery process executed by coupling the cap unit 300 and the corresponding recording head 8*b*. Furthermore, the recovery system unit includes a blade 401 as a wiping material formed of an elastic member such as rubber, and a blade holder 402 for holding the blade 401.

The four ink jet cartridges carried on the carriage 9 respectively use a black (to be abbreviated as K hereinafter) ink, a cyan (to be abbreviated as C hereinafter) ink, a magenta (be abbreviated to as M hereinafter) ink, and a yellow (to be abbreviated as Y hereinafter) ink. The inks overlap each other in this order. Intermediate colors can be realized by properly overlapping C, M, and Y color ink dots. More specifically, red can be realized by overlapping M and Y; blue, C and M; and green, C and Y. Black can be realized by overlapping three colors C, M, and Y. However, since black realized by overlapping three colors C, M, and Y has poor color development and precise overlapping of three colors is difficult, a chromatic edge is formed, and the ink implantation density per unit time becomes too high. For these reasons, only black is implanted separately (using a black ink).

(Control Arrangement)

Figure 5:
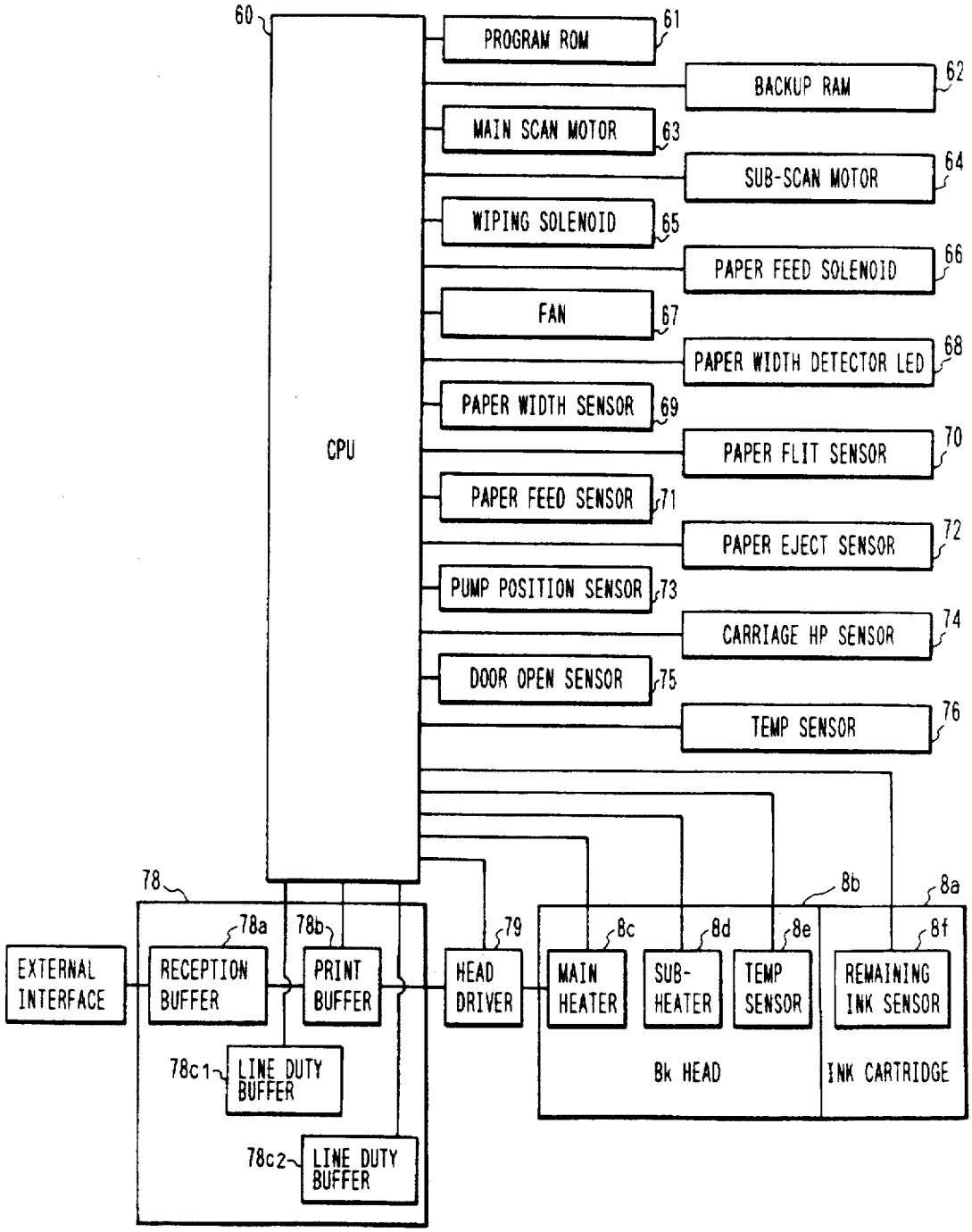
FIG. 5 is a block diagram showing a control arrangement for executing a recording control flow.

The control arrangement for executing recording control of the respective sections of the above-mentioned apparatus arrangement will be described below with reference to FIG. 5. In FIG. 5, a CPU 60 is connected to a program ROM 61 for storing a control program executed by the CPU 60, and a backup RAM 62 for storing various data. The CPU 60 is also connected to the main scan motor 63 for scanning the recording head, and the sub-scan motor 64 for feeding a recording sheet. The sub-scan motor 64 is also used in the suction operation by the pump. The CPU 60 is also connected to a wiping solenoid 65, a paper feed solenoid 66 used in paper feed control, a cooling fan 67, and a paper width detector LED 68 which is turned on in a paper width detection operation. The CPU 60 is also connected to a paper width sensor 69, a paper flit sensor 70, a paper feed sensor 71, a paper eject sensor 72, and a suction pump position sensor 73 for detecting the position of the suction pump. The CPU 60 is also connected to a carriage HP sensor 74 for detecting the home position of the carriage, a door open sensor 75 for detecting an open/closed state of a door, and a temperature sensor 76 for detecting the surrounding temperature.

The CPU 60 is also connected to a gate array 78 for performing supply control of recording data to the four color heads, a head driver 79 for driving the heads, the ink cartridges 8*a* for four colors, and the recording heads 8*b* for four colors. FIG. 5 representatively illustrates the Bk (black) ink cartridge 8*a* and the Bk recording head 8*b*. The head 8*b* has main heaters 8*c* for ejecting the ink, sub-heaters 8*d* for performing temperature control of the head, and temperature sensors 8*e* for detecting the head temperature.

Figure 6:
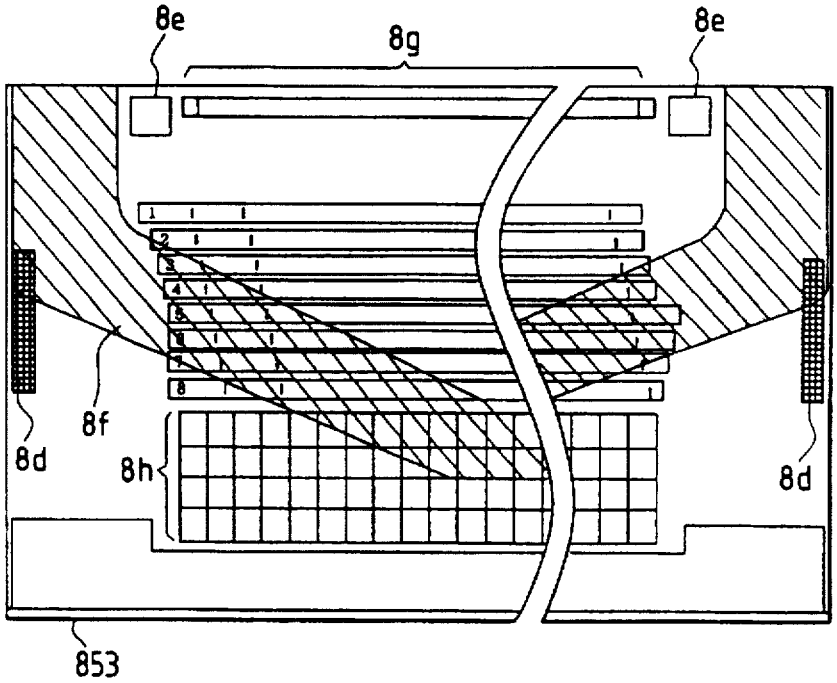
FIG. 6 is a view showing the positional relationship among sub-heaters, ejection (main) heaters, and a temperature sensor of the head used in this embodiment.

FIG. 6 is a view showing a heater board (H.B) 853 of the head used in this embodiment. Ejection unit arrays 8*g* on which the temperature control (sub) heaters 8*d* and the ejection (main) heaters 8*c* are arranged, the temperature sensors 8*e*, driving elements 8*h* are formed on a single substrate to have the positional relationship shown in FIG. 6. When the elements are arranged on the single substrate, detection and control of the head temperature can be efficiently performed, and a compact head and a simple manufacturing process can be realized. FIG. 6 also shows the positional relationship of outer wall sections 8*f* of a top plate for separating the H.B into a region filled with the ink, and the remaining region.

(First Embodiment)

An embodiment of the present invention will be described in detail below with reference to the accompanying drawings. In this embodiment, a temperature detection member capable of directly detecting the temperature of the recording head of the above-mentioned recording apparatus, and a temperature calculation circuit for this member are added.

In FIG. 6, the head temperature sensors 8*e* are arranged on the H.B 853 of the recording head together with the ejection heaters 8*g* and the sub-heaters 8*d*, and are thermally coupled to the heat source of the recording head. Therefore, each temperature sensor 8*e* can easily detect the temperature of the ink in the common ink chamber surrounded by the top plate 8*f*, but is easily influenced by heat generated by the ejection heaters and the sub-heaters. Thus, it is difficult to detect the temperature of the ink during the driving operation of these heaters. For this reason, in this embodiment, as the temperature of the recording head including the ink in the ejection unit, a value actually measured by the temperature detection member is used in a static state, and a predicted value is used in a dynamic state (e.g., in a recording mode suffering from a large temperature drift), thereby detecting the ink temperature in the ejection unit with high precision.

(Summary of Ejection Stabilization)

In this embodiment, in execution of recording by ejecting ink droplets from the recording head, the temperature of the recording head is maintained at a keeping temperature set to be higher than the surrounding temperature using the temperature detection member and heating members (sub-heaters) provided to the recording head. In addition to the detection temperature of the temperature detection member, the ink temperature drift of the ejection unit is predicted on the basis of energy to be supplied to the recording head, and the thermal time constant of the ejection unit, and ejection is stabilized according to the predicted ink temperature. It is difficult in terms of cost to equip the temperature detection member for directly detecting the temperature of the recording head in the ink jet recording apparatus using the IJC like in this embodiment. In addition, a countermeasure against static electricity required for joint points between a temperature measurement circuit and the IJC relatively complicates the recording apparatus. From this viewpoint, the arrangement of such a circuit is disadvantageous. However, in order to detect the temperature of the recording head including the ink in the ejection unit prior to recording, the temperature detection member provided to the recording head should be utilized to simplify calculation processing, and to improve precision. This embodiment exemplifies the exchangeable recording head. Of course, a permanent type recording head, which need not be exchanged, may be used. In this case, the above-mentioned disadvantages are relaxed as a matter of course.

In the present invention, the target head temperature in the recording mode is set at a temperature sufficiently higher than the upper limit of a surrounding temperature range within which the ink jet recording apparatus of the present invention is assumed to be normally used. In one driving method of this control, the temperature of the recording head is increased to and maintained at the keeping temperature higher than the surrounding temperature using the sub-heaters, and PWM ejection quantity control (to be described later) based on the predicted ink temperature drift is made to obtain a constant ejection quantity. More specifically, when the ejection quantity is stabilized, a change in density in one line or one page can be eliminated. At the same time, when the recording condition and the recovery condition are optimized, deterioration of image quality caused by the ejection error and ink overflow on a recording sheet can also be prevented.

(PWM Control)

Figure 7:
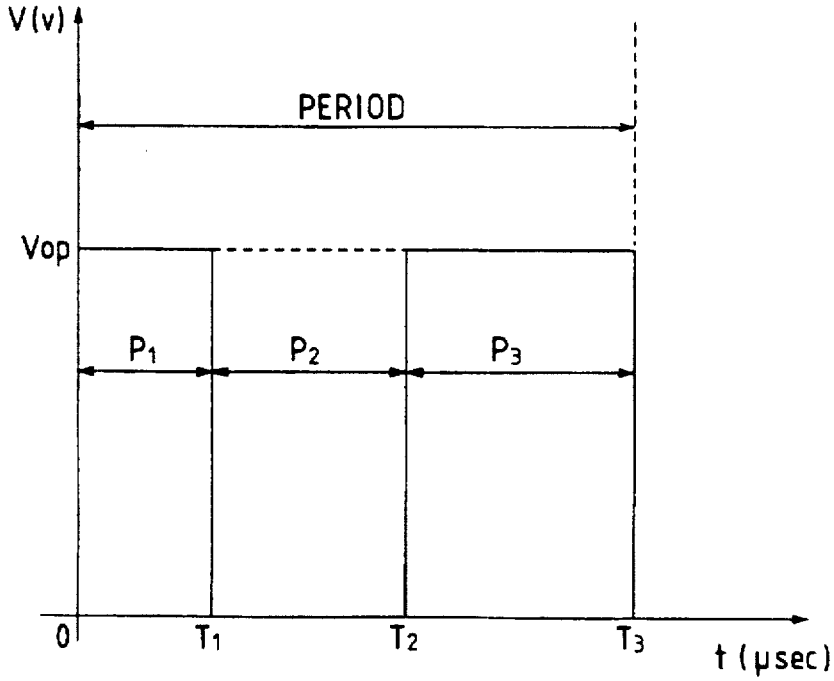
FIG. 7 is an explanatory view of a divided pulse width modulation driving method.

The PWM ejection quantity control method of this embodiment will be described in detail below with reference to the accompanying drawings. FIG. 7 is a view for explaining divided pulses according to this embodiment. In FIG. 7, $V_{op}$ represents an operational voltage, $P_1$ represents the pulse width of the first pulse (to be referred to as a pre-pulse hereinafter) of a plurality of divided heat pulses, $P_2$ represents an interval time, and $P_3$ represents the pulse width of the second pulse (to be referred to as a main pulse hereinafter). T1, T2, and T3 represent times for determining the pulse widths $P_1$, $P_2$, and $P_3$. The operational voltage $V_{op}$ represents electrical energy necessary for causing an electrothermal converting element applied with this voltage to generate heat energy in the ink in an ink channel constituted by the heater board and the top plate. The value of this voltage is determined by the area, resistance, and film structure of the electrothermal converting element, and the channel structure of the recording head.

The PWM ejection quantity control of this embodiment can also be referred to as a pre-pulse width modulation driving method. In this control, in ejection of one ink droplet, the pulses respectively having the widths $P_1$, $P_2$, and $P_3$ are sequentially applied, and the pre-pulse width is modulated according to the ink temperature. The pre-pulse is a pulse for mainly controlling the ink temperature in the channel, and plays an important role of the ejection quantity control of this embodiment. The pre-heat pulse width is preferably set to be a value that which does not cause a bubble production phenomenon in the ink by heat energy generated by the electrothermal converting element applied with this pulse. The interval time assures a time for transmitting the energy of the pre-pulse to the ink in the ink channel. The main pulse produces a bubble in the ink in the ink channel, and ejects the ink from an ejection orifice. The width $P_3$ of the main pulse is preferably determined by the area, resistance, and film structure of the electrothermal converting element, and the channel structure of the recording head.

Figure 8A:
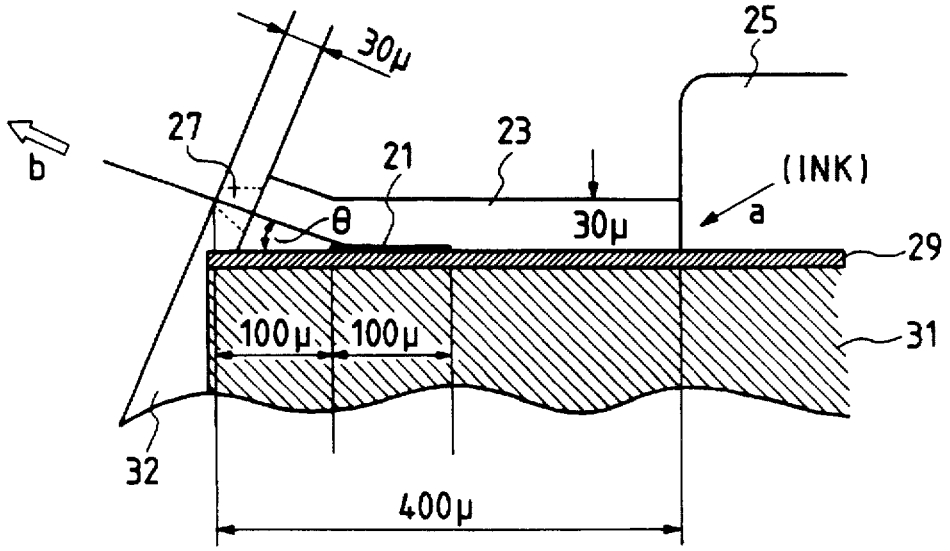
FIGS. 8A and 8B are respectively a schematic longitudinal sectional view along an ink channel and a schematic front view showing an arrangement of a recording head which can adopt the present invention.
Figure 8B:
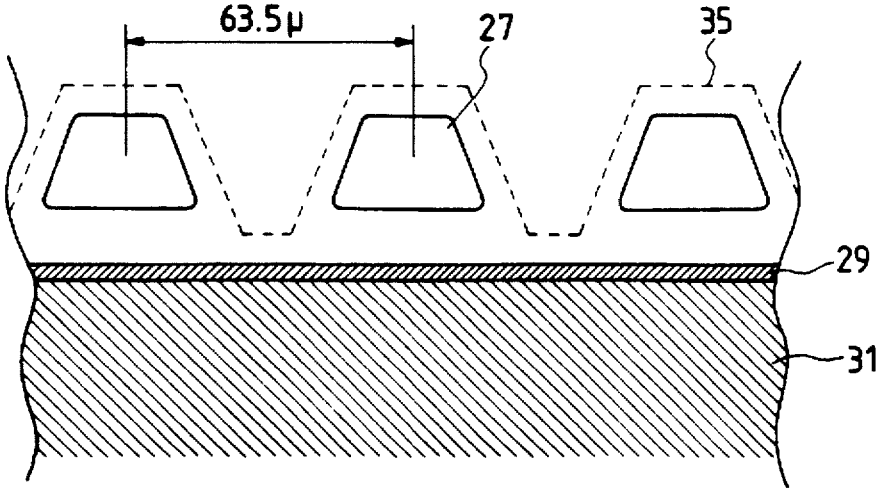

The operation of the pre-pulse in a recording head having a structure shown in, e.g., FIGS. 8A and 8B will be described below. FIGS. 8A and 8B are respectively a schematic longitudinal sectional view along an ink channel and a schematic front view showing an arrangement of a recording head which can adopt the present invention. In FIGS. 8A and 8B, an electrothermal converting element (ejection heater) 21 generates heat upon application of the divided pulses. The electrothermal converting element 21 is arranged on a heater board together with an electrode wire for applying the divided pulses to the element 21. The heater board is formed of a silicon layer 29, and is supported by an aluminum plate 31 constituting the substrate of the recording head. A top plate 32 is formed with grooves 35 for constituting ink channels 23, and the like. When the top plate 32 and the heater board (aluminum plate 31) are joined, the ink channels 23, and a common ink chamber 25 for supplying the ink to the channels are constituted. Ejection orifices 27 (the hole area corresponds to a diameter of 20 μ) are formed in the top plate 32, and communicate with the ink channels 23.

Figure 9:
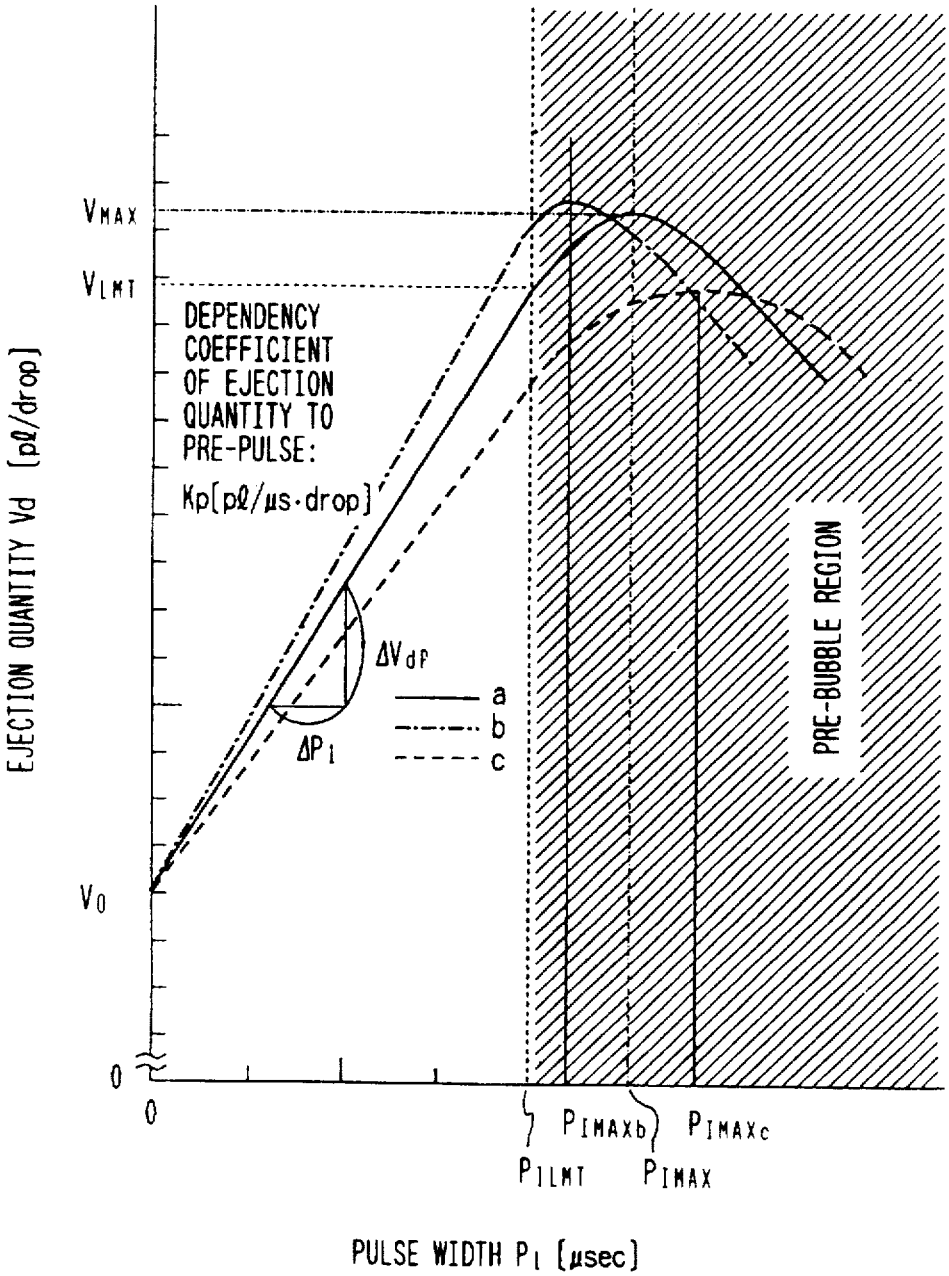
FIG. 9 is a graph showing the pre-pulse dependency of the ejection quantity.

In the recording head shown in FIGS. 8A and 8B, when the operational voltage $V_{op}$=18.0 (V) and the main pulse width $P_3$=4.114 [μsec] are set, and the pre-pulse width $P_1$ is changed within a range between 0 to 3.000 [μsec], the relationship between an ejection quantity Vd [pl/drop] and the pre-pulse width $P_1$ [μsec] shown in FIG. 9 is obtained. FIG. 9 is a graph showing the pre-pulse width dependency of the ejection quantity. In FIG. 9, $V_0$ represents the ejection quantity when $P_1$=0 [μsec], and this value is determined by the head structure shown in FIGS. 8A and 8B. For example, $V_0$=18.0 [pl/drop] in this embodiment when a surrounding temperature $T_R$=25° C.

As indicated by a curve a in FIG. 9, the ejection quantity Vd is linearly increased according to an increase in pre-pulse width $P_1$ when the pulse width $P_1$ changes from 0 to $P_{1LMT}$. The change in quantity loses linearity when the pulse width $P_1$ falls within a range larger than $P_{1LMT}$. The ejection quantity Vd is saturated, i.e., becomes maximum at the pulse width $P_{1MAX}$. The range up to the pulse width $P_{1LMT}$ where the change in ejection quantity Vd shows linearity with respect to the change input pulse width P1 is effective as a range where the ejection quantity can be easily controlled by changing the pulse width P1. For example, in this embodiment indicated by the curve a, $P_{1LMT}$=1.87 (μs), and the ejection quantity at that time was $V_{1LMT}$=24.0 [pl/drop]. The pulse width $P_{1MAX}$ when the ejection quantity Vd was saturated was $P_{1MAX}$=2.1 [μs], and the ejection quantity at that time was $V_{MAX}$=25.5 [pl/drop].

When the pulse width is larger than $P_{1MAX}$, the ejection quantity Vd becomes smaller than $V_{MAX}$. This phenomenon produces a small bubble (in a state immediately before film boiling) on the electrothermal converting element upon application of the pre-pulse having the pulse width within the above-mentioned range, the next main pulse is applied before this bubble disappears, and the small bubble disturbs bubble production by the main pulse, thus decreasing the ejection quantity. This region is called a pre-bubble region. In this region, it is difficult to perform ejection quantity control using the pre-pulse as a medium.

When the inclination of a line representing the relationship between the ejection quantity and the pulse width within a range of P1=0 to $P_{1LMT}$ [μs] is defined as a pre-pulse dependency coefficient, the pre-pulse dependency coefficient is given by:

$$KP=\Delta Vdp/\Delta P_1 \text{ [pl/μsec·drop]}$$

This coefficient KP is determined by the head structure, the driving condition, the ink physical property, and the like independently of the temperature. More specifically, curves b and c in FIG. 9 represent the cases of other recording heads. As can be understood from FIG. 9, the ejection characteristics vary depending on recording heads. In this manner, since the upper limit value $P_{1LMT}$ of the pre-pulse $P_1$ varies depending on different types of recording heads, the upper limit value $P_{1LMT}$ for each recording head is determined, as will be described later, and ejection quantity control is made. In the recording head and the ink indicated by the curve a of this embodiment, KP=3.209 [pl/μsec·drop].

Figure 10:
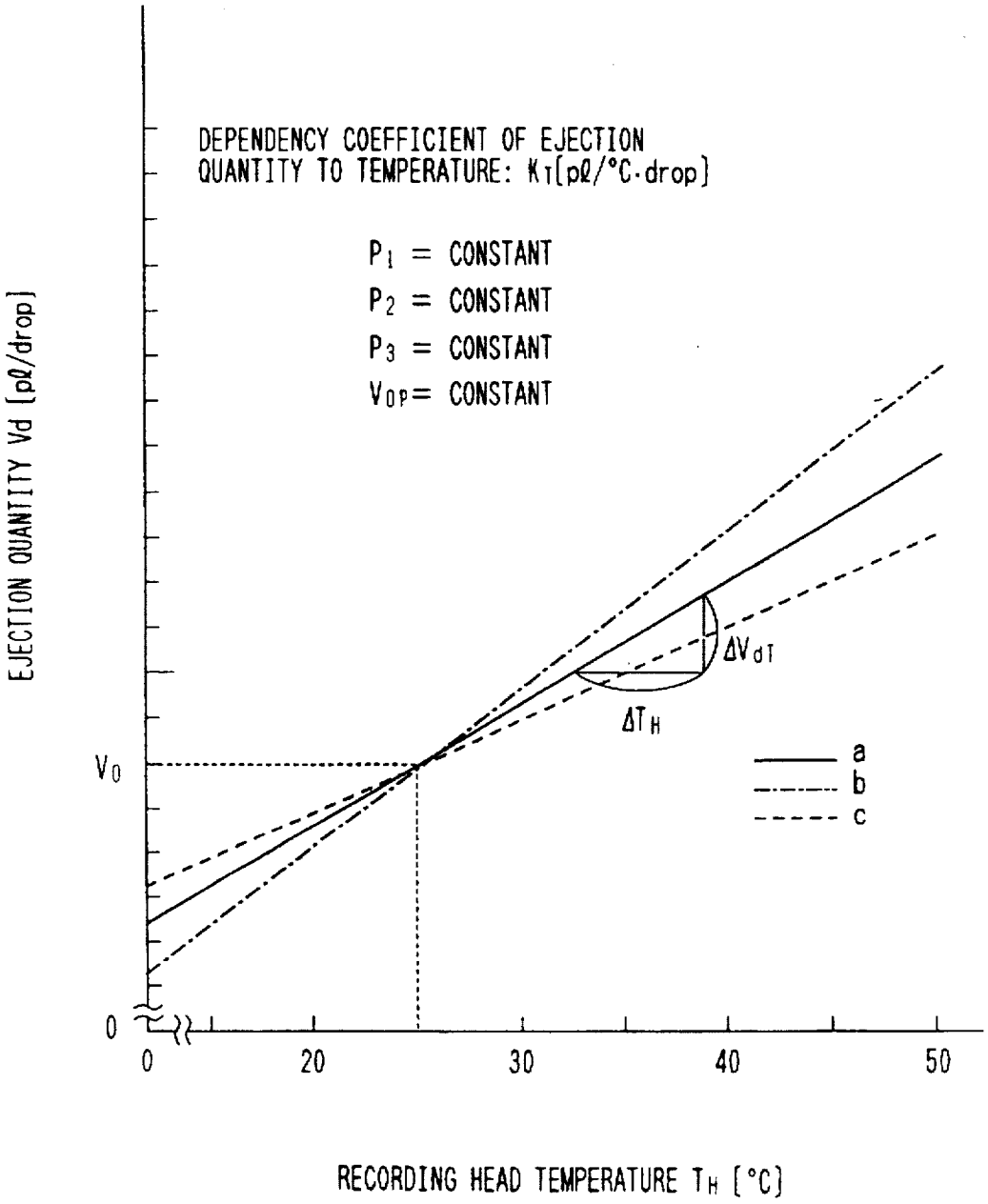
FIG. 10 is a graph showing the temperature dependency of the ejection quantity.

As another factor for determining the ejection quantity of the ink jet recording head, the ink temperature of the ejection unit (which may often be substituted with the temperature of the recording head) is known. FIG. 10 is a graph showing the temperature dependency of the ejection quantity. As indicated by a curve a in FIG. 10, the ejection quantity Vd linearly increases as an increase in temperature $T_H$ (equal to the ink temperature in the ejection unit since characteristics in this case are static temperature characteristics). When the inclination of this line is defined as a temperature dependency coefficient, the temperature dependency coefficient is given by:

$$KT=\Delta VdT/\Delta T_H \text{ [Pl/° C.·drop]}$$

This coefficient KT is determined by the head structure, the ink physical property, and the like independently of the driving condition. In FIG. 10, curves b and c also represent the cases of other recording heads. For example, in the recording head of this embodiment, KT=0.3 [pl/° C.·drop].

Figure 11:
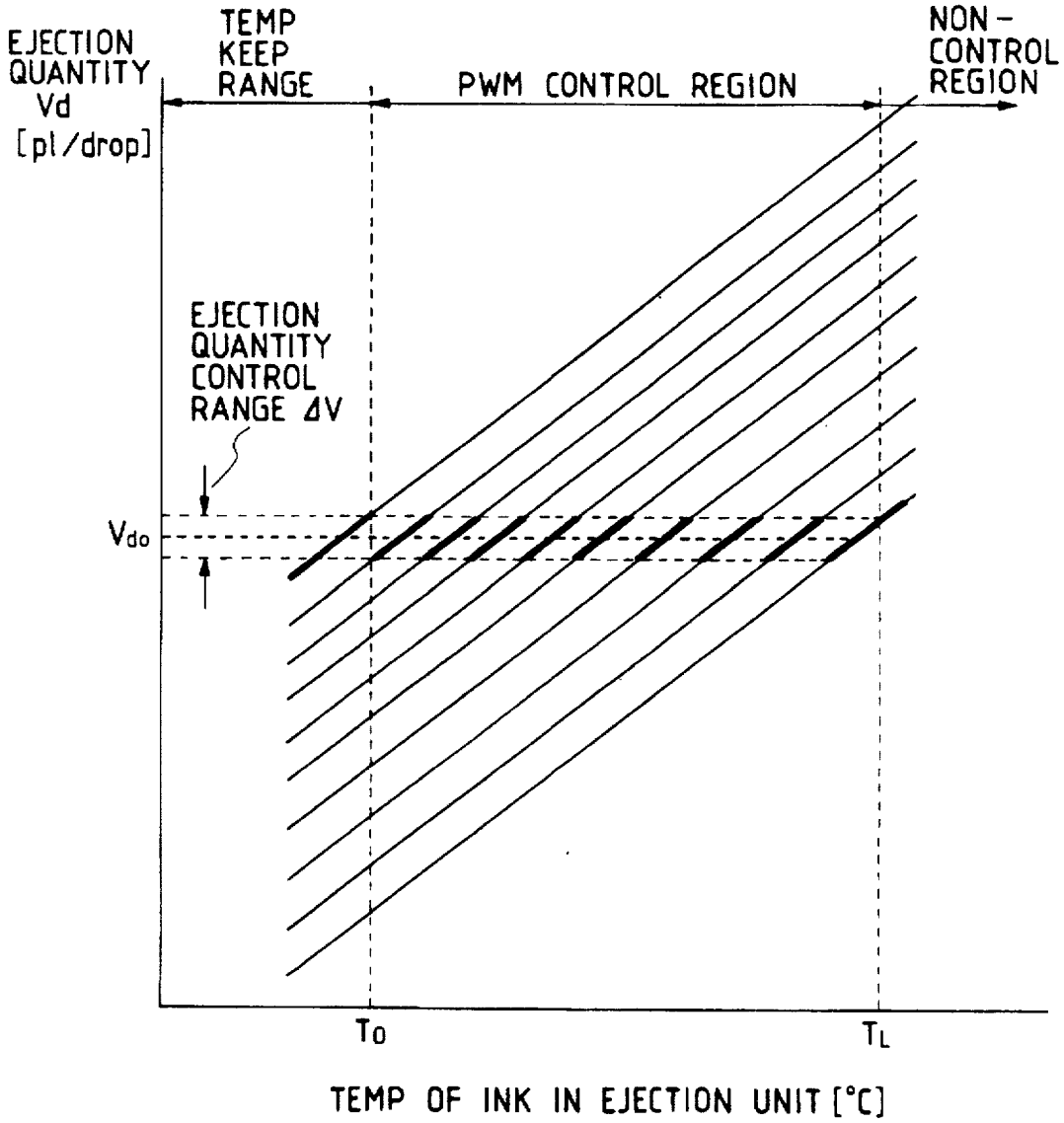
FIG. 11 is an explanatory view associated with ejection quantity control.

FIG. 11 shows an actual control diagram of the relationships shown in FIGS. 9 and 10. In FIG. 11, $T_0$ represents a keeping temperature of the recording head. When the ink temperature of the ejection unit is lower than $T_0$, the recording head is heated by the sub-heaters. Therefore, the PWM control as the ejection quantity control according to the ink temperature is performed at a temperature equal to or higher than $T_0$. In the present invention, the keeping temperature is set to be higher than a normal surrounding temperature. As described above, since the ejection quantity control is preferably performed using the pre-pulse, the width of which is smaller than the pre-bubble region, and the temperature range capable of performing the PWM control is limited to some extent, the ejection quantity can be stabilized easily at a high keeping temperature in consideration of the temperature rise of the recording head itself.

For example, when the keeping temperature is set at 20° C., the heating operation of the sub-heaters is almost unnecessary when the recording apparatus is used in an ordinary environment, and a merit of no wait time can be obtained. However, an upper limit temperature $T_L$ capable of performing the PWM control in this case is 38° C. In a high-temperature environment as high as about 30° C., even when the temperature of the recording head itself is increased, the temperature range capable of performing the ejection quantity control is narrowed. In contrast to this, according to the present invention, since the keeping temperature is set at 36° C., the upper limit temperature $T_L$ is set at 54° C., and the temperature range capable of performing the ejection quantity control can be prevented from being narrowed in an ordinary environment. Even when the temperature of the recording head itself is increased more or less, recording can be satisfactorily performed in a stable ejection quantity. When the PWM control is made by directly measuring the temperature of the recording head using a temperature sensor, it is advantageous since an adverse influence such as a ripple of the detection temperature due to heating of the sub-heater and heat generation in the recording mode can be eliminated. However, in this embodiment, the ink temperature of the ejection unit is directly measured in a state with a small temperature drift like in a non-recording mode, and the temperature in the recording mode with a large temperature drift is predicted from energy to be supplied to the recording head and the thermal time constant of the recording head including the ink in the ejection unit. For this reason, the above-mentioned adverse influence can be eliminated from the beginning. Furthermore, the ink temperature of the ejection unit, which has been increased too much, is decreased mainly by heat radiation to the recording head, and the ink temperature can be decreased earlier as the temperature decrease speed of the recording head is higher. For this reason, it is more advantageous as the difference between the keeping temperature and the surrounding temperature in the recording mode is larger.

The temperature range described as a "PWM control region" in FIG. 11 is a temperature range capable of stabilizing the ejection quantity, and in this embodiment, this range corresponds to a range between 34° C. and 54° C. of the ink temperature of the ejection unit. FIG. 11 shows the relationship between the ink temperature of the ejection unit and the ejection quantity when the pre-pulse is changed by 11 steps. Even when the ink temperature of the ejection unit changes, the pre-pulse width is changed for each temperature step width AT according to the ink temperature, so that the ejection quantity can be controlled within the width AV with respect to a target ejection quantity $V_{d0}$.

FIG. 12A shows a correspondence table between the ink temperature and the pre-pulse. In this embodiment, the exchangeable IJC is used as the recording head. When the ejection quantities vary depending on cartridges, the correspondence table between the ink temperature and the pre-pulse may be changed in correspondence with heads. For example, in the case of a cartridge having a relatively small ejection quantity, a table shown in FIG. 12B may be used. In the case of a cartridge having a relatively large ejection quantity, a table shown in FIG. 12C may be used. Furthermore, a table may be provided according to the pre-pulse dependency coefficient or the temperature dependency coefficient of the ejection quantity.

(Temperature Prediction Control)

Presumption of the ink temperature of the ejection unit in this embodiment is basically performed using the distribution of a power ratio calculated from the number of dots of image data to be printed on the basis of the actually measured value from the temperature detection member in the non-recording mode with a small temperature drift. In this embodiment, the power ratio is calculated in each reference period obtained by dividing a recording period at predetermined intervals, and the temperature prediction and PWM control are also sequentially performed in each reference period. The reason why the number of dots (print duty) is not merely used is that energy to be supplied to a head chip varies according to a variation in pre-pulse value even when the number of dots remains the same. Using the concept of the "power ratio", a single table can be used even when the pre-pulse value is changed by the PWM control. Of course, a calculation may be made while temporarily fixing the pulse width to a predetermined value depending on required precision of the predicted ink temperature.

In this embodiment, the temperature of the recording head is maintained at the keeping temperature set to be higher than the surrounding temperature by properly driving the sub-heaters according to the temperature detected by the temperature detection member. For this reason, as for an increase or decrease in ink temperature, the temperature rise due to heat generation of the ejection heaters and heat radiation based on the thermal time constant of the recording head need only be predicted with reference to a control temperature. In this case, until the temperature of an aluminum base plate having a large heat capacity, which is a major heat radiation destination in a temperature rise state, reaches a predetermined temperature, the heat radiation characteristics may often vary. In this case, since the object of utilization of the temperature detection member in this embodiment is to detect the ink temperature in a static state with a small temperature drift, the sub-heaters for keeping the temperature and the temperature detection member may be arranged adjacent to the aluminum base plate as one constituting member of the recording head since no serious problem is posed when they are arranged at positions relatively thermally separated from the ejection heaters.

In this embodiment, a sum of the keeping temperature and a value obtained by accumulating increased temperature remainders in all the effective reference time periods (the increased temperature remainder is not 0) before an objective reference time period in which the ink temperature is presumed is determined as the ink temperature during the objective reference time period with reference to a descent temperature table in FIG. 13, which shows increased temperature remainders from the keeping temperature according to the power ratio during a given reference time period in units of elapsed times from the reference time period. A print time for one line is assumed to be 0.7 sec, and a time period (0.02 sec) obtained by dividing this print time by 35 is defined as the reference time period.

For example, if recording is performed for the first time at a power ratio of 20% during the first reference time period, 80% during the second reference time period, and 50% during the third reference time period after the temperature keeping operation is completed, the ink temperature of the ejection unit during the fourth reference time period can be presumed from the increased temperature remainders of the three reference time periods so far. More specifically, the increased temperature remainder during the first reference time period is $85\times10^{-3}$ deg (ⓐ in FIG. 13) since the power ratio is 20% and the elapsed time is 0.06 sec; the increased temperature remainder during the second reference time period is $369\times10^{-3}$ deg (ⓑ in FIG. 13) since the power ratio is 80% and the elapsed time is 0.04 sec; and the increased temperature remainder during the third reference time period is $250\times10^{-3}$ deg (ⓒ in FIG. 13) since the power ratio is 50% and the elapsed time is 0.02 sec. Therefore, when these remainders are accumulated, we have $704\times10^{-3}$ deg, and 36.704° C. as the sum of this value and 36° C. are predicted as the ink temperature of the ejection unit during the fourth reference time period.

Presumption of the ink temperature and setting of the pulse width are performed as follows in practice. The pre-pulse value during the first reference period is obtained from the predicted ink temperature (equal to the keeping temperature if it is immediately after the temperature keeping operation is completed) at the beginning of the print operation during the first reference time period with reference to FIG. 12A, and is set on the memory. Then, the power ratio during the first reference time period is calculated based on the number of dots (number of times of ejection) obtained from image data, and the pre-pulse value. The calculated power ratio is substituted in the descent temperature table (FIG. 13) (with reference to the table) to predict the ink temperature at the end of the print operation during the first reference time period (i.e., at the beginning of the print operation during the second reference time period). The ink temperature can be presumed by adding the increased temperature remainder obtained from FIG. 13 to the keeping temperature. Subsequently, the pre-pulse value during the second reference time period is obtained from the predicted ink temperature at the beginning of the print operation during the second reference time period with reference to FIG. 12A, and is set in the memory.

Thereafter, the power ratio is calculated in turn based on the number of dots in the corresponding reference time period and the predicted ink temperature, and increased temperature remainders associated with the objective reference time periods are accumulated. Thereafter, after the pre-pulse values during all the reference time periods in one line are set, the 1-line print operation is performed according to the set pre-pulse values.

With the above-mentioned control, the actual ejection quantity can be stably controlled independently of the ink temperature, and a uniform recorded image with high quality can be obtained.

Recording signals, and the like sent through an external interface are stored in a reception buffer **78*a* in the gate array 78. The data stored in the reception buffer 78*a* is developed to a binary signal (0, 1) indicating "to eject/not to eject", and the binary signal is transferred to a print buffer 78*b*. The CPU 60 can refer to the recording signals from the print buffer 78*b* as needed. Two line duty buffers 78*c* are prepared in the gate array 78. Each line duty buffer stores print duties (ratios) of areas obtained by dividing one line at equal intervals (into, e.g., 35 areas). The "aline duty buffer 78*c*1" stores print duty data of the areas of a currently printed line. The "line duty buffer 78*c*2" stores print duty data of the areas of a line next to the currently printed line. The CPU 60** can refer to the print duties of the currently printed line and the next line at any time, as needed. The CPU 60 refers to the line duty buffers 78c during the above-mentioned temperature prediction control to obtain the print duties of the areas. Therefore, the calculation load on the CPU 60 can be reduced.

In this embodiment, a recording operation is inhibited or an alarm is generated for a user until the temperature keeping operation is completed, and the ink temperature associated with the ejection quantity control is presumed after the temperature keeping operation is completed. Under these conditions, prediction of the ink temperature can be simplified since the control is made under an assumption that the temperature of the aluminum base plate associated with heat radiation is maintained at a temperature equal to or higher than the keeping temperature. However, if a surrounding temperature detection means (the temperature sensor 5024 in FIG. 1) is used, since the temperature of the aluminum base plate at a desired timing can be predicted even before the temperature keeping operation is completed, the ink temperature of the ejection unit is detected using the predicted temperature as a reference temperature so as to allow recording before completion of the temperature keeping operation. Since a time required until the temperature keeping operation is completed can be calculated and predicted if the surrounding temperature detection means is used, the time of a temperature keeping timer may be changed according to the predicted time.

In this embodiment, double-pulse PWM control is performed to control the ejection quantity. Alternatively, single-pulse PWM control or PWM control using three or more pulses may be used.

According to the present invention, the keeping temperature is set to be higher than a normal surrounding temperature to widen the temperature range capable of performing the ejection quantity control to a high-temperature region. When the ink temperature reaches a non-control region at a higher temperature in which ejection quantity control is impossible, the temperature prediction may be restarted from the beginning after the carriage scan speed is decreased or after the carriage scan start timing is delayed.

(Second Embodiment)

A method of presuming the current temperature from a print ratio (to be referred to as a print duty hereinafter), and controlling a recovery sequence for stabilizing ejection in an ink jet recording apparatus will be described below. In the present invention, since the keeping temperature in a print mode is set to be higher than a surrounding temperature, the ink in the ejection unit is easily evaporated, and it is important to perform recovery control according to the thermal history of the recording head. In this embodiment, a pre-ejection condition is changed according to the presumed ink temperature of the ejection unit during recording and at the end of recording.

At a high temperature, the ink in the ejection unit is easily evaporated. In particular, when there is a nozzle which is not used by chance according to recording data, the ink in only this nozzle is evaporated, and cannot be easily ejected from this nozzle. Thus, the pre-ejection interval or the number of times of pre-ejection can be changed according to the presumed ink temperature in the recording mode. In this embodiment, the number of times of pre-ejection is changed as shown in Table 1 below according to the maximum ink temperature in the recording mode. At the same time, as the temperature in a pre-ejection mode is higher, the ejection quantity is increased. For this reason, the ejection quantity is suppressed by decreasing the pulse width according to the ink temperature in the pre-ejection mode by the same PWM control as in the first embodiment. In this case, a pre-pulse table may be modified to obtain relatively higher energy than in the recording mode in consideration of the object of the pre-ejection.

TABLE 1

| Maximum Ink Temperature (°C.) | Number of Times of Pre-ejection |
|---|---|
| 30 to 40 | 12 |
| 40 to 50 | 18 |
| more than 50 | 24 |

As the temperature is higher, the temperature variations among nozzles are increased. For this reason, the distribution of the number of times of pre-ejection may be optimized. For example, as the temperature becomes higher, control may be made to increase a difference between the numbers of times of pre-ejection of the nozzle end portions and the central portion as compared to that at room temperature.

When a plurality of heads are arranged, different pre-ejection temperature tables may be prepared in units of ink colors. When the head temperature is high, the viscosity of Bk (black) containing a larger amount of dye as compared to Y (yellow), M (magenta), and C (cyan) tends to be increased. For this reason, control may be made to increase the number of times of pre-ejection. When the plurality of heads have different head temperatures, pre-ejection control may be made in units of heads.

Figure 14A:
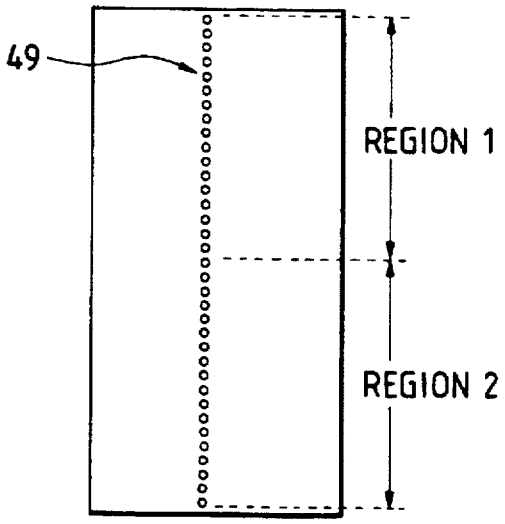
FIGS. 14A and 14B are explanatory views showing another arrangement for head temperature prediction.
Figure 14B:
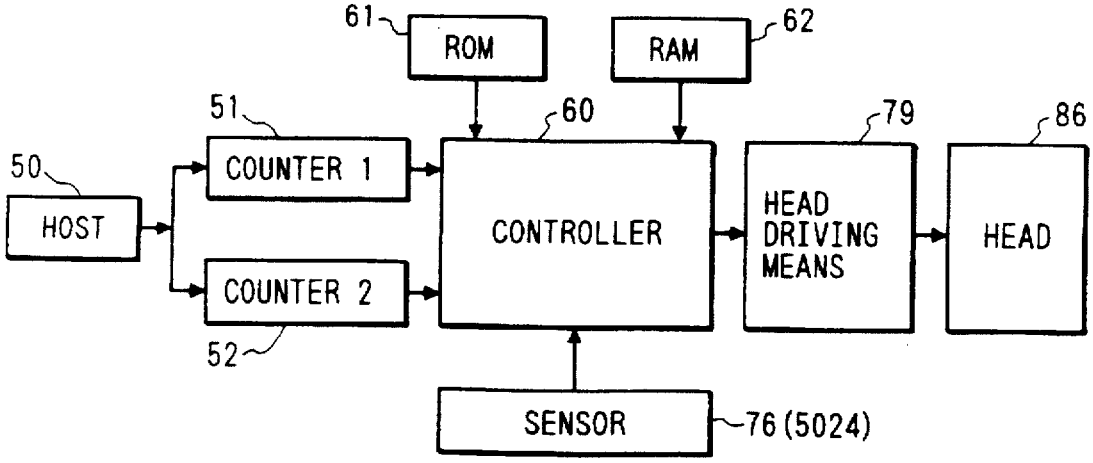

When the number of nozzles is large, nozzles 49 may be divided into two regions, as shown in FIG. 14A showing the surface of the head, and the ink temperature may be presumed in units of divided regions. As shown in the block diagram of FIG. 14B, counters 51 and 52 for independently obtaining print duties are provided in correspondence with the two nozzle regions, and the ink temperatures are presumed on the basis of the independently obtained print duties. Then, the pre-ejection conditions can be independently set. Thus, an error in ink temperature prediction caused by the print duty can be eliminated, and more stable ejection can be expected. Note that in FIG. 14B, a host computer 50 is connected to the counters 51 and 52, and the same reference numerals in FIG. 14B denote the same parts as in FIGS. 1 and 5.

The total number of times of ejection of each nozzle may be counted, and the degree of evaporation of the ink in each nozzle may be presumed in combination with the presumed ink temperature. The distribution of the number of times of pre-ejection may be optimized in correspondence with these presumed values. Such control can be easily realized by the arrangement of the present invention, and a remarkable effect can also be expected.

(Third Embodiment) This embodiment exemplifies a case wherein a predetermined recovery means is operated at intervals which are optimally set according to the history of the ink temperature in an ejection unit within a predetermined period of time. The recovery means to be controlled in this embodiment is wiping means, which is executed at predetermined time intervals during a continuous print operation (in a cap open state) so as to stabilize ejection. The wiping means to be controlled in this embodiment is executed for the purpose of removing an unnecessary liquid such as an ink, vapor, or the like, and a solid-state foreign matter such as paper particles, dust, or the like attached onto an orifice formation surface.

This embodiment pays attention to the fact that the wet quantity due to, e.g., the ink varies depending on the head temperature, and evaporation of the wet quantity, which makes removal of the ink or the foreign matter difficult, is associated with the head temperature (the temperature of the orifice formation surface). Thus, since the temperature of the orifice formation surface has a strong correlation with the ink temperature in the ejection unit, ink temperature prediction can be applied to wiping control. Since the above-mentioned wet quantity and evaporation of the wet associated with wiping has a stronger correlation with the temperature of the orifice formation surface in the recording mode than the head temperature upon execution of wiping, a temperature presuming means in the recording mode of this embodiment can be suitably applied.

Figures 15, 15A:
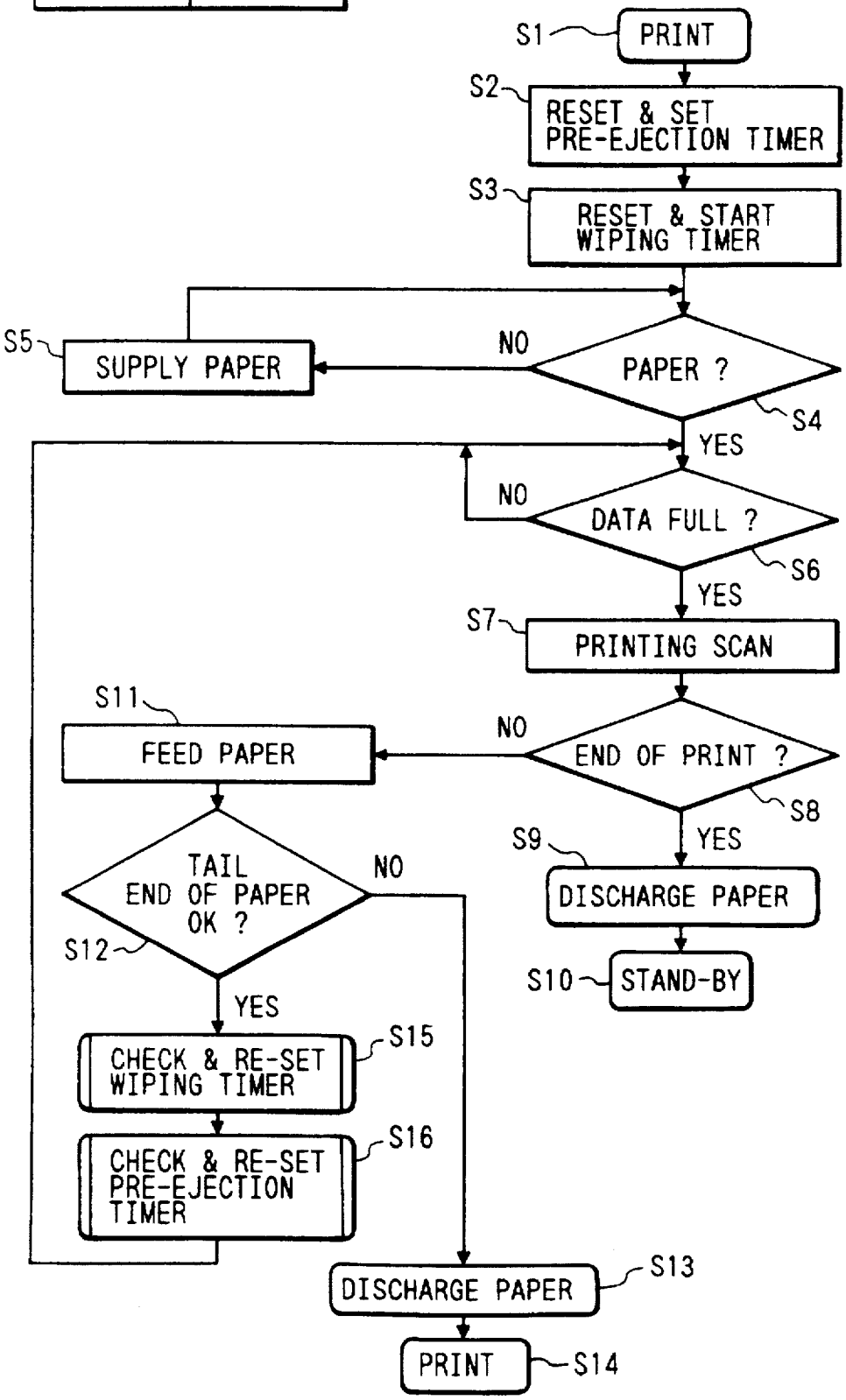
FIG. 15, which is comprised of FIGS. 15A and 15B, is a flow chart showing the outline of a print sequence.
Figure 15B:
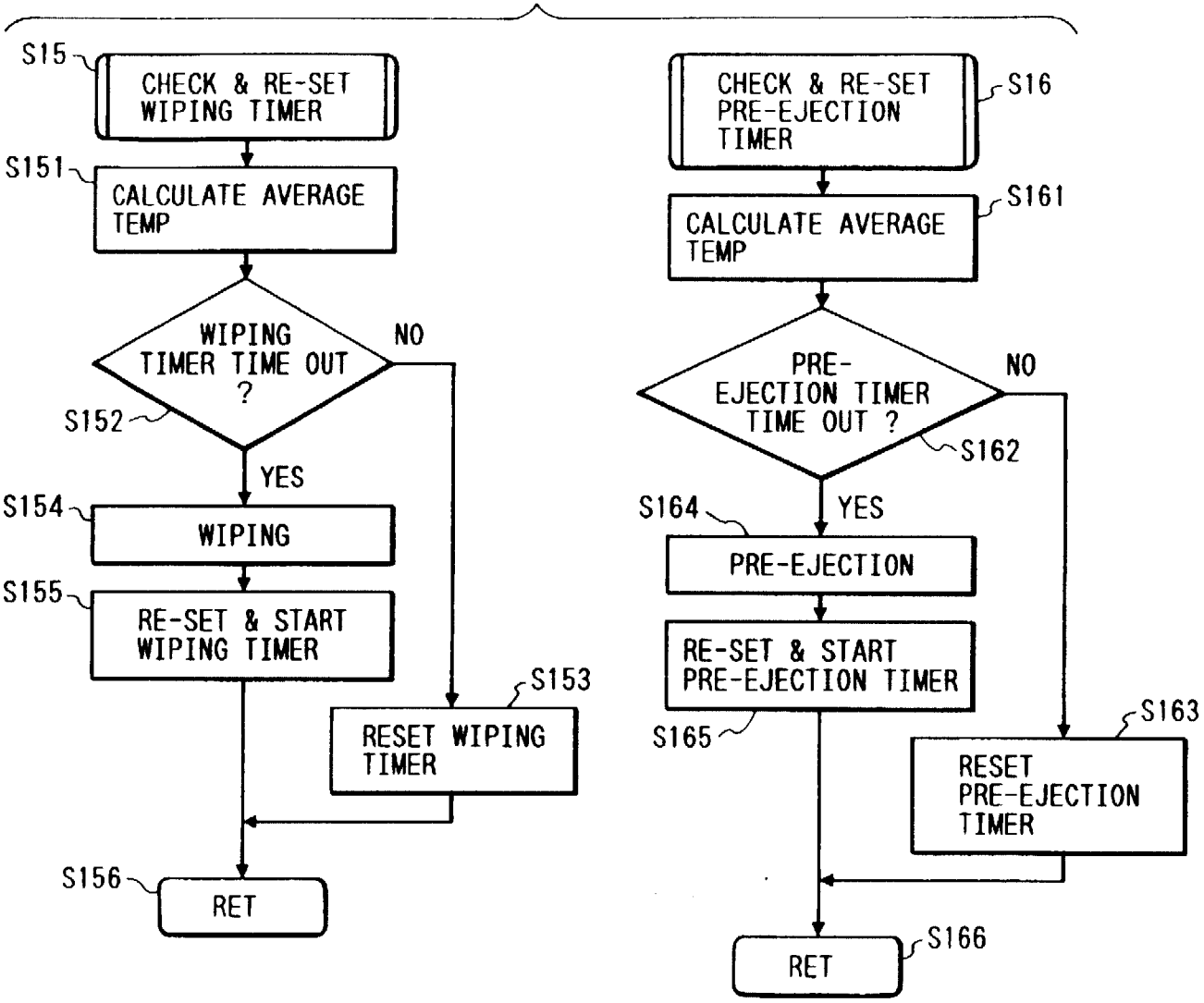

FIG. 15, which is comprised of FIGS. 15A and 15B, is a flow chart showing the outline of a print sequence of the ink jet recording apparatus of this embodiment. When a print signal is input, the print sequence is executed (step S1). A pre-ejection timer is set according to the ink temperature at that time, and is started (step S2). Furthermore, a wiping timer is similarly set according to the ink temperature at that time, and is started (step S3). If no paper sheet is stocked, paper sheets are supplied (steps S4 and S5), and thereafter, as soon as a data input operation is completed, a carriage scan (printing scan) operation is performed to print data for one line (steps S6 and S7).

When the print operation is to be ended, the paper sheet is discharged, and the control returns to a standby state (steps SB to S10); when the print operation is to be continued, the paper sheet is fed by a predetermined amount, and the tail end of the paper sheet is checked (steps S11 to S14). The wiping and pre-ejection timers, which have been set according to the average ink temperature in the print mode, are checked and re-set, and after a wiping or pre-ejection operation is performed as needed, these timers are restarted (steps S15 and S16). At this time, the average ink temperature is calculated regardless of the presence/absence of execution of the operation (steps S151 and S161), and the wiping and pre-ejection timers are re-set according to the calculated average temperature (steps S153, S155, S163, and S165).

More specifically, in this embodiment, since the wiping and pre-ejection timings are finely re-set according to the average ink temperature every time a line print operation is performed, the optimal wiping and pre-ejection operations according to ink evaporation or wet conditions can be performed. After the end of the predetermined recovery operations, and the completion of the data input operation, the above-mentioned steps are repeated to perform the printing scan operation again.

Table 2 below serves as a correspondence table between the pre-ejection interval and the number of times of pre-ejection according to the average ink temperature for last 12 sec, and as for the wiping interval, serves as a correspondence table according to the average ink temperature for last 48 sec. In this embodiment, as the average head temperature becomes higher, the interval is set to be shorter, and the number of times of pre-ejection is decreased. On the contrary, as the average head temperature becomes lower, the interval is set to be longer, and the number of times of pre-ejection is increased. The interval and the number of times of pre-ejection can be appropriately set in consideration of the ejection characteristics according to evaporation/viscosity increase characteristics of the ink, and characteristics such as a change in density. For example, when an ink, which contains a large quantity of a nonvolatile solvent, and is assumed to suffer from a decrease in viscosity due to the temperature rise rather than an increase in viscosity due to evaporation, is used, the pre-ejection interval may be set to be longer when the temperature is high.

TABLE 2

| Presumed | Presumption for Last 12 sec Pre-ejection | | Presumption for Last 48 sec Wiping | Presumption for Last 12 hours Suction |
|---|---|---|---|---|
| Temperature (°C.) | Interval (sec) | No. of Pulses | Interval (sec) | Interval (hour) |
| 30 to 40 | 9 | 12 | 36 | 60 |
| 40 to 50 | 6 | 8 | 24 | 48 |
| more than 50 | 3 | 4 | 12 | 3 |

As for wiping, since a normal liquid ink tends to increase the wet quantity and difficulty of removal as the temperature becomes higher, the wiping operation is frequently performed at a high temperature in this embodiment. This embodiment has exemplified a case wherein one recording head is arranged. However, in an apparatus which realizes color recording or high-speed recording using a plurality of heads, the recovery conditions may be controlled based on the average ink temperature in units of recording heads, or the recovery means may be simultaneously operated according to a recording head requiring the shortest interval.

(Fourth Embodiment)

This embodiment exemplifies an example of a suction recovery means according to the past average ink temperature for a relatively long period of time as another example of recovery control based on the presumed average ink temperature like in the third embodiment. The recording head of the ink jet recording apparatus is often arranged for the purpose of stabilizing the meniscus shape at a nozzle opening, such that a negative head pressure is attained at the nozzle opening. An unexpected bubble in an ink channel causes various problems in the ink jet recording apparatus, and tends to pose problems particularly in a system maintained at the negative head pressure.

More specifically, even in a non-recording state, i.e., when the ink is merely left as it is, a bubble, which disturbs normal ejection, is grown in the ink channel due to dissociation of a gas contained in the ink or gas exchange through the ink channel constituting members, thus posing a problem. The suction recovery means is prepared for the purpose of removing such a bubble in the ink channel and the ink whose viscosity is increased due to evaporation at the distal end portion of the nozzle opening. Ink evaporation changes depending on the head temperature, as described above. The growth of a bubble in the ink channel is influenced more easily by the ink temperature, and the bubble tends to be produced as the temperature is higher. In this embodiment, as shown in Table 2 above, the suction recovery interval is set according to the average ink temperature for last 12 hours, and a suction recovery operation is frequently performed as the average ink temperature is higher. The average temperature may be re-set for, e.g., every page.

When the past average ink temperature over a relatively long period of time is to be presumed using a plurality of heads, as shown in FIG. 4 presented previously, after the plurality of heads are thermally coupled, the average ink temperature of the plurality of heads may be presumed on the basis of the average duty of the plurality of heads, and the average temperature detected by the temperature detection member, so that control may be simplified under an assumption that the plurality of heads are almost identical.

In FIG. 4, the heads are thermally coupled as follows. That is, the recording heads are mounted on a carriage which is partially (including a common support portion for the heads) or entirely formed of a material having a high heat conductivity such as aluminum, so that base portions having a high heat conductivity of the recording heads are in direct contact with the carriage.

As has been described above in the first embodiment, a future head temperature can be easily predicted based on the average ink temperature. Therefore, optimal suction recovery control may be set in consideration of a future ejection condition.

For example, even when anxiety for an ejection error upon execution of a high-duty print operation at the current ink temperature is present, if it is known that no high-duty print operation will be performed in the future, the suction operation is postponed at the present time, and is performed after a recording medium is discharged, thereby shortening the total print time.

(Fifth Embodiment)

This embodiment exemplifies an example of recovery system control according to the history of a temperature presumed from the temperature detected by the temperature detection member of the recording head, and the print duty. A foreign matter such as the ink deposited on the orifice formation surface often deviates the ejection direction, and sometimes causes an ejection error. The wiping means is arranged as a means for recovering such deteriorated ejection characteristics. In some cases, a wiping member having a stronger frictional contact force may be prepared, or wiring characteristics may be improved by temporarily changing a wiping condition.

In this embodiment, the entrance amount (thrust amount) of the wiping member comprising a rubber blade to the orifice formation surface is increased to temporarily improve the wiping characteristics (rubbing mode). It was experimentally demonstrated that deposition of a foreign matter requiring rubbing was associated with the wet ink quantity, the residual wet ink quantity after wiping, and evaporation of the wet ink, and had a strong correlation with the number of times of ejection, and the temperature upon ejection. In this embodiment, the rubbing mode is controlled according to the number of times of ejection weighted by the ink temperature. Table 3 below shows weighting coefficients to be multiplied with the number of times of ejection as fundamental data of a print duty according to the ink temperature presumed from the print duty. More specifically, as the temperature is higher at which a wet or residual wet ink tends to appear, the number of times of ejection serving as an index of a deposit is controlled to be increased.

TABLE 3

| Presumed Temperature (°C.) | Weighting Coefficient for No. of Pulses |
|---|---|
| 30 to 40 | 1.0 |
| 40 to 50 | 1.2 |
| more than 50 | 1.4 |

When the weighted number of times of ejection reaches five million times, the rubbing mode is enabled. The rubbing mode is effective for removing a deposit, but may cause mechanical damage to the orifice formation surface due to the strong frictional contact force. Therefore, it is preferable to minimize execution of the rubbing mode. When control is made based on data having a direct correlation with the deposition of a foreign matter like in this embodiment, this allows a simple arrangement, and high reliability. In a system having a plurality of heads, the print duty may be managed in units of colors, and the rubbing mode may be controlled in units of ink colors having different deposition characteristics.

As has been described above in the first embodiment, a future ink temperature can be easily predicted. Therefore, optimal control may be set using the "weighted number of times of ejection" in consideration of a future condition in the calculation of the "weighted number of times of ejection".

(Sixth Embodiment)

This embodiment exemplifies an example of suction recovery control like in the fourth embodiment. In this embodiment, in addition to presumption of a bubble (non-print bubble) grown when the ink is left as it is, a bubble. (print bubble) grown in the print mode is also presumed, thus allowing presumption of bubbles in the ink channel with high precision. As described above, evaporation of the ink changes depending on the ink temperature. The growth of a bubble in the ink channel is influenced more easily by the ink temperature, and the bubble tends to be produced as the temperature is higher. For this reason, it is obvious that the non-print bubble can be presumed by counting a non-print time weighted by the ink temperature. The print bubble tends to be grown as the ink temperature upon ejection is higher, and also has a positive correlation with the number of times of ejection.

Thus, it is also obvious that the print bubble can be presumed by counting the number of times of ejections weighted by the ink temperature in the ejection unit. In this embodiment, as shown in Table 4 below, the number of points according to a non-print time (non-print bubble), and the number of points according to the number of times of ejections (print bubble) are set, and when a total number of points reaches one hundred million, it is determined that the bubble in the ink channel may adversely influence ejection, and the suction recovery operation is performed, thereby removing the bubble.

TABLE 4

| Presumed Temperature (°C.) | No. of Points According to Non-print Time (point/sec) | No. of Points According to No. of Dots (point/sec) |
|---|---|---|
| 30 to 40 | 455 | 56 |
| 40 to 50 | 588 | 65 |
| more than 50 | 769 | 74 |

Matching between the number of points of the print bubble and that of the non-print bubble was experimentally determined such that the numbers of points were equal to each other when ejection errors were independently caused by these factors under a constant temperature condition. Also, weighting coefficients according to the temperature were also experimentally obtained and converted values. As the bubble removing means, either the suction means of this embodiment or a compression means may be employed. Furthermore, after the ink in the ink channel are intentionally removed, the suction means may be operated.

As has been described above in the first embodiment, a future ink temperature can be easily predicted. Therefore, optimal control may be set using "ink evaporation characteristics" and "growth of a bubble in the ink channel" in consideration of a future ejection condition in presumption or prediction of the "ink evaporation characteristics" and the "growth of a bubble in the ink channel".

Note that in the second to sixth embodiments, the ejection quantity control described in the first embodiment may or may not be executed in combination. When no ejection quantity control is performed, steps associated with the PWM control and sub-heater control can be omitted.

In this embodiment, the energization time is used as an index of energy to be supplied to the head. However, the present invention is not limited to this. For example, when no PWM control is performed, or when high-precision temperature prediction is not required, the number of print dots may be used. Furthermore, when the print duty does not suffer from a large drift, the print time and the non-print time may be used.

(Seventh Embodiment)

This embodiment exemplifies an example of an ink jet recording apparatus comprising a temperature keeping means constituted by a self temperature control type heating member, thermally coupled to a recording head, for maintaining the temperature of the recording head at a predetermined keeping temperature higher than a surrounding temperature capable of performing recording, and a temperature keeping timer for managing an operation time of the heating member, a temperature prediction means for predicting a change in ink temperature in an ejection unit in a recording mode prior to recording on the basis of a temperature detected by a temperature detection member provided to the recording head and of recording data, and an ejection stabilization means for stabilizing ejection according to the ink temperature in the ejection unit.

In this embodiment, a difference from the ink jet recording apparatuses described in the first to sixth embodiments is that the heating member provided to the recording head is a self temperature control type heater which contacts not a heater board but an aluminum base plate as the base member of the recording head. The self temperature control type heater spontaneously suppresses heat generation without using a special temperature detection mechanism when a predetermined temperature is reached. For example, the self temperature control type heater is formed of a material such as barium titanate of PTC characteristics (having a positive resistance temperature coefficient). Some heaters can obtain the same characteristics as described above by modifying an arrangement even when a heater element itself has no PTC characteristics. For example, a heater element is formed of a material prepared by dispersing, e.g., conductive graphite particles in a heat-resistant resin having an electrical insulating property. When this element is heated, the resin is expanded, and graphite particles are separated from each other, thus increasing the resistance. In such a self temperature control type heater, a desired control temperature can be set by adjusting the composition or arrangement. In this embodiment, a heater exhibiting a control temperature of about 36° C. was used.

In this embodiment, since the temperature of the recording head including the ink in the ejection unit at the beginning of recording is basically equal to the control temperature of the self temperature control type heater, the ink temperature drift in the ejection unit in the recording mode can be predicted on the basis of expected energy to be supplied to the ejection heaters in the recording mode at that control temperature and of the thermal time constant of the recording head including the ink in the ejection unit.

In ink temperature prediction of the present invention, a temperature rise from the keeping temperature is calculated on the basis of energy to be supplied for ejection. For this reason, the predicted ink temperature upon ejection has higher precision than that of the temperature detected by the temperature detection member provided to the recording head. However, the predicted ink temperature inevitably varies due to a difference in thermal time constant of each recording head, a difference in thermal efficiency upon ejection, and the like.

Thus, in this embodiment, the predicted ink temperature is corrected. The predicted ink temperature correction in this embodiment is performed using the temperature detected by the temperature detection member prepared for the recording head in the ink jet recording apparatus of the present invention in a state wherein the recording head is not driven. The descent temperature table used for predicting the ink temperature is corrected so as to decrease a difference between a difference between the temperatures detected by the temperature detection member in thermally static non-ejection states before and after recording, and the predicted ink temperature rise calculated from energy to be supplied for ejection. In this embodiment, the descent temperature table is corrected in such a manner that error rates in units of recording lines are sequentially accumulated, and an average value of the error rates for one page is calculated.

Therefore, when the recording head is exchanged, or when the surrounding temperature considerably drifts, the ink temperature can be stably predicted as compared to the above embodiments. More specifically, in this embodiment, since the temperature detection member of the recording head is used not only in detection of the ink temperature at the beginning of recording but also in correction of the predicted ink temperature, the ink temperature in the ejection unit in the recording mode can be predicted with high precision, and ejection can be stabilized.

In this embodiment, since the aluminum base plate having a heat capacity which largely influences the ink temperature in the ejection unit is always maintained at the control temperature, as for an increase/decrease in ink temperature, the temperature rise caused by heat generation of the ejection heaters, and heat radiation according to the thermal time constant of the recording head need only be predicted with reference to the control temperature. For this reason, the ink temperature can be stably predicted as compared to the above embodiments wherein the temperature near the ejection unit of the recording head is maintained.

In this embodiment, a recording operation is inhibited or an alarm is generated for a user until the temperature keeping timer measures a predetermined period of time. Then, recording is performed after the temperature keeping operation by the self temperature control type heater is completed. For this reason, ink temperature prediction can be simplified since control can be made under an assumption that the temperature of the aluminum base plate associated with heat radiation is maintained at the keeping temperature as the control temperature of the element. However, when the ink temperature at the beginning of the temperature keeping operation is detected by the temperature detection member, and is set as an initial temperature of the aluminum base plate, the temperature of the aluminum base plate can be predicted at a desired timing even before completion of the temperature keeping operation as long as the temperature rise characteristics of the self temperature control type heater are measured in advance. Thus, the ink temperature in the ejection unit may be predicted with reference to the initial temperature so as to allow recording before completion of the temperature keeping operation. Similarly, since a time until completion of the temperature keeping operation can be calculated and predicted, the time of the temperature keeping timer may be changed according to the predicted time.

According to the temperature control method of this embodiment, the same ejection stabilization control described in the second to sixth embodiments can be realized, and simplified temperature prediction can be expected.

As described above, according to the present invention, the temperature of the recording head is maintained at a temperature higher than the surrounding temperature, and ejection is stabilized according to the ink temperature in the ejection unit, which is presumed prior to recording on the basis of the temperature detected by the temperature detection member provided to the recording head and recording data. Therefore, the ejection quantity and ejection can be stabilized without considerably decreasing the recording speed, and a high-quality image having a uniform density can be obtained.

(Eighth Embodiment)

Figure 16:
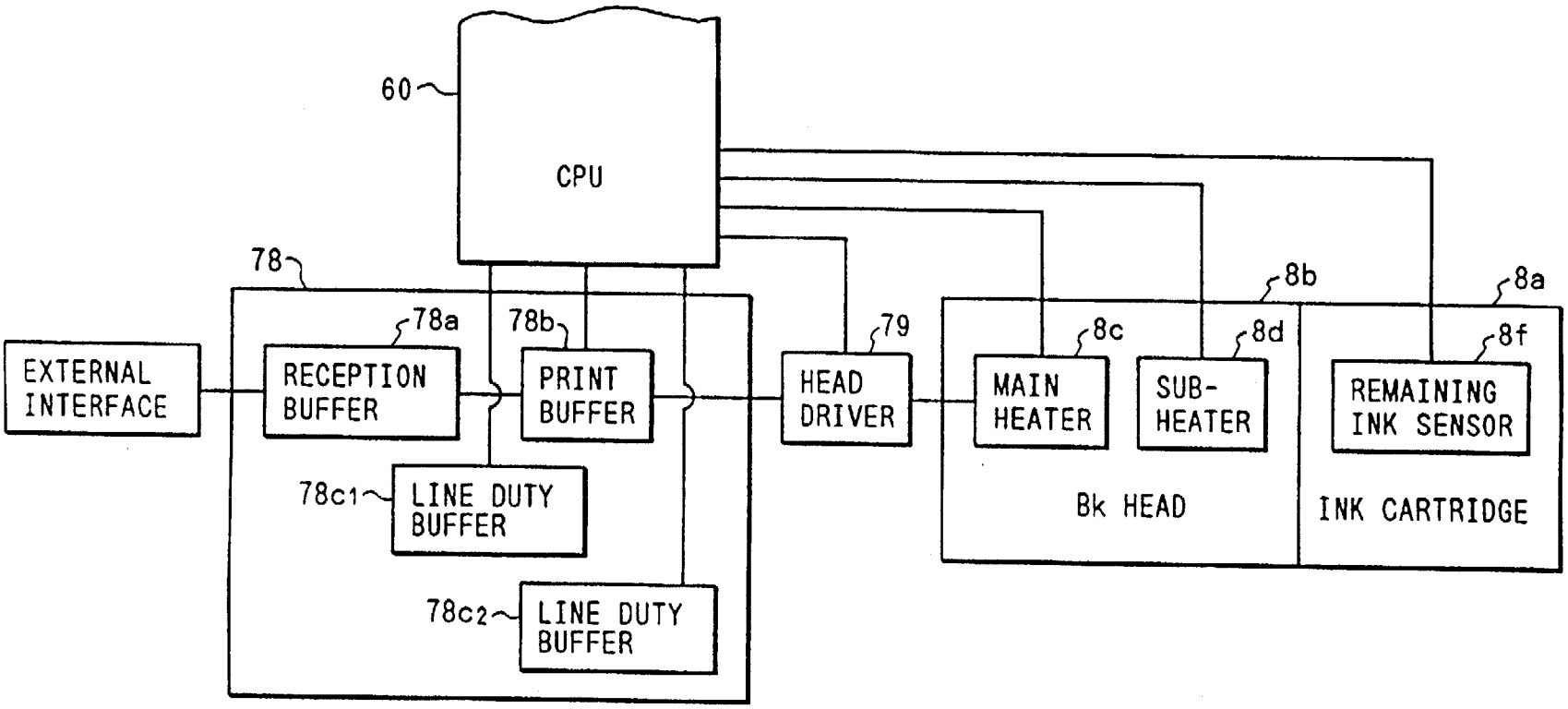
FIG. 16 is a block diagram showing another control arrangement for executing the recording control flow.

An embodiment for performing temperature prediction different from those in the above-mentioned first to seventh embodiments will be described in detail below with reference to the accompanying drawings. The control arrangement of this embodiment is as shown in FIG. 16, and is substantially the same as that shown in FIG. 5, except that the temperature sensors 8*e* are omitted from the arrangement shown in FIG. 5. Although not shown, a recording head has substantially the same arrangement as that shown in FIG. 6, except that the temperature sensors 8*e* are omitted from the arrangement shown in FIG. 6.

(Summary of Temperature Prediction)

In this embodiment, upon execution of recording by ejecting ink droplets from the recording head, a surrounding temperature sensor for measuring the surrounding temperature is provided to an apparatus main body, and the ink temperature drift in an ejection unit is presumed and predicted as a change in ink temperature from the past to the present and future by calculation processing based on ink ejection energy and energy to be supplied to sub-heaters for maintaining the temperature of the recording head, thereby stabilizing ejection according to the ink temperature. More specifically, a temperature detection member (the temperature sensors 8*e* in FIGS. 5 and 6) for directly detecting the temperature of the recording head can be omitted. It is difficult in terms of cost to equip the temperature detection member for directly detecting the temperature of the recording head in the ink jet recording apparatus using the IJC like in this embodiment. In addition, a countermeasure against static electricity required for joint points between a temperature measurement circuit and the IJC relatively complicates the recording apparatus. From these viewpoints, this embodiment is advantageous. Note that the recording head shown in FIG. 5 may be used. In this case, the temperature sensors 8*e* are not used.

Briefly speaking, in this embodiment, a change in ink temperature in the ejection unit is presumed and predicted by evaluating the thermal time constant of the recording head and the ejection unit including the ink, and input energy in a range from the past to future, which energy is substantially associated with the ink temperature using a temperature change table calculated in advance. Based on the predicted ink temperature, the head is controlled by a divided pulse width modulation (PWM) method of heaters (sub-heaters) for increasing the temperature of the head, and ejection heaters.

(Temperature Prediction Control)

Figure 18:
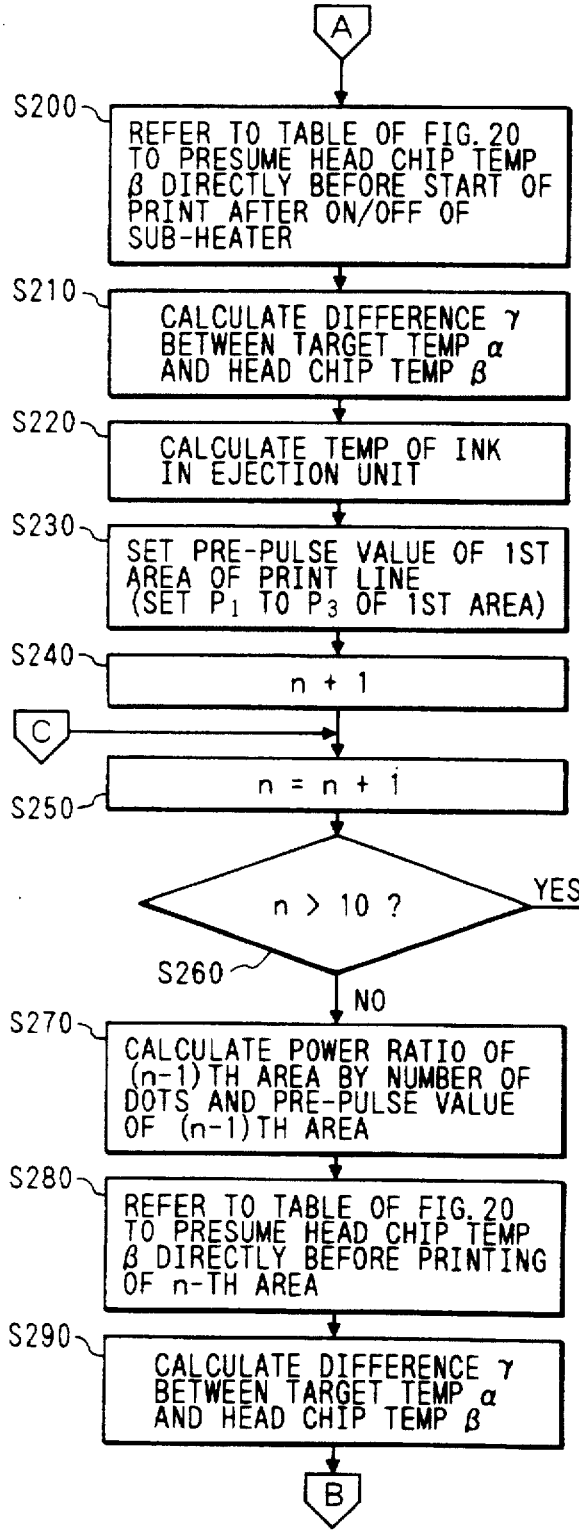
Figure 19:
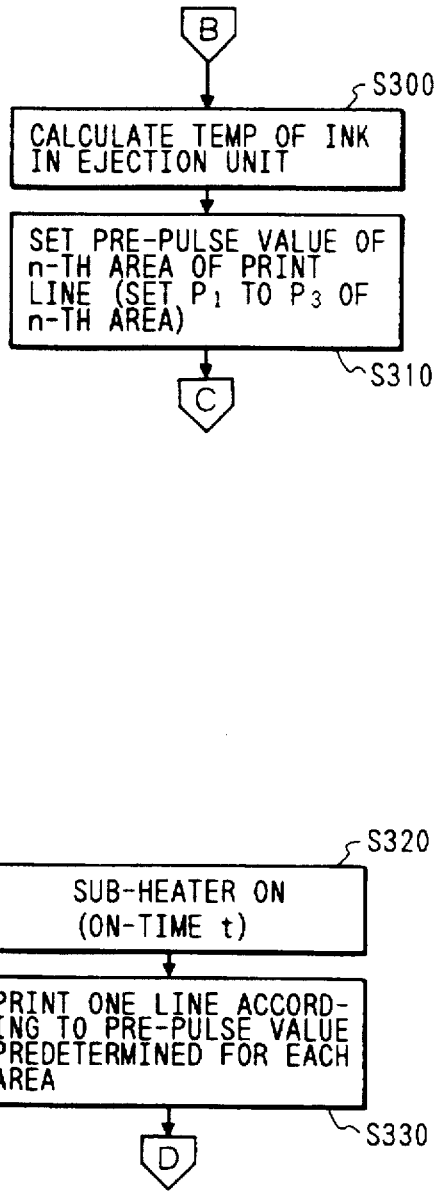

An operation executed when recording is performed using the recording apparatus with the above arrangement will be described below with reference to the flow charts shown in FIGS. 17 to 19.

When the power switch is turned on in step S100, an internal temperature increase correction timer is reset/set (S110). The temperature of a temperature sensor (to be referred to as a reference thermistor hereinafter) on a main body printed circuit board (to be referred to as a PCB hereinafter) is read (S120) to detect the surrounding temperature. However, the reference thermistor is influenced by a heat generation element (e.g., a driver) on the PCB, and cannot often detect the accurate surrounding temperature of the head. Therefore, the detection value is corrected according to an elapsed time from the ON operation of the power switch of the main body, thereby obtaining the surrounding temperature. More specifically, the elapsed time from the ON operation of the power switch is read from the internal temperature increase correction timer to look up an internal temperature increase correction table (Table 5) so as to obtain the accurate surrounding temperature from which the influence of the heat generation element is corrected (S140).

TABLE 5

| Internal Temperature Increase Correction Timer (min) | Correction Value (°C.) |
|---|---|
| 0 to 2 | 0 |
| 2 to 5 | −2 |
| 5 to 15 | −4 |
| 15 to 30 | −6 |
| more than 30 | −7 |

In step S150, a temperature prediction table (FIG. 20) is looked up to predict a current head chip temperature (β), and the control waits for an input print signal. The current head chip temperature (β) is predicted by updating the surrounding temperature obtained in step S140 by adding to it a value determined by a matrix of a difference between the head temperature and the surrounding temperature with respect to energy to be supplied to the head in unit time (power ratio). Immediately after the power switch is ON, since there is no print signal (energy to be supplied to the head is 0), and the temperature difference between the head temperature and the surrounding temperature is also 0, a matrix value "0" (thermal equilibrium) is added. If there is no input print signal, the flow returns to step S120, and the processing is repeated from the operation for reading the temperature of the reference thermistor. In this embodiment, a head chip temperature prediction cycle is set to be 0.1 sec.

The temperature prediction table shown in FIG. 20 is a matrix table showing temperature increase characteristics in unit time, which are determined by the thermal time constant of the head and energy supplied to the head. As the power ratio becomes larger, the matrix value is also increased. On the other hand, when the temperature difference between the head temperature and the surrounding temperature becomes larger, the thermal equilibrium tends to be established. For this reason, the matrix value is decreased. The thermal equilibrium is established when the supplied energy is equal to radiation energy. In the table, the power ratio=500% means that energy obtained when the sub-heaters are energized is converted into the power ratio.

The matrix values are accumulated based on this table every time the unit time elapses, so that the temperature of the head at that time can be presumed, and a future change in temperature of the head can be predicted by inputting future print data, or energy to be supplied to the head (e.g., to the sub-heaters) in the future.

When the print signal is input, a target (driving) temperature table (Table 6) is looked up to obtain a print target temperature (α) of the head chip capable of performing optimal driving at the current surrounding temperature (S170). In Table 6, the reason why the target temperature varies depending on the surrounding temperature is that even when the temperature on a silicon heater board of the head is controlled to be a predetermined temperature, since the ink flowing into the heater board has a low temperature and a large thermal time constant, the temperature of a system around the head chip is lowered from the viewpoint of an average temperature. For this reason, as the surrounding temperature becomes lower, the target temperature of the silicon heater board of the head must be increased. Therefore, the above-mentioned keeping temperature can be attained in a low-temperature environment by changing the target temperature in control.

TABLE 6

| Surrounding Temperature (°C.) | Target Temperature (°C.) |
|---|---|
| up to 12 | 52 |
| 12 to 15 | 50 |
| 15 to 18 | 48 |
| 18 to 21 | 46 |
| 21 to 24 | 44 |
| 24 to 27 | 42 |
| 27 to 30 | 40 |
| 30 to 33 | 38 |
| 33 to 36 | 36 |

In step S180, a difference γ (=α−β) between the print target temperature (α) and the current head chip temperature (β) is calculated. In step S190, a sub-heater control table (Table 7) is looked up to obtain a pre-print sub-heater ON time (t) for the purpose of decreasing the difference (γ). This function is to increase the temperature of the entire head chip using the sub-heaters when the presumed head temperature and the target temperature have a difference therebetween at the beginning of the print operation. With this function, the temperature of the entire head chip including the ink in the ejection unit can approach the target temperature as much as possible.

TABLE 7

| Difference γ (°C.) | Sub-heater ON Time (sec) | γ (°C.) | ON (sec) |
|---|---|---|---|
| −18 to −15 | 6 | −42 to −39 | 14 |
| −15 to −12 | 5 | −39 to −36 | 13 |
| −12 to −9 | 4 | −36 to −33 | 12 |
| −9 to −6 | 3 | −33 to −30 | 11 |
| −6 to −5 | 2 | −30 to −27 | 10 |
| −5 to −4 | 1 | −27 to −24 | 9 |
| −4 to −3 | 0.5 | −24 to −21 | 8 |
| −3 to −2 | 0.2 | −21 to −18 | 7 |
| more than −2 | 0 | | |

After the pre-print sub-heater ON time (t) is obtained, the temperature prediction table (FIG. 20) is looked up to predict a (future) head chip temperature immediately before the start of the print operation under an assumption that the sub-heaters are turned on for the setting time (S200). The difference (γ) between the print target temperature (α) and this head chip temperature (β) is calculated (S210). Since the difference between the print target temperature and the head chip temperature can be considered as a difference between the keeping temperature and the ink temperature, the ink temperature can be substantially obtained as a sum the keeping temperature and the difference (γ) (S220). Needless to say, it is preferable that the difference (γ) is 0. When the driving operation is performed according the predicted ink temperature with reference to the ejection unit ink temperature—pre-pulse table shown in FIG. 12A so as to attain the ejection quantity equal to that obtained by the print operation at the keeping temperature, the ejection quantity can be stabilized.

This embodiment is attained under an assumption that the ink temperature is set to be at least equal to or higher than the keeping temperature before printing using the above-mentioned sub-heaters, and employs a method for correcting an increase in ejection quantity when the recording head accumulates heat in a continuous print operation at a high duty, and the ink temperature is increased accordingly. In this embodiment, the ejection quantity based on a difference from the target value is corrected by a PWM method.

The chip temperature of the head changes depending on its ejection duty during a one-line print operation. More specifically, since the difference (γ) is sometimes changed in one line, it is preferable to optimize the pre-pulse value in one line according to the change in difference. In this embodiment, the one-line print operation requires 1.0 sec. Since the temperature prediction cycle of the head chip is also 0.1 sec, one line is divided into 10 areas in this embodiment. The pre-pulse value (S230) at the beginning of printing, which value is set previously, is a pre-pulse value at the beginning of printing of the first area.

A method of determining a pre-pulse value at the beginning of printing of each of the second to 10th areas will be described below. In step S240, n=1 is set, and in step S250, n is incremented. In this case, n represents the area, and since there are 10 areas, the control escapes from the following loop when n exceeds 10 (S260).

In the first round of the loop, the pre-pulse value at the beginning of printing of the second area is set. More specifically, the power ratio of the first area is calculated based on the number of dots and the PWM value of the first area (S270). The power ratio corresponds to a value plotted along the ordinate when the temperature prediction table is looked up. The reason why the number of dots (print duty) is not merely used is that energy to be supplied to the head chip varies depending on the pre-pulse value even if the number of dots remains the same. Using the concept of the "power ratio", a single table can be used even when the PWM control is performed or when the sub-heaters are ON.

In this case, the head chip temperature (β) at the end of printing of the first area (i.e., at the beginning of printing of the second area) is predicted by substituting the power ratio in the temperature prediction table (FIG. 20) (i.e., by looking up the table) (S280). In step S290, the difference (γ) between the print target temperature (α) and the head chip temperature (β) is calculated again. A pre-pulse value for printing the second area is obtained by looking up FIG. 12A based on the difference (γ), and is set on a memory (S300 and S310).

Thereafter, the power ratio in the corresponding area is sequentially calculated based on the number of dots and the pre-pulse value of the immediately preceding area, and the head chip temperature (β) at the end of printing of the corresponding area is predicted. Then, the pre-pulse value of the next area is set based on the difference (γ) between the print target temperature (α) and the head chip temperature (β) (S250 to S310). After the pre-pulse values of all the 10 areas in one line are set, the flow advances from step S260 to step S320 to heat the sub-heaters before printing. Thereafter, a one-line print operation is performed according to the set pre-pulse values (S330). Upon completion of the one-line print operation in step S330, the flow returns to step S120 to read the temperature of the reference thermistor. Thereafter, the above-mentioned control is repeated in turn.

With the above-mentioned control, the actual ejection quantity can be stably controlled independently of the ink temperature, and a high-quality recorded image having a uniform density can be obtained.

The ejection quantity control will be described below again. In this embodiment, ejection/ejection quantity of the head is stabilized by controlling the following two points.

① The target temperature is determined from the "target temperature table" according to the surrounding temperature, so that the temperature of the recording head including the ink in the ejection unit reaches at least the keeping temperature, and the recording head is heated using the sub-heaters as needed. More specifically, in this embodiment, the ink temperature in the ejection unit is equal to a temperature obtained by subtracting the difference between the target temperature and the surrounding temperature from a calculated temperature.

② A shift (difference) between the target temperature and the current head temperature is presumed. The sum of the keeping temperature and the presumed difference is considered as the ink temperature in the ejection unit, and the pre-pulse value is set according to the ink temperature, thereby stabilizing the ejection quantity.

In this embodiment, since a future head temperature can be predicted without using a temperature sensor for directly measuring the temperature of the recording head, various head control operations can be performed before the actual print operation, and hence, recording can be performed more properly.

Constants such as the number of divided areas (10 areas) in one line, the temperature prediction cycle (0.1 sec), and the like used in this embodiment are merely examples, and the present invention is not limited to these.

(Ninth Embodiment)

Figure 21:
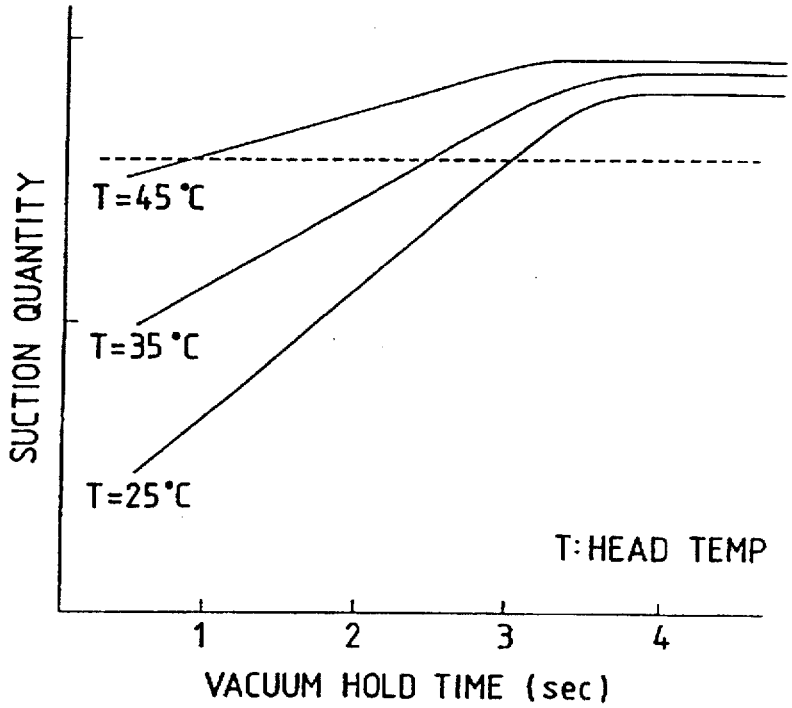
FIG. 21 is a graph showing the temperature dependency of the vacuum hold time and the suction quantity.

In this embodiment, the current head temperature is presumed from a print duty like in the eighth embodiment, and a suction condition is changed according to the presumed head temperature. The suction condition is controlled based on a suction pressure (initial piston position) or a suction quantity (volume change quantity or vacuum hold time). FIG. 21 shows the head temperature dependency of the vacuum hold time and the suction quantity. Although the suction quantity can be controlled according to the vacuum hold time for a predetermined period, the suction quantity changes independently of the vacuum hold time in other periods. Since the suction quantity is influenced by the head temperature presumed from the print duty, the vacuum hold time is changed according to the presumed head temperature. In this manner, even when the head temperature changes, the ejection quantity can be maintained constant (optimal quantity), thus stabilizing ejection.

Furthermore, when a plurality of heads are used, the head temperature is presumed more precisely by performing heat radiation correction according to the arrangement of the heads. Since the end portion of a carriage causes heat radiation more easier than the central portion, and the temperature distribution varies, ejection largely influenced by the temperature also varies. For this reason, correction is made while heat radiation at the end portion is assumed to be 100%, and heat radiation at the central portion is assumed to be 95%. With this correction, a thermal variation can be prevented, and stable ejection can be attained. Furthermore, the suction condition may be changed according to the features or states of heads in units of heads.

Furthermore, in this embodiment, a head temperature drop upon suction is presumed. When the surrounding temperature and the head temperature have a difference therebetween, the ink at a high temperature is discharged by suction, and a new ink at a low temperature is supplied from the ink tank. The head at a high temperature is cooled by the supplied new ink. Table 8 below shows the difference between the surrounding temperature and the presumed head temperature, and temperature drop correction upon suction. When the head temperature is presumed from the print duty, the temperature drop upon suction can be corrected based on the difference between the surrounding temperature and the head temperature, and the head temperature after suction can be simultaneously predicted.

TABLE 8

| Difference between Surrounding Temperature and Presumed Head Temperature (°C.) | ΔT Upon Suction (°C.) |
|---|---|
| 0 to 10 | −1.2 |
| 10 to 20 | −3.6 |
| 20 to 30 | −6.0 |

In the case of an exchangeable head, the temperature of the ink tank need be presumed. Since the ink tank is in tight contact with the head, the temperature rise caused ejection influences the ink tank. For this reason, the ink tank temperature is presumed from an average of temperatures for last 10 minutes. The presumed temperature can be fed back to compensate for the temperature drop upon suction.

In the case of a permanent head, since the head and the ink tank are separated from each other, the temperature of an ink to be supplied is equal to the surrounding temperature, and the temperature of the ink tank need not be predicted.

Figure 22:
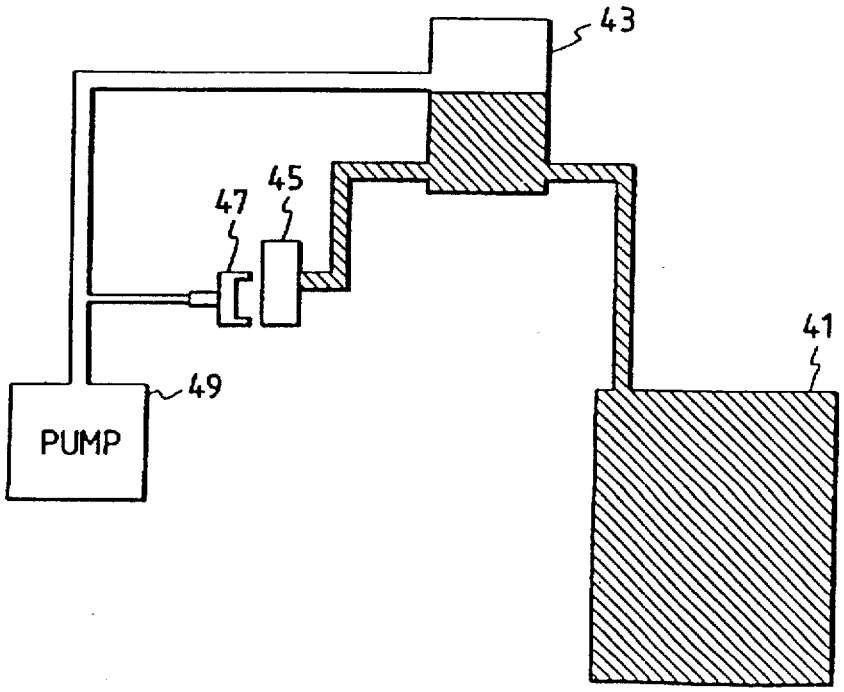
FIG. 22 is a diagram showing an arrangement of a sub-tank system.

Furthermore, in the case of a sub-tank system shown in FIG. 22, even when the suction operation is performed while the temperature of the ink is high, the suction quantity is undesirably increased. For this reason, an ink-level pull-up effect cannot be expected, thus causing an ink supply error. When the head temperature predicted from the print duty is high, the number of times of suction is increased to obtain the sufficient ink-level pull-up effect. Table 9 below shows the relationship between the difference between the surrounding temperature and the presumed head temperature, and the number of times of suction. In Table 9, as the difference between the surrounding temperature and the presumed head temperature is larger, the number of times of suction is increased. Thus, the ink-level pull-up effect can be prevented from being impaired.

Note that the sub-tank system shown in FIG. 22 includes a main tank 41 provided to the apparatus main body, a sub-tank 43 arranged on, e.g., a carriage, a head chip 45, a cap 47 for covering the head chip 45, and a pump 49 for applying a suction force to the cap 47.

TABLE 9

| Difference between Surrounding Temperature and Presumed Head Temperature (°C.) | Number of Times of Suction |
|---|---|
| 0 to 10 | 8 |
| 10 to 20 | 10 |
| 20 to 30 | 12 |

(10th Embodiment)

The current head temperature is presumed from the print duty like in the ninth embodiment. In this embodiment, a pre-ejection condition is changed according to the presumed head temperature, and this embodiment corresponds to the second embodiment.

At a high temperature, the ink in the ejection unit is easily evaporated. Thus, the pre-ejection interval or the number of times of pre-ejection can be changed according to the presumed head temperature. In this embodiment, the number of times of pre-ejection is changed according to the presumed head temperature upon pre-ejection like in Table 1. At the same time, as the temperature becomes higher, the ejection quantity is increased. Thus, the pulse width is decreased to suppress the ejection quantity. Since this embodiment is substantially the same as the second embodiment except for the above-mentioned point, a detailed description thereof will be omitted.

(11th Embodiment)

This embodiment exemplifies a case wherein the past average head temperature within a predetermined period is presumed from a temperature detected by a reference temperature sensor provided to a main body, and a print duty, and a predetermined recovery means is operated at intervals optimally set according to the average head temperature. The recovery means to be controlled according to the average head temperature in this embodiment includes pre-ejection and wiping means, which are executed at predetermined time intervals during printing (in a cap open state) so as to stabilize ejection. As is known in the ink jet technique, the pre-ejection means is executed for the purpose of preventing a non-ejection state or a change in density caused by evaporation of the ink from nozzle openings. Paying attention to the fact that ink evaporation varies depending on the head temperature, in this embodiment, the optimal pre-ejection interval and the optimal number of times of pre-ejection are set according to the average head temperature, and pre-ejection operations are performed efficiently in terms of time or ink consumption.

In open-loop temperature control, i.e., in a method of calculating and presuming a temperature at that time on the basis of the temperature detected by the reference temperature sensor provided to the main body, and the past print duty, as the major constituting element of this embodiment, the average head temperature during the past predetermined period, which is required in this embodiment, can be easily obtained. This embodiment pays attention to the fact that ink evaporation is associated with the head temperatures at respective times, and the total quantity of evaporated ink during a predetermined period has a strong correlation with the average head temperature during this period.

Also, in this embodiment, paying attention to the fact that the wet quantity due to, e.g., the ink varies depending on the head temperature, and evaporation of the wet quantity which makes it difficult to remove the ink or the foreign matter, is associated with the head temperature (the temperature of the orifice formation surface), the wiping operation is efficiently performed by setting optimal wiping intervals according to the past average head temperature. Since the wet quantity or evaporation of the wet quantity associated with wiping has a stronger correlation with the past average head temperature than the head temperature at the time of wiping, a head temperature presuming means of this embodiment is suitably used.

The outline of the print sequence of this embodiment is the same as that shown in the flow chart of FIG. 15 described in the third embodiment. In this embodiment, in step S2, a pre-ejection timer is set according to the average head temperature at that time, and is started. Furthermore, in step S3, a wiping timer is set according to the average head temperature at that time, and is started.

When a print operation is to be continued, the wiping timer and the pre-ejection timer, which have been set according to the average head temperature, are checked and re-set, and after wiping or pre-ejection is performed as needed, the timers are restarted (steps S15 and S16). At this time, in steps S151 and S161, the average head temperature is calculated regardless of the presence/absence of execution of the operation.

More specifically, if this embodiment, since the wiping and pre-ejection timings can be finely re-set according to a change in average head temperature in units of print lines, optimal wiping and pre-ejections according to the evaporation and wet conditions of the ink can be performed.

Table 2 presented previously can be employed as a correspondence table between the pre-ejection interval and the number of times of pre-ejection according to the average head temperature for last 12 sec, and a correspondence table of the wiping interval according to the average head temperature for last 48 sec in this embodiment.

As has been described above in the sixth embodiment, the head temperature is not limited to a presumed temperature at the present time, and a future head temperature can also be easily predicted. Therefore, the optimal pre-ejection interval and the optimal number of times of pre-ejection may be set in consideration of a future condition.

(12th Embodiment)

This embodiment exemplifies a suction recovery means according to the past average head temperature for a relatively long period of time as another example of recovery control based on the presumed average head temperature like in the 11th embodiment. In this embodiment, as shown in Table 2 (fourth embodiment) above, the suction recovery interval is set according to the average head temperature for last 12 hours, and a suction recovery operation is frequently performed as the average head temperature is higher. The average temperature may be reset for, e.g., every page.

When the past average head temperature over a relatively long period of time is to be presumed using a plurality of heads, as shown in FIG. 4 presented previously, after the plurality of heads are thermally coupled, the average head temperature may be presumed on the basis of the average duty of the plurality of heads, and the temperature detected by the reference temperature sensor, so that control may be simplified under an assumption that the plurality of heads are almost identical.

As has been described above in the eighth embodiment, the head temperature is not limited to a presumed temperature at the present time, and a future head temperature can also be easily predicted. Therefore, optimal suction recovery control may be set in consideration of a future condition.

For example, even when anxiety for an ejection error upon execution of a high-duty print operation at the current presumed head temperature is present, if it is known that no high-duty print operation will be performed in the future, the suction operation is postponed at the present time, and is performed after a recording medium is discharged, thereby shortening the total print time.

(13th Embodiment)

This embodiment exemplifies a case wherein a recovery system is controlled according to the history of a temperature presumed from a temperature detected by a reference temperature sensor of a main body, and a print duty. This embodiment corresponds to the fifth embodiment described above.

In this embodiment, a rubbing mode is controlled according to the number of times of ejection according to the head temperature, and Table 3 can be employed.

As has been described above in the eighth embodiment, the head temperature is not limited to a presumed temperature at the present time, and a future head temperature can also be easily predicted. Therefore, optimal control may be set using the "weighted number of times of ejection" in consideration of a future condition in the calculation of the "weighted number of times of ejection".

(14th Embodiment)

This embodiment exemplifies suction recovery control like in the fourth embodiment. In this embodiment, in addition to presumption of a bubble (non-print bubble) grown when the ink is left as it is, a bubble (print bubble) grown in the print mode is also presumed, thus allowing presumption of bubbles in the ink channel with high precision. This embodiment corresponds to the sixth embodiment described above. In this embodiment, the non-print time and the number of times of ejection, which are weighted by the head temperature need only be counted, and this embodiment employs Table 4 above.

As has been described above in the eighth embodiment, the head temperature is not limited to a presumed temperature at the present time, and a future head temperature can also be easily predicted. Therefore, optimal control may be set using "evaporation characteristics of the ink" and "growth of bubble in the ink channel" in consideration of a future condition in presumption and prediction of the "evaporation characteristics of the ink" and the "growth of bubble in the ink channel".

Note that in the ninth to 14th embodiments, the ejection quantity control described in the first embodiment may or may not be executed in combination. When no ejection quantity control is performed, steps associated with the PWM control and sub-heater control can be omitted.

(15th Embodiment)

This embodiment exemplifies an ink jet recording apparatus comprising a temperature keeping means constituted by a self temperature control type heating member, thermally coupled to a recording head, for maintaining the temperature of the recording head at a predetermined keeping temperature higher than a surrounding temperature capable of performing recording, and a temperature keeping timer for managing an operation time of the heating member, a temperature prediction means for predicting a change in ink temperature in an ejection unit in a recording mode prior to recording, and an ejection stabilization means for stabilizing ejection according to the ink temperature in the ejection unit.

In this embodiment, a difference from the ink jet recording apparatuses described in the eighth to 14th embodiments is that the heating member provided to the recording head is a self temperature control type heater which contacts not a heater board but an aluminum base plate as the base member of the recording head.

Therefore, ink temperature prediction can be simplified as compared to the above embodiments. More specifically, in the arrangement of the recording head like in this embodiment, since the aluminum base plate having a heat capacity which largely influences the ink temperature in the ejection unit is always maintained at the control temperature, as for an increase/decrease in ink temperature, the temperature rise caused by heat generation of the ejection heaters, and heat radiation according to the thermal time constant of the recording head need only be predicted with reference to the control temperature.

In this embodiment, a sum of a reference temperature (keeping temperature) and a value obtained by accumulating increased temperature remainders in all the effective reference time periods (the increased temperature remainder is not 0) before an objective reference time period in which the ink temperature is presumed is determined as the ink temperature during the objective reference time period with reference to a descent temperature table in FIG. 13, which shows increased temperature remainders from the keeping temperature according to the power ratio during a given reference time period in units of elapsed times from the reference time period. A print time for one line is assumed to be 0.7 sec, and a time period (0.02 sec) obtained by dividing this print time by 35 is defined as the reference time period.

For example, if recording is performed for the first time at a power ratio of 20% during the first reference time period, 80% during the second reference time period, and 50% during the third reference time period after the temperature keeping operation is completed, the ink temperature of the ejection unit during the fourth reference time period can be presumed from the increased temperature remainders of the three reference time periods so far. More specifically, the increased temperature remainder during the first reference time period is $85\times10^{-3}$ deg (ⓐ in FIG. 13) since the power ratio is 20% and the elapsed time is 0.06 sec; the increased temperature remainder during the second reference time period is $369\times10^{-3}$ deg (ⓑ in FIG. 13) since the power ratio is 80% and the elapsed time is 0.04 sec; and the increased temperature remainder during the third reference time period is $250\times10^{-3}$ deg (ⓒ in FIG. 13) since the power ratio is 50% and the elapsed time is 0.02 sec. Therefore, when these remainders are accumulated, we have $704\times10^{-3}$ deg, and 36.704° C. as the sum of this value and 36° C. are predicted as the ink temperature of the ejection unit during the fourth reference time period.

In this embodiment, ejection quantity control based on the predicted ink temperature described in the eighth embodiment can be performed.

In this embodiment, a recording operation is inhibited or an alarm is generated for a user until the temperature keeping timer measures a predetermined period of time. When a surrounding temperature detection means for detecting the surrounding temperature is added like in the above embodiment, the temperature of the aluminum base plate can be predicted at a desired timing even before completion of the temperature keeping operation. For this reason, the ink temperature in, the ejection unit may be detected using the predicted temperature as a reference temperature so as to allow recording before completion of the temperature keeping operation. When the surrounding temperature detection means is arranged, since a time until completion of the temperature keeping operation can be calculated and predicted, the time of the temperature keeping timer may be changed according to the predicted time.

According to the temperature control method of this embodiment, the same ejection stabilization control described in the ninth to 14th embodiments can be realized, and simplified temperature prediction can be expected.

As described above, according to the present invention, the temperature of the recording head is maintained at a temperature higher than the surrounding temperature, and ejection is stabilized according to the ink temperature in the ejection unit; which is presumed prior to recording. Therefore, the ejection quantity and ejection can be stabilized without considerably decreasing the recording speed, and a high-quality image having a uniform density can be obtained.

When the ink temperature is presumed without arranging temperature sensors in the recording head, the recording apparatus main body and the recording head can be simplified.

(16th Embodiment)

The 16th embodiment of the present invention will be described in detail below with reference to the accompanying drawings. In this embodiment, a temperature detection member capable of directly detecting the temperature of the recording head of the above-mentioned recording apparatus, and a temperature calculation circuit for this member are added.

The control arrangement of this embodiment is the same as that shown in FIG. 5, and the arrangement of a recording head is the same as that shown in FIG. 6. In FIG. 6, head temperature sensors 8*e* are arranged on a heater board 853 of the recording head together with ejection heaters 8*g* and sub-heaters 8*d*, and are thermally coupled to the heat source of the recording head. In this embodiment, the output temperature characteristics of a temperature detection diode, which is formed simultaneously with a diode formed on the heater board as a portion of an ejection heater driver, are used as a temperature sensor (Di sensor).

Figure 23:
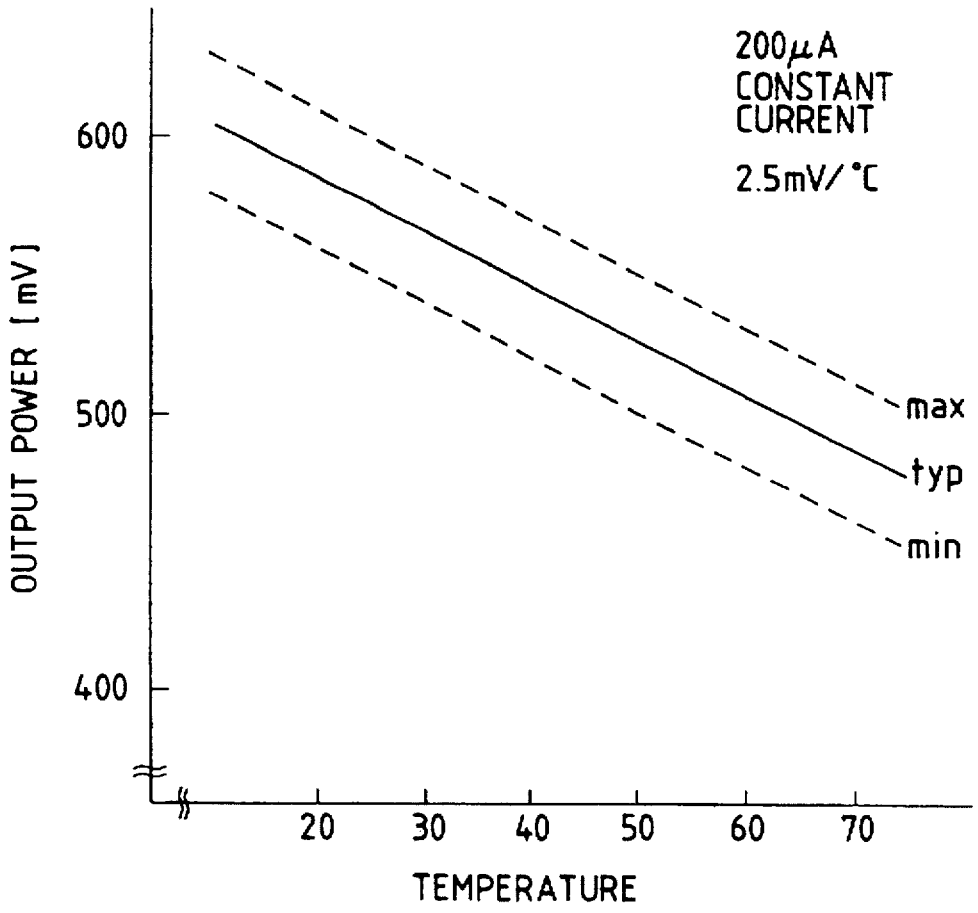
FIG. 23 is a graph showing output characteristics of a temperature sensor of the recording head used in the present invention.

FIG. 23 shows temperature characteristics of the temperature characteristics of the temperature detection member of the recording head of this embodiment. In this embodiment, the temperature detection member is driven at a constant current of 200 μA, and exhibits output characteristics, i.e., an output voltage $V_F$ of 575±25 mV (25° C.), and the temperature dependency of about −2.5 mV/° C. Although variations in temperature dependency are small in terms of the manufacturing process of the element, the output voltage deviates largely, and a variation of about 25° C. may occur. The temperature detection precision required in this embodiment is ±2° C., and 12 ranks of identification information are required so as to measure a correction value and to provide information to the recording head upon delivery of the recording head. Variations of the temperature detection elements can be suppressed in the manufacturing process. For this purpose, however, the manufacturing cost of the recording head is undesirably increased, and it is very disadvantageous for an exchangeable recording head like in this embodiment.

In this embodiment, the temperature sensor of the recording head is corrected using a reference sensor provided to the recording apparatus main body. When the detection temperature is corrected, the temperature of the ink in a common ink chamber surrounded by a top plate 8*f*, which temperature is important for stabilization of ejection, especially, the ink temperature in the ejection unit, can be detected with high precision, and ejection can be stabilized.

(Temperature Calibration)

Calibration of the temperature detection member of the recording head in this embodiment is performed using a chip thermistor 5024 arranged on an electrical circuit board of the main body in a non-record mode with the small ink temperature drift in the ejection unit. The chip thermistor 5024 is arranged on the electrical circuit board together with its detection circuit, and has already been calibrated as well as a variation of the detection circuit before delivery of the recording apparatus.

Since the chip thermistor 5024 can detect the temperature in the recording apparatus main body, it is considered that the temperature of the recording head is equal to the detection value in a state wherein no energy for a temperature keeping operation and ejection is supplied to the recording head. When such energy is supplied to the recording head, the temperature in the recording apparatus main body becomes almost equal to the temperature of the recording head after an elapse of a predetermined period of time after the supply of energy.

This embodiment comprises a non-record time measurement timer for measuring a non-record time. When a non-record state continues over a predetermined period of time, the temperature detection member of the recording head is calibrated to calculate a correction value for matching a value actually measured by the temperature detection member of the recording head with the detection temperature of the chip thermistor of the main body. The calculated correction value is stored in a RAM or an EEPROM 62. Thereafter, the temperature of the recording head is calculated by correcting the actually measured value using the correction value. The non-record time in this embodiment means a state wherein no energy is supplied to the recording head. Therefore, the non-record time does not include a time while the temperature of the recording head is maintained as a preliminary operation for recording. Even in a power OFF state, when a timer means backed up by a battery is available, the power OFF time may be measured for the purpose of simplifying timer control.

Furthermore, as a calibration execution timing, every time the non-record time exceeds a predetermined period of time, calibration may be executed. When the non-record time exceeds the predetermined period of time, only a calibration request signal is generated, and the calibration is not executed actually at that time. Thereafter, the calibration may be executed before new energy is supplied to the recording head, e.g., before the beginning of the next recording or immediately after the power switch is turned on.

The heat source in the recording apparatus includes a power supply unit of the recording apparatus, and a control element itself on the electrical circuit board in addition to the recording head. In some cases, the detection temperature of the chip thermistor 5024 as the reference temperature sensor in the main body may exceed the temperature of the remaining portion in the recording apparatus including the recording head. For this reason, in this embodiment, the detection temperature of the chip thermistor 5024 is corrected on the basis of the power-ON time of the recording apparatus. As a correction table for this operation, Table 5 presented previously is used, and the same timer as that for measuring the non-record time is used for measuring the power-ON time.

In this embodiment, the power-ON timer simply measures a time elapsed from when the power switch is turned on until the temperature sensor of the recording head is corrected. When the influences of the heat generation amount of the power supply and the heat generation amount of the driver for the recording head are large, a temperature rise calculated based on energy supplied to the recording head may be corrected in addition to the power-ON time. Furthermore, correction may be made on the basis of all the past factors such as the power-ON time or energy supplied to the recording head that influence the local temperature rise of the chip thermistor 5024 of the main body.

Figure 24:
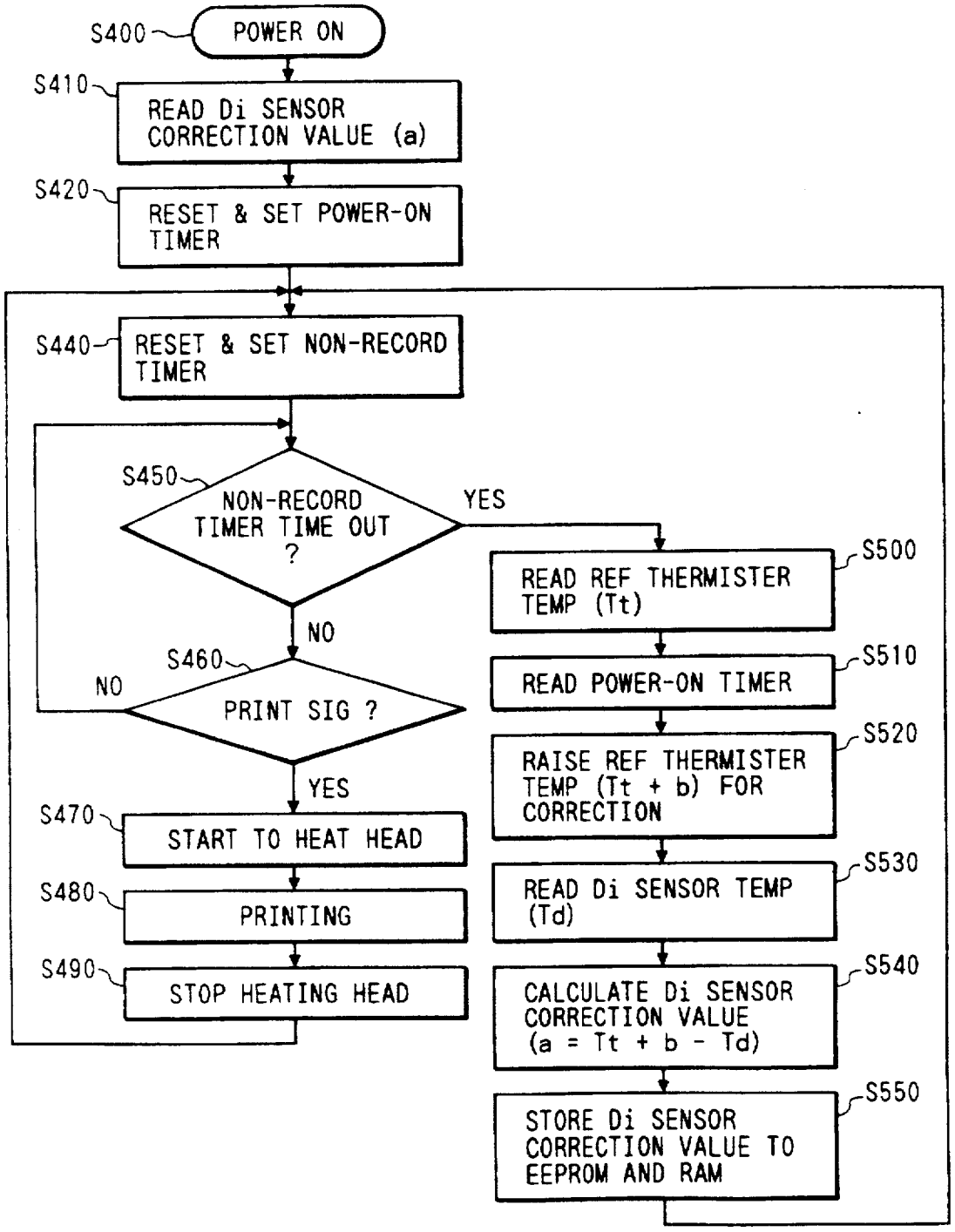
FIG. 24 is a flow chart showing calibration of a temperature detection member of a recording head in the 16th embodiment.

FIG. 24 shows a processing flow for calibrating the temperature detection member of the recording head in this embodiment. Calibration processing will be described in detail below with reference to FIG. 24 and the block diagram of FIG. 5.

When the power switch is turned on in step S400, a CPU 60 reads a Di sensor correction value (a) stored in the EEPROM 62 into its internal RAM so as to set a state wherein the Di sensor is corrected and used (S410). Then, the power-ON timer is reset/started to prepare for temperature rise correction of the chip thermistor sensor 5024 in the main body (S420). Then, the non-record timer for determining the correction timing of the Di sensor is reset/started (S440). In this state, the control stands by while checking if the non-record timer reaches a time-out state (S450) or if a print signal is input (S460).

When the print signal is input first, a head heating operation is started to prepare for the print operation (S470). In this case, temperature detection for the head heating operation is performed by correcting the temperature detected by the Di sensor using the correction value stored in the EEPROM 62. After the head heating operation, the recording (print) operation is performed (S480). Thereafter, the head heating operation is stopped (S490). During the print operation, as described above, ejection stabilization control can be performed by a PWM ejection quantity control method based on the detection temperature of the recording head. In the head heating operation and the recording operation, since energy is supplied to the recording head, the temperature of the recording head is different from (normally higher than) the temperature of the chip thermistor 5024 on the main body electrical circuit board. For this reason, after the recording operation is completed, the non-record timer is reset/started (S440), thus re-waiting for the correction timing of the Di sensor.

When the non-record timer has reached the time-out state in the standby state, i.e., when it is considered that the temperature in the recording apparatus main body (the temperature of the chip thermistor 5024) becomes almost equal to the temperature of the recording head, the Di sensor correction is performed. In the Di sensor correction, the temperature (Tt) of the reference thermistor (chip thermistor 5024) is read (S500), and the temperature rise correction of the temperature of the reference thermistor is performed with reference to the data from the power-ON timer for temperature rise correction (S510). The temperature rise correction is performed using a correction value b in a table (Table 5) stored in a program ROM 61 (Tt+b).

Then, the Di sensor temperature (Td) is read (S530), and the Di sensor correction value (a) is calculated (S540). The Di sensor correction value is calculated as a difference (Tt+b–Td) between the temperature (Tt+b) of the reference thermistor 5024 after the temperature rise correction, and the Di sensor temperature (Td). The correction value (a) obtained as described above of the Di sensor as the temperature sensor of the recording head is stored in the backup EEPROM, and is left in the internal RAM of the CPU 60 for the next temperature control (S550). In this manner, the correction of the Di sensor is completed, and the flow returns to step S440 to prepare for the next correction timing or the print operation.

As described above, since the temperature detection member of the recording head can be easily calibrated, even when an exchangeable recording head is used like in this embodiment, the temperature control of the recording head can be stably performed. When control is made using the temperature detection member of the recording head, which member is corrected easily as described above, an actual ejection quantity can be stably controlled independently of the ink temperature, and a high-quality recorded image having a uniform density can be obtained.

In this embodiment, when 30 minutes have elapsed as the non-record time, the correction is performed. However, this time period may be properly set according to the required precision of calibration (correction).

In this embodiment, as an example of using the calibrated temperature detection member of the recording head, double-pulse PWM control for controlling the ejection quantity is used. However, single-pulse PWM control or PWM control using three or more pulses may be used. In this embodiment, control is made to perform optimal ejection according to the temperature of the recording head. For example, this embodiment may be used in control for changing a recording speed or delaying (standing by) recording so that the temperature of the recording head falls within a predetermined range. The detection temperature of the calibrated temperature detection member may be used not only in driving control of the recording head but also in control of a known recovery system as ejection stabilization means, for example, a means for forcibly discharging the ink from the recording head, wiping means, and pre-ejection means.

(17th Embodiment)

Figure 25:
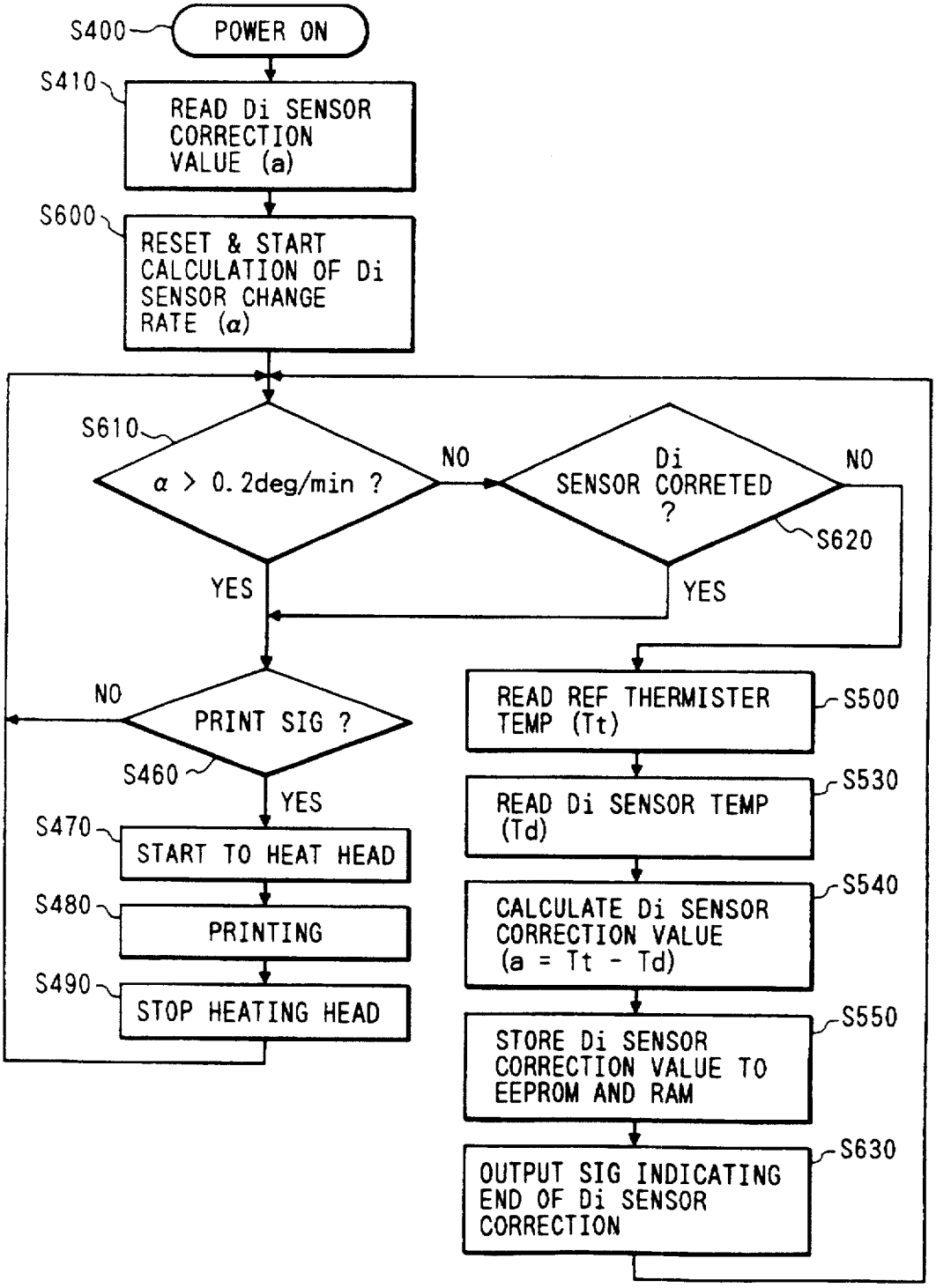
FIG. 25 is a flow chart showing calibration of a temperature detection member of a recording head in the 17th embodiment.

In this embodiment, the calibration timing of a temperature detection member (Di sensor) of a recording head is determined by measuring the change rate of the detection temperature of the temperature detection member. Since the present invention is not limited to the arrangement of the recording head, the arrangement of the temperature detection member of the recording head, and the like, the same arrangements as those in the 16th embodiment described above are used, and only a calibration timing determination method will be described below with reference to FIG. 25. The same reference numerals in FIG. 25 denote the same steps as in FIG. 24.

In this embodiment, the change rate of the detection sensor of the Di sensor is measured from a timing immediately after the power switch is turned on (S400). The change rate of the detection temperature is measured by calculating a difference between temperatures at predetermined time intervals. In this embodiment, the detection temperature is read every minute, and a difference between the current detection temperature stored in the internal RAM of the CPU 60 and the detection temperature one minute before is calculated as the detection temperature change rate ($\alpha$). If it is determined in step S610 that the change rate is smaller than 0.2 deg/min, i.e., if it is considered that the temperature in the recording apparatus main body (the temperature of the chip thermistor 5024) becomes almost equal to the temperature of the recording head, the Di sensor of the recording head is calibrated (S610). In this embodiment, in order to avoid frequent calibration, the presence/absence of execution of correction is checked so that correction is performed once per power ON operation (S620). If it is determined that the Di sensor is corrected for the first time, calibration is performed in the same manner as in the above embodiment, and finally, a signal indicating the end of calibration, i.e., the end of Di sensor correction is recorded (S630).

In this embodiment, since the sensor need only be corrected once when, e.g., the head is exchanged, it is sufficient that the correction is performed at least once after the power ON operation. For this reason, the temperature rise correction of the reference temperature sensor of the main body as a temperature correction method after a relatively long period of time elapses after the power ON operation described in the above embodiment may be omitted. In this embodiment, since it is considered that the recording head is calibrated at a relatively early timing after the power switch is turned on, when the power switch is not so frequently turned on/off, the print operation for several pages after the power ON operation may be performed using an average value of temperature correction pre-stored in the ROM without using a rewritable storage element such as the EEPROM 62.

When the exchange operation of the recording head can be detected by, e.g., detecting attachment/detachment of the recording head using a mechanical switch, if it is determined that the change rate is smaller than a predetermined value after an exchange signal of the recording head is input, calibration may be performed only once.

In this embodiment, when the change rate is smaller than 0.2 deg/min, the Di sensor of the recording head is calibrated. However, the reference change rate may be set according to the required precision of calibration (correction).

(18th Embodiment)

This embodiment exemplifies a method of preventing erroneous correction of a temperature detection member of a recording head. The normal temperature cannot often be detected due to a trouble such as disconnection of the temperature detection member of the recording head or an abnormality of a detection circuit of the main body. In particular, in the case of an exchangeable head, the electrical connection of the temperature detection member may be temporarily disabled. Also, the detection circuit may temporarily cause an abnormality due to electrostatic noise.

Figure 26:
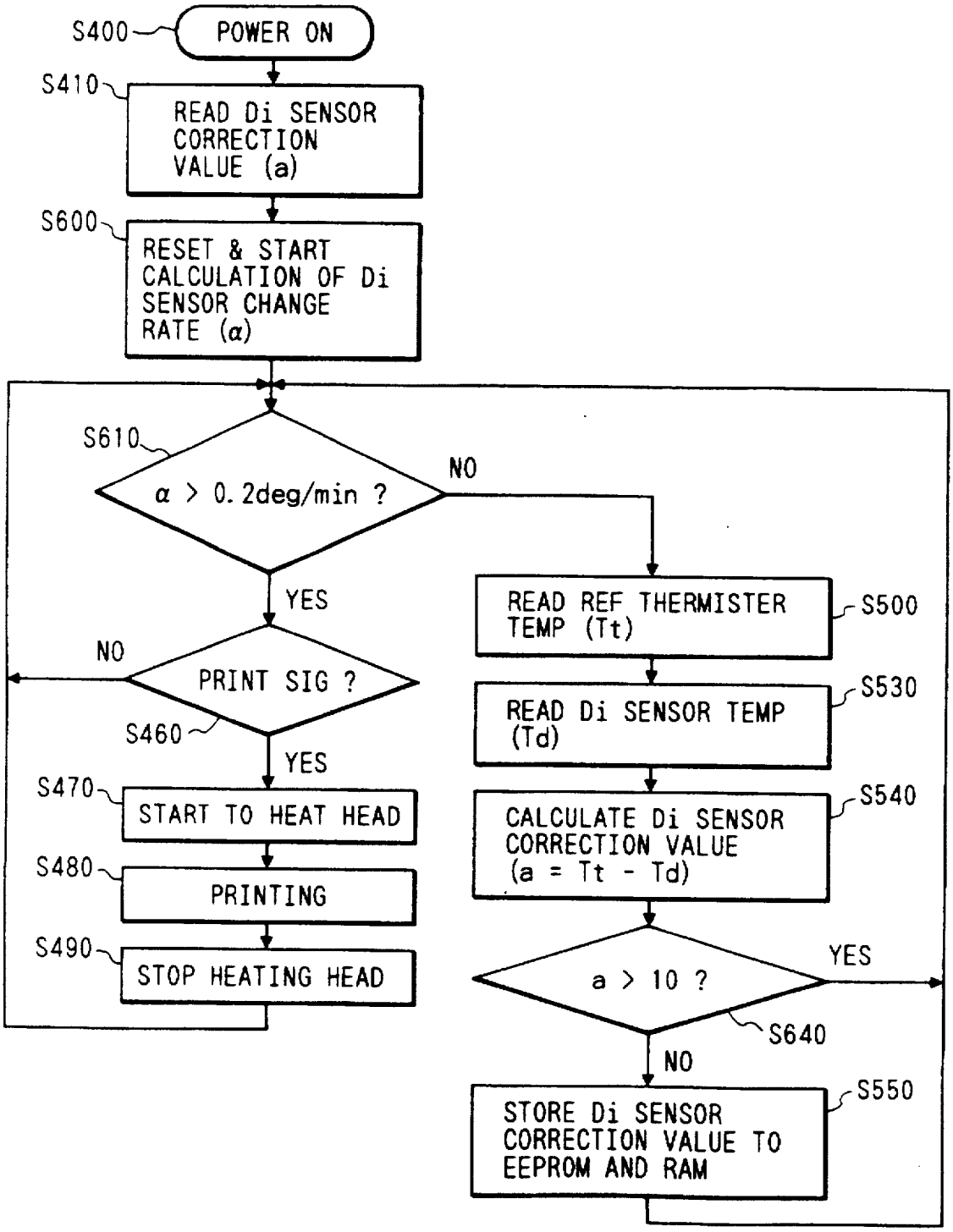
FIG. 26 is a flow chart showing calibration of a temperature detection member of a recording head in the 18th embodiment.

In this embodiment, as shown in FIG. 26, when the temporary abnormality occurs, calibration of the temperature detection member is delayed or stopped. The same reference symbols in FIG. 26 denote the same steps as in FIG. 25.

In step S640 in FIG. 26, if the correction value becomes equal to or larger than 10, it is determined that the above-mentioned abnormality occurs, and the correction value is neither stored nor updated. When the correction value is smaller than 10, the correction value is updated (S550). In this embodiment, when an abnormal correction value is calculated, the control waits for the next correction timing. However, an abnormal temperature alarm may be generated to urge a user to re-attach the recording head.

As described above, according to the present invention, since the temperature detection member provided to the recording head is easily calibrated by the reference temperature sensor provided to the main body, the temperature of the recording head, which is important for stabilizing ejection, can be detected with high precision, and a high-quality image can be obtained.

(19th Embodiment)

Figure 27:
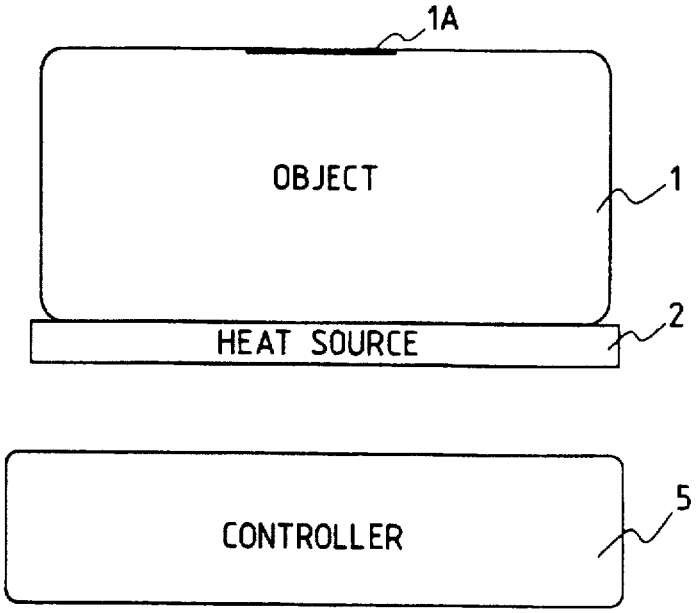
FIG. 27 is an explanatory view for explaining a temperature calculation system of the present invention.

FIG. 27 is an explanatory view of a temperature calculation system for performing a temperature calculation using a temperature calculation algorithm of the present invention. In FIG. 27, an object 1 for the temperature calculation corresponds to a recording head in the case of a recording apparatus. The object 1 has a temperature calculation objective point 1A where the temperature calculation is performed, and corresponds to a heater surface, contacting an ink, of the recording head in the recording apparatus. A heat source 2 applies heat to the object 1, and a controller 5 performs the temperature calculation to control the heat source 2.

The details of the temperature calculation algorithm for calculating a change in temperature of the temperature calculation objective point 1A of the object 1 when the heat source 2 is turned on/off will be described below.

In the present invention, the head temperature is presumed basically using the following heat conduction formulas:

In heating:

$$\Delta temp = a\{1 - exp[-m*T]\} \quad (1)$$

In cooling started during heating:

$$\Delta temp = a\{exp[-m(T-T1)] - exp[-m*T]\} \quad (2)$$

where temp: increased temperature of object a: equilibrium temperature of object by heat source T: elapsed time m: thermal time constant of object T1: time for which heat source is removed When the object 1 such as the recording head is processed as a lumped constant system, a change in temperature can be theoretically calculated and presumed upon combination of the above-mentioned formulas (1) and (2). However, every time the heat source is turned on/off, in the case of the recording apparatus, the formulas (1) and (2) must be developed according to the print duty. In a system wherein the heat source is frequently turned on/off, it is difficult to realize such presumption in terms of processing power. Therefore, in the present invention, the above-mentioned formulas are developed as follows.

<Change in temperature after elapse of nt time after heat source is ON>

| | |
|---|---|
| a{1−exp[−m*n*t]} | . . . <1> = |
| a{exp[−m*t]−exp[−m*t]+exp[−2*m*t]−exp[−2*m*t] + exp[−(n−1)*m*t]−exp[−(n−1)*m*t]+1−exp[−n*m*t]} = | . . . + |
| a{1−exp[−m*t]} + | |
| a{exp[−m*t]−exp[−2*m*t]} + | |
| a{exp[−2*m*t]−exp[−3*m*t]} | |
| . . . + | |
| a{exp[−(n−1)*m*t]−exp[−n*m*t]} = | |
| a{1−exp[−mt]} | . . . <2−1> + |
| a{exp[−m*(2t−t)]−exp[−m*2t]} | . . . <2-2> + |
| a{exp[−m*(3t−t)]−exp[−m*3t]} | . . . <2-3> |
| . . . + | |
| a{exp[−m*(nt−t)]−exp[−m*nt]} | . . . <2-n> |

Since the above-mentioned formulas are developed as described above, the formula <1> coincides with <2-1>+<2-2>+<2-3>+ . . . +<2-n>.

Formula <2-n>: equal to the temperature of the object at time nt when heating is performed from time 0 to time nt, and the heat source is kept OFF from time t to time nt Formula <2-3>: equal to the temperature of the object at time nt when heating is performed from time (n−3)t to time (n−2)t, and the heat source is kept OFF from time (n−2)t to time nt Formula <2-2>: equal to the temperature of the object at time nt when heating is performed from time (n−2)t to time (n−1)t, and the heat source is kept OFF from time (n−)t to time nt Formula <2-1>: equal to the temperature of the object at time nt when heating is performed from time (n−1)t to time nt The fact that the total of the above formulas are equal to the formula <1> has the following meaning. That is, a change in temperature (increase in temperature) of the object 1 is calculated by obtaining a decreased temperature after an elapse of unit time from a temperature increased by energy supplied in unit time (corresponding to each of the formulas <2-1>, <2-2>, . . . , <2-n>), and a total sum of decreased temperatures at the present time from temperatures increased in respective past unit times is calculated to presume the current temperature of the object 1 (<2-1>+<2-2>+ . . . +<2-n>).

Figure 28:
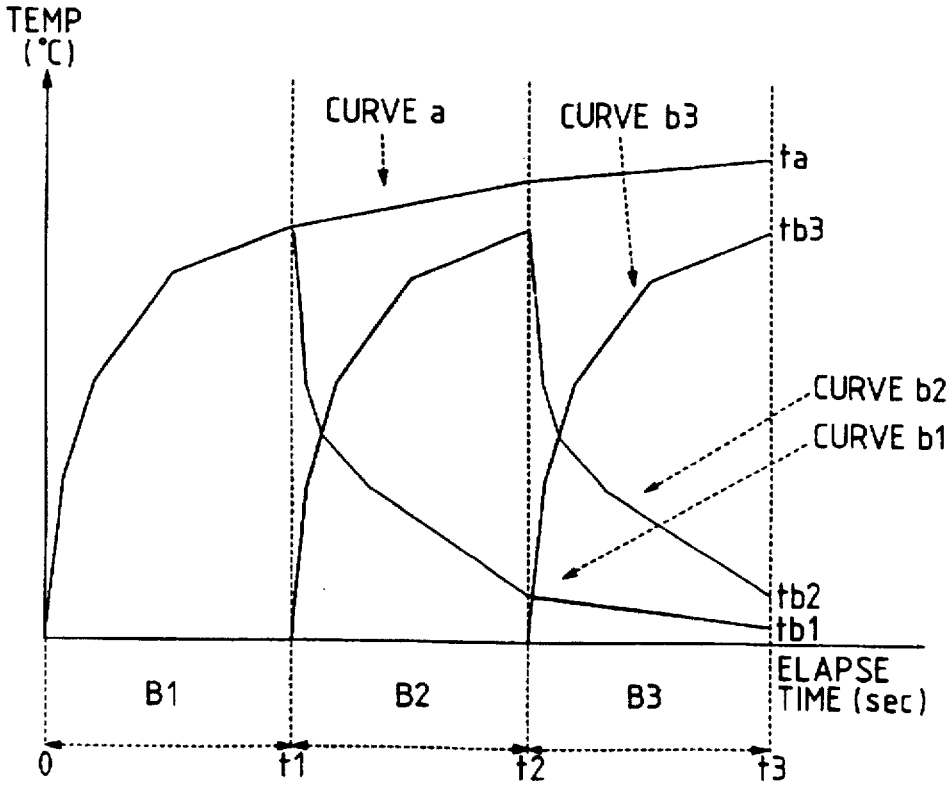
FIG. 28 is a graph for explaining a temperature calculation of the present invention.

An example will be described with reference to FIG. 28. In FIG. 28,

Abscissa: elapsed time

Ordinate: increased temperature

Curve a: temperature increase curve obtained when the heat source 2 is driven at a duty [X%] from time 0 to t3

Curve b1: temperature increase/decrease curve obtained when the heat source 2 is driven at the duty [X%] from time 0 to t1, and thereafter, the driving operation is stopped Curve b2: temperature increase/decrease curve obtained when the heat source 2 is driven at the duty [X%] from time t1 to t2, and thereafter, the driving operation is stopped Curve b3: temperature increase curve obtained when the heat source 2 is driven at the duty [X%] from time t2 to t3

In this algorithm, a temperature [ta] at time t3 obtained when the heat source 2 is continuously driven is calculated by [ta=tb1+tb2+tb3]. More specifically, increased/decreased temperatures at the present time from the temperatures increased by energy supplied in unit time are obtained (tb1, tb2, and tb3), and a total sum of these temperature is calculated, thus presuming (calculating) the current temperature.

In this embodiment, as shown in FIG. 29, a matrix obtained in advance by calculating changes in temperature, i.e., increases/decreases in temperature of the object 1 within a range of the thermal time constant of the object 1 and possible input energy is set as a table, thereby greatly decreasing the calculation time. In this embodiment, the print duty is set at 2.5% intervals, and the unit time (temperature presumption interval) is set to be 0.1 sec. The duty indicates the ratio of an ON time of the head source 2 to the unit time (0.1 sec in this embodiment). In the object used in this embodiment, since a temperature increased in unit time is decreased to almost 0° C. after an elapse of 1.5 sec, the table showing a decrease in temperature after an elapse of 1.6 sec is not provided. However, in the case of an object having a thermal time constant indicating a low thermal conductivity, a table until the increased temperature is decreased to 0° C., and its influence is eliminated is provided.

Control for presuming the temperature of the recording head using the temperature presumption calculation method of the present invention will be described below with reference to the table of FIG. 30 and the flow chart of FIG. 31.

Figure 31:
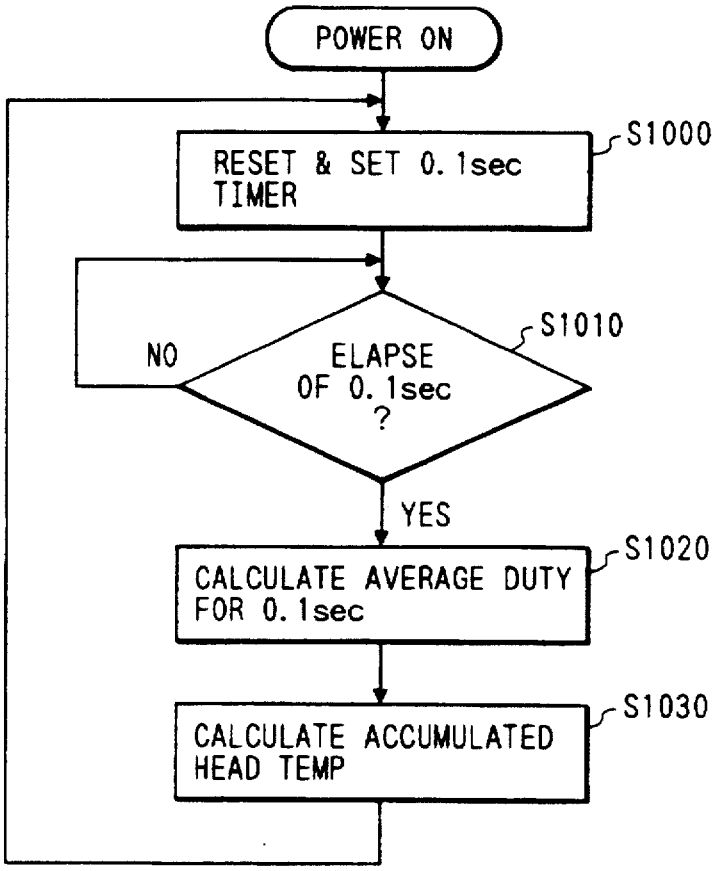
FIG. 31 is a flow chart for presuming the head temperature according to the 19th embodiment.

When a calculation is started, a [0.1 sec timer] is set/reset in step S1000 in FIG. 31. At the same time, the heat source ON duty for 0.1 sec is kept monitored. In this embodiment, the average duty for 0.1 sec is calculated from a value obtained by dividing the ON time of the heat source 2 by 0.1 sec, as described above (S1010 and S1020). The current temperature of the object (recording head) is calculated by accumulating data on the basis of duty data (15 data) for last 1.5 sec at 0.1-sec intervals, and the pre-set head temperature increase/decrease table (FIG. 29) in units of duties (S1030). The flow returns to step S1000 again to reset/set the 0.1 sec timer, thus counting the number of print dots for 0.1 sec.

The temperature accumulation calculation in step S1030 will be described below with reference to FIG. 30. FIG. 30 shows a case wherein the duty (%) changes like 100, 100, 95, and 0 at 0.1-sec intervals.

In FIG. 30(*a*) showing a state of an elapsed time=0.1 sec, since the duty is 100%, 15 table values at 0.1-sec intervals in the column of duty=100 in FIG. 29 are set in memories M1 to M15. At this time, the value of the memory M1 indicates the temperature of the object at that time, and the values in memories M2 to M15 indicate temperatures of the object at 0.1-sec intervals. In FIG. 30(*b*) showing a state of an elapse time=0.2 sec, the values in the memories M1 to M15 are shifted to the left to set the temperatures of the object at this time to be obtained by the previously supplied energy. In addition, since the duty is 100%, the same table values as in FIG. 30(*a*) are added to the values in the memories M1 to M15. At this time, the value of the memory M1 indicates the temperature of the object at that time, and the values in memories M2 to M15 indicate temperatures of the object at 0.1-sec intervals.

In FIG. 30(*c*) showing a state of an elapsed time=0.3 sec, the values in the memories M1 to M15 are shifted to the left, and table values corresponding to duty=95 in FIG. 29 are added to the values in the memories M1 to M15. In FIG. 30(*d*) showing a state of an elapsed time=0.4 sec, the values in the memories M1 to M15 are shifted to the left, and table values corresponding to duty=0 in FIG. 29 are added to the values in the memories M1 to M15. At this time, the value of the memory M1 indicates the temperature of the object at that time, and the values in memories M2 to M15 indicate temperatures of the object at 0.1-sec intervals.

As described above, in a system for applying heat energy to an object, the temperature is calculated as follows:

(1) a change in temperature of the object is processed as a sum of discrete values per unit time;

(2) a temperature drift (change) of the object according to each discrete value is calculated in advance within a range of possible input energy to form a table; and (3) the table is constituted by a two-dimensional matrix of supplied energy per unit time and elapse time.

Therefore, the following effects can be expected.

1. The problem of the response time can be solved.

2. A measurement error of a temperature sensor due to, e.g., electrical noise, which is very difficult to be perfectly removed, can be eliminated.

3. The problem of a direct/indirect increase in cost due to the arrangement of a temperature sensor can be eliminated.

In this embodiment, no temperature sensor is required, and a change in temperature of an object in the future can be predicted as long as energy to be supplied to the object in the future is known. For this reason, various control operations can be performed before energy is actually applied, and more proper control can be realized. In this algorithm, the temperature calculation can be performed only by looking up the table formed by calculating a change in temperature in advance, and by adding data, resulting in easy calculation control.

(20th Embodiment)

An embodiment wherein the temperature calculation algorithm of the present invention is applied to an ink jet recording apparatus will be described below.

The arrangement of this embodiment is the same as that shown in FIGS. 1 to 3 and FIG. 16. The 20th embodiment will be described in detail below with reference to the accompanying drawings.

(Overall Control)

In this embodiment, upon execution of recording by ejecting ink droplets from a recording head, a surrounding temperature sensor for measuring the surrounding temperature is provided to the main body side, and a change in temperature of the recording head with respect to the surrounding temperature from the past to the present and future is presumed by the above-mentioned calculation processing, thereby calculating the temperature of the recording head. Thus, optimal temperature control and ejection control can be performed without arranging a head temperature sensor having a correlation with the head temperature.

More specifically, the head is controlled by a divided pulse width modulation (PWM) driving method of heaters (sub-heaters) for increasing the head temperature, and ejection heaters on the basis of the head temperature calculated by the temperature calculation algorithm of the present invention. As one driving method of this control, when a difference from a temperature control target value is large, the head temperature is increased near the target value using the sub-heaters, and the remaining temperature difference is controlled by PWM ejection quantity control, so that a constant ejection quantity can be obtained. When the PWM control as an ejection quantity control means for a quick response head is used, a response delay time in temperature detection due to the position of a temperature sensor of the head or a detection error due to, e.g., noise can be prevented since calculation processing is performed, and control that maximally utilizes this merit can be performed. Since the PWM control in one line can be performed without arranging the temperature sensor to the head, as described above, density nonuniformity in one line or in one page can also be eliminated.

(Temperature Calculation Control)

Briefly speaking, a change in temperature of the head is calculated by estimating it using a matrix calculated in advance within a range of the thermal time constant of the head and possible input energy. A detailed means for calculating and presuming a change in temperature of the recording head uses the thermal conduction formula (1) in heating, and uses the thermal conduction formula (2) in cooling started during heating.

In order to facilitate the calculation processing, like in the 19th embodiment, the formulas are developed to the formulas <2-1>, <2-2>, <2-3>, . . . . <2-n>, as described above. More specifically, a change in temperature (increase in temperature) of the head is calculated by obtaining a decreased temperature after an elapse of unit time from a head temperature increased by energy supplied in unit time (corresponding to each of the formulas <2-1>, <2-2>, . . . . <2-n>), and a total sum of decreased temperatures at the present time from temperatures increased in respective past unit times is calculated to presume the current head temperature (<2-1>+<2-2>+ . . . +<2-n>). The calculation time of a change in head temperature, i.e., an increase/decrease in head temperature can be greatly shortened like in the 19th embodiment since a matrix calculated in advance within a range of the thermal time constant of the head and possible input energy is set as a table. In this embodiment, the print duty is set at 2.5% intervals, and the unit time (temperature presumption interval) is set to be 0.1 sec as shown in FIG. 32.

In the head used in this embodiment, since a temperature increased in unit time is decreased to almost 0° C. after an elapse of 60.0 sec, no temperature decrease table after an elapse of 60.1 sec is not prepared. However, in the case of a head having a thermal time constant indicating a low thermal conductivity, a table until the increased temperature is decreased to 0° C., and its influence is eliminated is preferably prepared. Ejection quantity control is performed by the above-mentioned PWM control.

In the ink jet recording apparatus for applying heat energy to the head as described above, in addition to the 19th embodiment,

- since the head is controlled by the divided pulse width modulation (PWM) driving method of heaters (sub-heaters) for increasing the head temperature, and ejection heaters on the basis of the head temperature calculated by the temperature calculation algorithm,
- the head temperature can be controlled, and stabilization of ejection, and ejection quantity control can be attained. Ejection control in one line such as PWM control can be performed, and density nonuniformity in one line or one page can be eliminated.

Furthermore, in this embodiment, no temperature sensor is required, and a change in temperature of an object in the future can be predicted as long as energy to be supplied to the head in the future is known. For this reason, various control operations can be performed before energy is actually applied, and more proper control can be realized.

In this embodiment, the time base of the table formed by calculating in advance a change in temperature corresponds to an arithmetic progression, but need not always correspond to the arithmetic progression. More specifically, in order to save a memory capacity for the table, the time base of the calculation table may be roughly set for a region where a change in temperature is small, and increased/decreased temperature data in unit time may be calculated and presumed from adjacent data.

(21st Embodiment)

Figure 33:
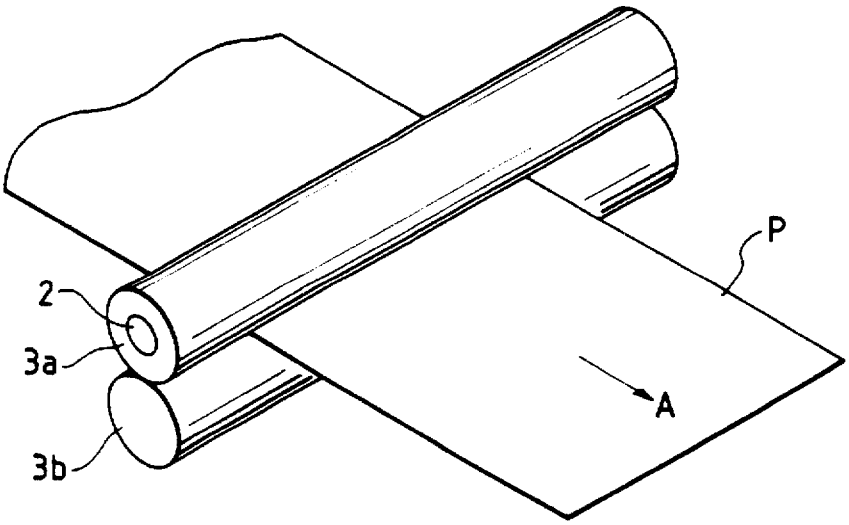
FIG. 33 is a perspective view showing an arrangement of the 21st embodiment.

An embodiment wherein the temperature calculation algorithm of the present invention is applied to a copying machine will be described below. FIG. 33 is a perspective view of thermal fixing rollers of a copying machine which can suitably embody or adopt the present invention. In FIG. 33, a heat source 2 applies heat energy to an upper fixing roller 3*a*, and a lower fixing roller 3*b* is paired with the upper fixing roller. A recording medium P is conveyed in a direction of an arrow in FIG. 33.

In the copying machine, an electrostatic latent image according to an original image is formed on a transfer drum (not shown). A toner as a recording agent is attracted to the electrostatic latent image, and the toner on the transfer drum is transferred onto the recording medium. Thereafter, the recording medium on which a non-fixed toner image is formed passes between the thermal fixing rollers, thus completing the fixing process. The recording medium is then discharged outside the copying machine. More specifically, when the recording medium passes between the thermal fixing rollers, the toner is melted by heat of the thermal fixing rollers, and when the molten toner is pressed, it is fixed on the recording medium.

In the copying machine, in order to reliably fix the toner as the recording agent on the recording medium, the temperature control of the thermal fixing rollers is an important factor. Therefore, in general, a temperature sensor is arranged in the surface layer of the fixing roller, and the heat source is ON/OFF-controlled according to the detection value from the temperature sensor. When the temperature control is performed using the temperature sensor in the fixing device of the copying machine, the above-mentioned influence is a matter of concern.

In this embodiment, a change in temperature of the thermal fixing rollers is calculated by the temperature calculation algorithm of the present invention, and temperature control is performed according to the calculated value, thus preventing occurrence of the above-mentioned influence.

(Temperature Calculation Control)

The temperature calculation control of this embodiment is substantially the same as that in the 19th and 20th embodiments, and a change in temperature of the fixing rollers is calculated by evaluating it using a matrix calculated in advance within a range of the thermal time constant of the fixing rollers and input possible energy.

A detailed means for calculating and presuming a change in temperature of the fixing rollers uses the thermal conduction formulas like in the 19th and 20th embodiments. In order to facilitate the calculation processing, the formulas are developed like in the 19th and 20th embodiments. A change in temperature (increase in temperature) of the fixing rollers is calculated by obtaining a decreased temperature after an elapse of unit time from a fixing roller temperature increased by energy supplied in unit time, and a total sum of decreased temperatures at the present time from temperatures increased in respective past unit times is calculated as the current fixing roller temperature.

The calculation time of a change in temperature, i.e., an increase/decrease in temperature of the fixing rollers can be greatly shortened since a matrix calculated in advance within a range of the thermal time constant of the fixing rollers and possible input energy is set as a table. In this embodiment, as shown in FIG. 34, the driving duty of the fixing rollers is set at 5% intervals, and the unit time (temperature presumption interval) is set to be 5 sec.

In the fixing rollers used in this embodiment, when 60.0 sec have elapsed, the temperature increased in unit time is decreased to about 0° C. For this reason, a temperature decrease table after an elapse of 65 sec is not prepared. In the case of fixing rollers having a thermal time constant indicating a low thermal conductivity, a table having values coping with a decrease in increased temperature to 0° C. and its influence is preferably prepared.

In the method of controlling the temperature of the thermal fixing rollers in this embodiment, an upper limit temperature (U) and a lower limit temperature (L) are set in advance, and when the temperature of the thermal fixing rollers falls outside the set temperature range, the ON/OFF control of the heat source 2 is performed.

As described above, in the copying machine for applying heat energy to the thermal fixing rollers, in addition to the 19th embodiment, when the heat source for increasing the temperature of the thermal fixing rollers is controlled according to the temperature of the thermal fixing rollers calculated by the temperature calculation algorithm, the temperature of the thermal fixing rollers can be adequately controlled, and reliability of the fixing characteristics can be improved.

In this embodiment, like in the 19th and 20th embodiments, the time base of the calculation table corresponds to an arithmetic progression, but need not always correspond to the arithmetic progression. More specifically, in order to save a memory capacity for the table, the time base of the calculation table may be roughly set for a region where a change in temperature is small, and increased/decreased temperature data in unit time may be calculated and presumed from adjacent data. The temperature increase/decrease gradient of the fixing rollers may be multiplied with a proper correction value. For example, temperature increase/decrease data of the calculation table may be multiplied with a correction coefficient based on, e.g., passage of the recording medium as a factor.

Various control methods for controlling the heat source according to the temperature of the fixing rollers can be similarly applied to a case wherein the temperature calculation algorithm of the present invention. Since individual heat source control means is a known technique, a detailed description thereof will be omitted.

(22nd Embodiment)

The 22nd embodiment wherein the present invention is applied to a recording apparatus like in the 20th embodiment will be described below with reference to the accompanying drawings.

(Outline of Overall Control Flow)

As described above, in an ink jet recording apparatus, when the temperature of a recording head is controlled to fall within a predetermined region, ejection and the ejection quantity can be stabilized, and a high-quality image can be recorded. In order to realize stable high-quality image recording, a temperature calculation/detection means of the recording head, and an optimal driving control method according to the temperature will be briefly described below.

(1) Setting of Target Temperature

Head driving control for stabilizing the ejection quantity to be described below is made with reference to the chip temperature of the head. More specifically, the chip temperature of the head is used as substitute characteristics upon detection of the ejection quantity per dot ejected at that time. However, even whew the chip temperature is constant, since the ink temperature in a tank depends on the surrounding temperature, the ejection quantity varies. In order to eliminate this difference, a value that determines the chip temperature of the head for obtaining equal ejection quantities in units of surrounding temperatures (i.e., in units of ink temperatures) is a target temperature. The target temperature is set in advance as a target temperature table. FIG. 35 shows the target temperature table used in this embodiment.

(2) Calculation means of Recording Head Temperature

The recording head temperature is presumed and calculated from energy supplied previously. In a temperature calculation method, a change in temperature of the recording head is processed as the accumulation of discrete values per unit time. The changes in temperature of the recording head according to the discrete values are calculated in advance within a range of possible input energy so as to form a table. In this case, the table is constituted by a two-dimensional matrix (two-dimensional table) of input energy per unit time and an elapsed time.

In a temperature calculation algorithm means in this embodiment, the recording head constituted by combining members having a plurality of different heat conduction times is substituted with a smaller number of thermal time constants than that in practice to form a model, and calculations are individually performed while grouping required calculation intervals and required data hold times in units of models (thermal time constants). Furthermore, a plurality of heat sources are set, and temperature rise widths are calculated in units of models for each heat source. The calculated widths are added later to calculate the head temperature.

The reasons why the chip temperature is calculated and presumed from input energy in place of sensing it using a sensor are:

① the response time can be shortened by calculating and presuming the chip temperature as compared to the case using the sensor, a change in chip temperature can be quickly processed; and ② cost can be decreased.

The presumed head temperature serves as a reference for ejection driving and sub-heater driving in this embodiment.

(3) PWM control

When the head is driven at the chip temperature described in the target temperature table in the corresponding environment, the ejection quantity can be stabilized. However, the chip temperature varies from time to time according to, e.g., the print duty, and is not constant. For this reason, a means for driving the head in a multi-pulse PWM driving mode and controlling the ejection quantity independently of the temperature for the purpose of stabilizing the ejection quantity is PWM control. In this embodiment, a PWM table, which defines a pulse having an optimal waveform and width at that time according to a difference between the head temperature and the target temperature in the corresponding environment, is set in advance, thereby determining an ejection driving condition.

(4) Sub-heater Driving Control

Control for driving sub-heaters immediately before printing to approach the head temperature to the target temperature when a desired ejection quantity cannot be obtained even by PWM driving is sub-heater control. An optimal sub-heater driving time at that time is set in advance according to a difference between the head temperature and the target temperature in the corresponding environment, thereby determining a sub-heater driving condition.

Principal control operations of this embodiment will be individually described below.

(Temperature Prediction Control)

Briefly speaking, a change in head temperature is calculated by estimating it using a matrix calculated in advance within a range of the thermal time constant of the head and possible input energy. The detailed means for calculating and presuming a change in temperature of the recording head uses the above-mentioned heat conduction formula (1) in heating, and uses the above-mentioned heat conduction formula (2) in cooling started during heating like in the 20th embodiment.

When the recording head is processed as a lumped constant system, the chip temperature of the recording head can be theoretically presumed by calculating the formulas (1) and (2) according to the print duty in correspondence with a plurality of thermal time constants.

However, in general, it is difficult to perform the above-mentioned calculations without modifications in terms of a problem of the processing speed.

Strictly speaking, all the constituting members have different time constants, and another time constant is formed between adjacent members, resulting in a huge number of times of calculations.

In general, since an MPU cannot directly perform exponential calculations, approximate calculations must be performed, or calculations using a conversion table must be performed, thus disturbing a decrease in calculation time.

This embodiment solves the above-mentioned problems by the following modeling and calculation algorithm.

(1) Modeling

Figure 36:
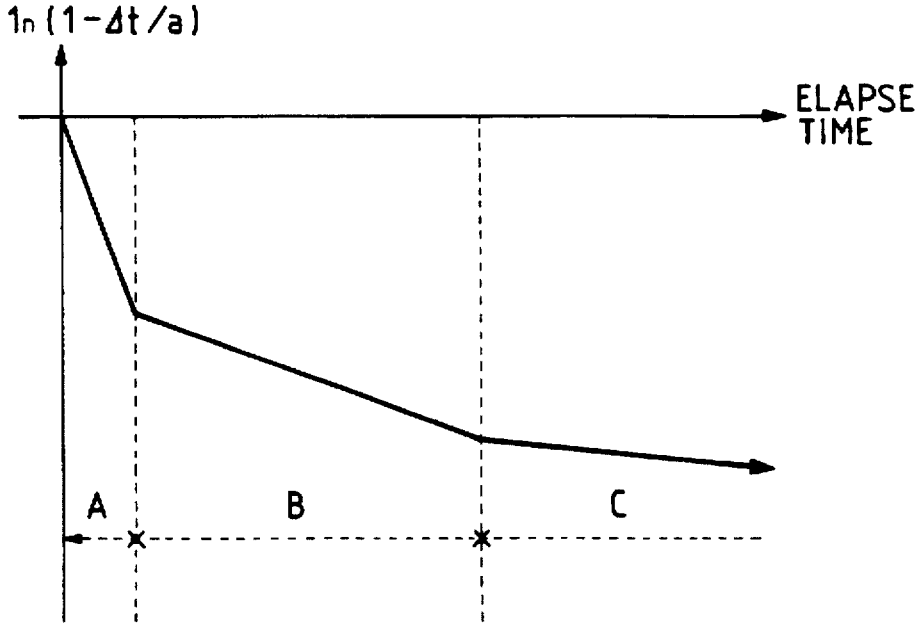
FIG. 36 is a graph showing a temperature rise process of a recording head in the 22nd embodiment.

The present inventors sampled data in the temperature rise process of the recording head by applying energy to the recording head with the above arrangement, and obtained the result shown in FIG. 36. Strictly speaking, the recording head with the above arrangement is constituted by combining many members having different heat conduction times. However, FIG. 36 reveals that such many heat conduction times can be processed as a heat conduction time of a single member in practice in ranges where the differential value of the function of the log-converted increased temperature data and the elapsed time is constant (i.e., ranges A, B, and C having constant inclinations).

From the above-mentioned result, in a model associated with heat conduction, this embodiment processes the recording head using two thermal time constants. Note that the above-mentioned result indicates that feedback control can be more precisely performed upon modeling having three thermal time constants. However, in this embodiment, it is determined that the inclinations in areas B and C in FIG. 36 are almost equal to each other, and the recording head is modeled using two thermal time constants in consideration of calculation efficiency. More specifically, one heat condition is a model having a time constant at which the temperature is increased to the equilibrium temperature in 0.8 sec (corresponding to the area A in FIG. 36), and the other heat conduction is given by a model having a time constant at which the temperature is increased to the equilibrium temperature in 512 sec (i.e., a model of the areas B and C in FIG. 36).

Furthermore, this embodiment processes the recording head as follows to obtain a model.

The temperature distribution in heat conduction is assumed to be ignored, and the entire recording head is processed as a lumped constant system.

The heat source assumed to include two heat sources, i.e., a heat source for the print operation, and a heat source as sub-heaters.

Figure 37:
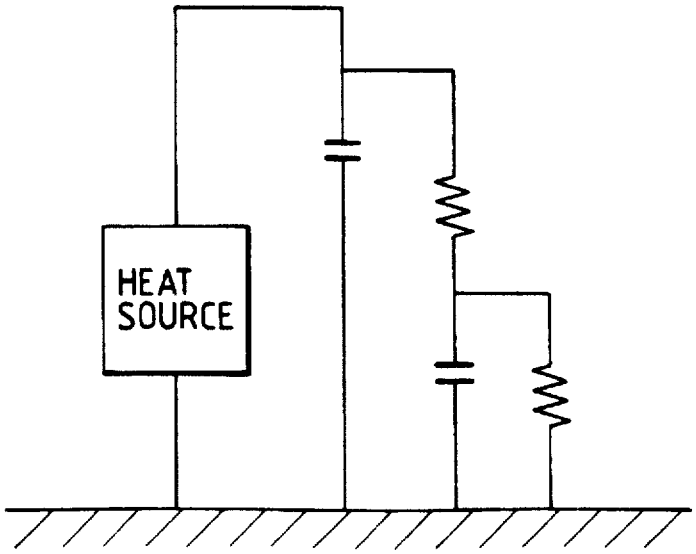
FIG. 37 is an equivalent circuit diagram of a heat conduction model in the 22nd embodiment.

FIG. 37 shows a heat conduction equivalent circuit modeled in this embodiment. FIG. 37 illustrates only one heat source. However, when two heat sources are used, they may be connected in series with each other.

(2) Calculation Algorithm

In the head temperature calculations of this embodiment, the above-mentioned formulas are developed to formulas <2-1>, <2-2>, <2-3>, . . . , <2-n> like in the 20th embodiment so as to facilitate the calculation processing. More specifically, a change in head temperature (increase in temperature) is obtained by calculating a decreased temperature after an elapse of unit time from the head temperature increased by energy supplied in unit time (corresponding to each of the formulas <2-1>, <2-2>, . . . , <2-n>), and a total sum of decreased temperatures at the present time from temperatures increased in respective past unit times is calculated to presume the current head temperature (<2-1>+<2-2>+ . . . +<2-n>).

In this embodiment, the chip temperature of the recording head is calculated (heat source 2*thermal time constant 2) four times based on the above-mentioned modeling. The required calculation times and data hold times for the four calculations are as shown in FIG. 38. FIGS. 39 to 42 show calculation tables used for calculating the head temperature, and each comprising a two-dimensional matrix of input energy and elapsed time. FIG. 39 shows a calculation table when ejection heaters are used as heat source, and a member group having a short-range time constant is used; FIG. 40 shows a calculation table when ejection heaters are used as the heat source, and a member group having a long-range time constant is used; FIG. 41 shows a calculation table when sub-heaters are used as the heat source, and a member group having a short-range time constant is used; and FIG. 42 shows a calculation table when sub-heaters are used as the heat source, and a member group having a long-range time constant is used.

As shown in FIGS. 39 to 42, calculations are performed at 0.05-sec intervals to obtain:

(1) an increase (in degrees) in temperature of a member having a time constant represented by the short range upon driving of the ejection heaters (ΔTmh);

(2) an increase (in degrees) in temperature of a member having a time constant represented by the short range upon driving of the sub-heaters (ΔTsh);

calculations are performed at 1.0-sec intervals to obtain:

(3) an increase (in degrees) in temperature of a member having a time constant represented by the long range upon driving of the ejection heaters (ΔTmb); and (4) an increase (in degrees) in temperature of a member having a time constant represented by the long range upon driving of the sub-heaters (ΔTsb).

The above-mentioned calculations are sequentially performed, and ΔTmh, ΔTsh, ΔTmb, and ΔTsb are added to each other (=ΔTmh+ΔTsh+ΔTmb+ΔTsb), thus calculating the head temperature at that time.

As described above, since the recording head constituted by combining a plurality of members having different heat conduction times is modeled to be substituted with a smaller number of thermal time constants than that in practice, the following effects can be obtained.

As compared to a case wherein calculation processing is faithfully performed in units of all the members having different heat conduction times, and in units of thermal time constants between adjacent members, the calculation processing volume can be greatly decreased without impairing calculation precision so much.

Since the head is modeled with reference to time constants, calculation processing can be performed in a small number of processing operations without impairing calculation precision. For example, in the above-mentioned case, when the head is not modeled in units of time constants, the calculation interval requires 50 msec since it is determined by the area A having a small time constant. On the other hand, the data hold time of discrete data requires 512 sec since it is determined by the areas B and C having a large time constant. More specifically, accumulation calculation processing of 10,240 data for last 512 sec must be performed at 50-msec intervals, resulting in the number of calculation processing operations several hundreds of times that of this embodiment.

As described above, in addition to the temperature calculation algorithm in the 20th embodiment, in this embodiment, the recording head constituted by combining a plurality of members having different heat conduction times is modeled to be substituted with a smaller number of thermal time constants than that in practice, and calculations are individually performed while grouping required calculation intervals and required data hold times in units of model units (thermal time constants). Furthermore, a plurality of heat sources are set, temperature rise widths are calculated in units of model units for each heat source, and the calculated widths are added later to calculate the head temperature (plural heat source calculation algorithm). Thus, a change in temperature of the recording head can be processed by calculations even in a low-cost recording apparatus without arranging a temperature sensor in the recording head.

Moreover, the above-mentioned PWM driving control and sub-heater control for controlling the temperature of the recording head within a predetermined range can be properly performed, and ejection and the ejection quantity can be stabilized, thus allowing recording of a high-quality image.

Figure 43A:
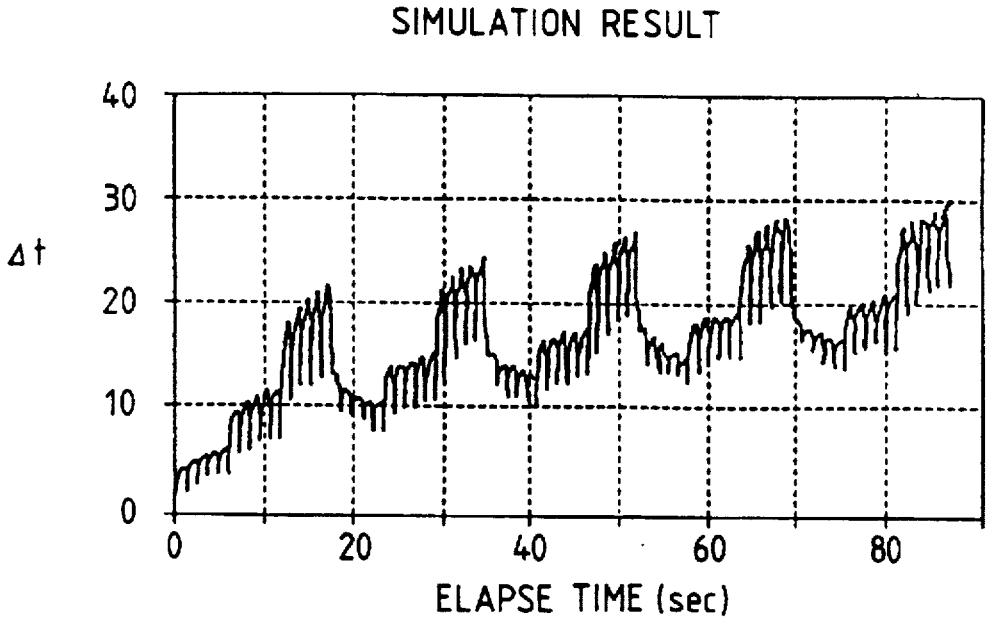
FIGS. 43A and 43B are graphs for comparing the recording head temperature presumed by a head temperature calculation means of the 22nd embodiment, and the actually measured recording head temperature.
Figure 43B:
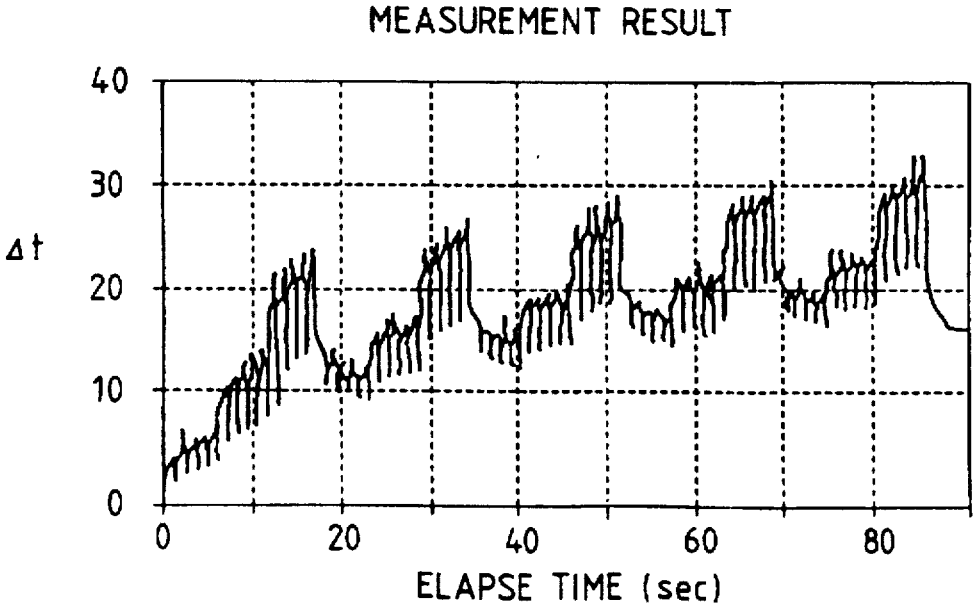

FIGS. 43A and 43B compare the recording head temperature presumed by the head temperature calculation method described in this embodiment, and the actually measured recording head temperature using the recording head with the above-mentioned arrangement. In FIGS. 43A and 43B, abscissa: elapsed time (sec)

ordinate: increased temperature (Δt)

print pattern; (25% duty*5 lines+50% duty*5 lines+100% duty*5 lines)*5 times (a total of 75 lines printed)

FIG. 43A; change in recording head temperature presumed by the head temperature calculation means FIG. 43B; actually measured change in recording head temperature As can be seen from FIGS. 43A and 43B, the head temperature can be precisely presumed by the temperature calculation method of this embodiment.

(PWM Control)

In this embodiment, double-pulse PWM control is performed like in the 20th embodiment. However, other multi-pulse PWM control methods such as triple-pulse PWM control may be employed, or a main pulse PWM driving method for modulating a main pulse width by a single pulse may be employed.

In this embodiment, control is made to uniquely set a PWM value based on a temperature difference (ΔT) between the target temperature (FIG. 35) and the head temperature. FIG. 44 shows the relationship between ΔT and the PWM value. In FIG. 44, "temperature difference", represents ΔT, "pre-heat" represents $P_1$, "interval" represents $P_2$, and "main" represents $P_3$. Also, "set-up time", indicates a time from when a recording command is input until the pulse $P_1$ is actually raised. This time is mainly determined by a margin time until the driver is enabled, and is not a principal value in the present invention. In addition, "weight" represents the weighting coefficient to be multiplied with the number of print dots, which is detected for calculating the head temperature. Even when the number of print dots remains the same, an increase in head temperature varies depending on a pulse width, e.g., between a case wherein the print operation is performed to have a pulse width of 7 μs and a case wherein the print operation is performed to have a pulse width of 4.5 μs. As a means for correcting a difference in the increase in temperature due to PWM control depending on the selected PWM table, the "weight" is used.

(Sub-heater Driving Control)

Figure 45:
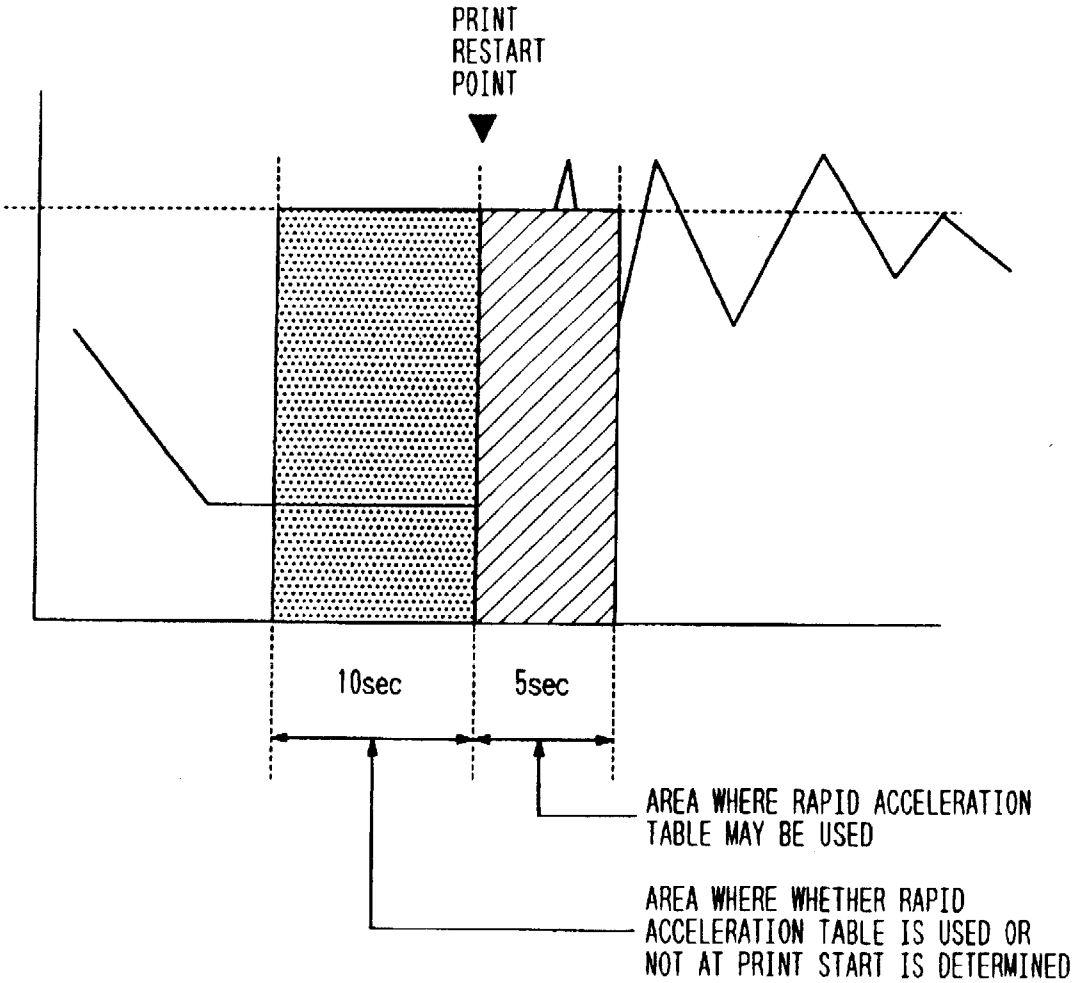
FIG. 45 is a graph for explaining sub-heater driving control.

When an actual ejection quantity is below a reference ejection quantity even after the PWM driving means is executed, the sub-heater driving control is performed immediately before the print operation, so that the ejection quantity becomes equal to the reference ejection quantity. The sub-heater driving time is set from a sub-heater table according to a difference (Δt) between the target temperature and the actual head temperature. Two sub-heater tables, i.e., "rapid acceleration sub-heater table" and "normal sub-heater table", are prepared, and are selectively used according to the following conditions (see FIG. 45).

[When print operation is restarted from non-print state]

When 10 sec or more have elapsed from the end of the previous print operation, the "rapid acceleration sub-heater table" is used. Before an elapse of 10 sec, the "normal sub-heater table" is used.

[When continuous print operation is performed]

When 5 sec or more have elapsed after the print operation is restarted from the non-print state, the "normal sub-heater table" is used. Before an elapse of 5 sec, the table used at the beginning of the print operation is used. More specifically, when the rapid, acceleration sub-heater table is used, the "rapid acceleration sub-heater table" is used; when the normal sub-heater table is used, the "normal sub-heater table" is used.

The reason why the two tables are selectively used, and the rapid acceleration sub-heater table is used is as follows. That is, since the ejection control means using the sub-heaters is a means for controlling the ejection quantity by increasing the head temperature, a temperature rise operation requires much time. When the required temperature rise operation is not completed within the ramp-up time of the carriage, the start of the print operation must be delayed until the temperature rise operation is completed, thus decreasing the throughput.

FIG. 46 shows details of the sub-heater driving conditions. In FIG. 46, "temperature difference" represents the difference (Δt) between the target temperature and the actual head temperature, "LONG" represents the rapid acceleration sub-heater table, and "SHORT" represents the normal sub-heater table.

(Overall Flow Control)

The flow of the overall control system will be described below with reference to FIGS. 47 and 48.

Figure 47:
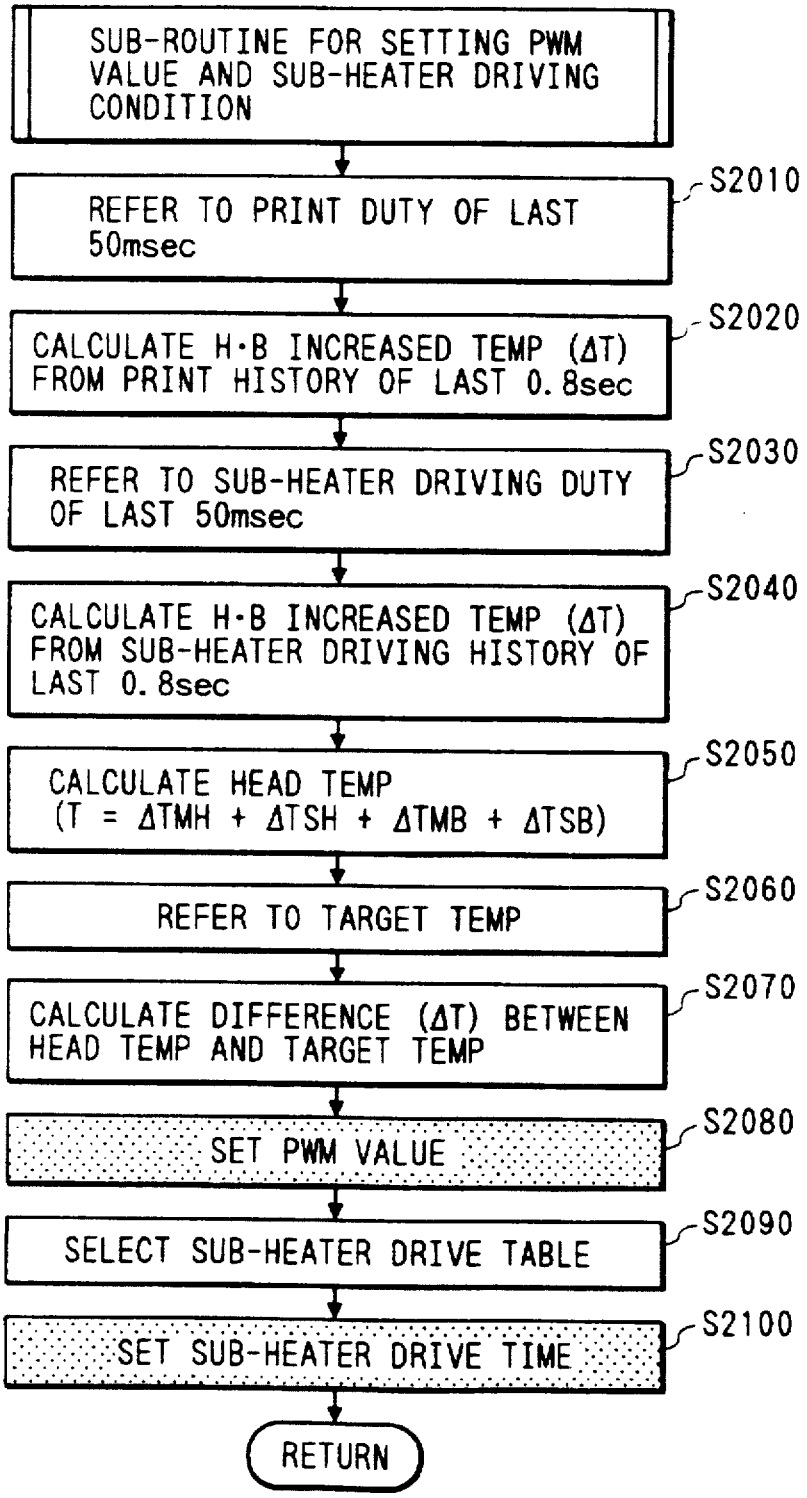
FIG. 47 is a flow chart showing an interrupt routine for setting a PWM driving value and a sub-heater driving time.

FIG. 47 shows an interrupt routine for setting a PWM driving value for ejection, and a sub-heater driving time. This interrupt routine is called at 50-msec intervals. Therefore, the PWM value and the sub-heater driving time are updated at every 50 msec regardless of a print or non-print state, or an environment requiring or not requiring the driving operation of the sub-heaters.

When the interrupt routine is called at a 50-msec interval, the print duty for last 50 msec is referred to (S2010). The print duty to be referred to at this time is a value obtained by multiplying the number of actually ejected dots with a weighting coefficient in units of PWM values, as has been described above in the paragraph of (PWM Control). The increased temperature (ΔTmh) of a member group when the ejection heaters are used as a heat source and the short-range time constant is used is calculated based on the print duty for last 50 msec, and the print history for last 0.8 sec (S2020). Similarly, the driving duty of the sub-heaters for last 50 msec is referred to (S2030), and the increased temperature (ΔTsh) of a member group when the sub-heaters are used as a heat source and the short-range time constant is used is calculated based on the driving duty of the sub-heaters for last 50 msec, and the print history for last 0.8 sec (S2040). Then, the increased temperature (ΔTmb) of a member group when the ejection heaters are used as a heat source and the long-range time constant is used, and the increased temperature (ΔTsb) of a member group when the sub-heaters are used as a heat source and the long-range time constant is used, which temperatures have been calculated in the main routine (to be described later), are referred to, and the above-mentioned temperatures are added to each other (=ΔTmh+ΔTsh+ΔTmb+ΔTsb), thus calculating the head temperature (S2050).

The target temperature is set from the target temperature table (S2060), and the temperature difference (ΔT) between the head temperature and the target temperature is calculated (S2070). A PWM value as the optimal head driving condition according to ΔT is set based on the temperature difference ΔT and the PWM table (S2080). The sub-heater driving time (S2100) as the optimal head driving condition according to the temperature difference ΔT is set on the basis of the selected sub-heater table (S2090). Thus, the interrupt routine is ended.

Figure 48:
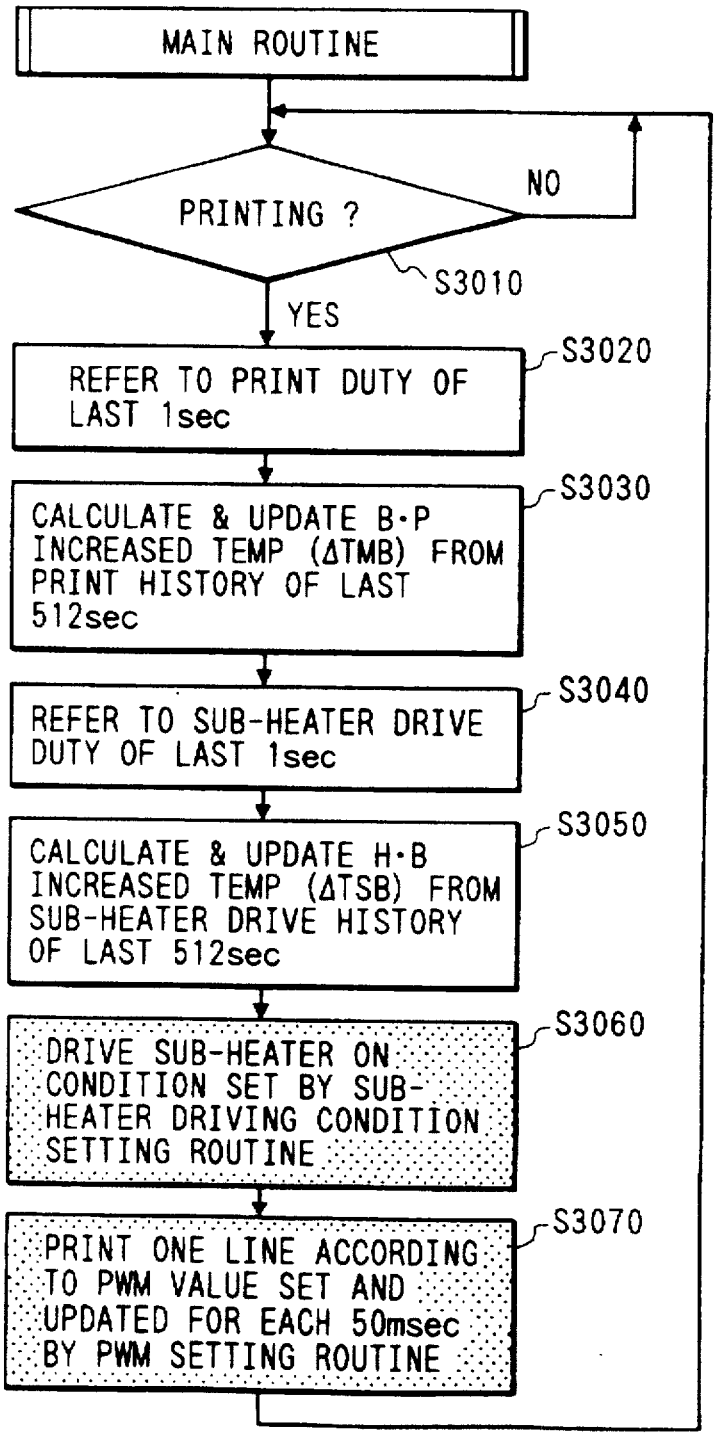
FIG. 48 is a flow chart showing a main routine.

FIG. 48 shows the main routine. When a print command is input in step S3010, the print duty for last 1 sec is referred to (S3020). In this case, the print duty to be referred to at this time is a value obtained by multiplying the number of actually ejected dots with a weighting coefficient in units of PWM values, as has been described above in the paragraph of (PWM Control). The increased temperature (ΔTmb) of a member group when the ejection heaters are used as a heat source and the long-range time constant is used is calculated based on the duty for the last 1 sec, and the print history for last 512 sec, and is stored and updated at a memory position, which is determined to be easily referred to in the interrupt routine called at 50-msec intervals (S3030). Similarly, the driving duty of the sub-heaters for last 1 sec is referred to (S3040), and the increased temperature (ΔTsb) of a member group when the sub-heaters are used as a heat source and the long-range time constant is used is calculated based on the driving duty of the sub-heaters for last 1 sec, and the driving history of the sub-heaters for last 512 sec. The temperature ΔTsb is stored and updated at a memory position, which is determined to be easily referred to in the interrupt routine called at each 50-msec interval, in the same manner as in a case wherein ΔTmb is stored and updated (S3050).

The sub-heaters are driven according to the PWM value and the sub-heater driving time, which are updated in the interrupt routine called at each 50-msec interval (S3060), and thereafter, the print operation for one line is performed (S3070).

In this embodiment, the double- and single-pulse PWM control methods for controlling the ejection quantity and the head temperature are used. Alternatively, PWM control using three or more pulses may be used. When the head chip temperature is higher than the print target temperature, and cannot be decreased by PWM control with small energy, the carriage scan speed may be decreased, or the carriage scan start timing may be controlled.

In this embodiment, since a future head temperature can be predicted without using a temperature sensor, various head control operations can be performed before an actual print operation, and recording can be more properly performed. Since the model of the recording head is simplified, and the calculation algorithm is realized by accumulating simple calculations, prediction control can also be facilitated. Constants such as temperature prediction cycles (50-msec intervals and 1-sec intervals) used in this embodiment are merely examples, and the present invention is not limited to these.

(23rd Embodiment)

A method for presuming the current temperature from a print ratio (to be referred to as a print duty hereinafter), and controlling a recovery sequence for stabilizing ejection in an ink jet recording apparatus will be described below. When the above-mentioned PWM control is not performed, the print duty is equal to the power ratio.

In this embodiment, the current head temperature is presumed from the print duty like in the 19th embodiment described above, and a suction condition is changed according to the presumed head temperature like in FIG. 21 (ninth embodiment) presented previously.

(24th Embodiment)

The current head temperature is presumed from the print duty like in the 23rd embodiment. However, in this embodiment, a pre-ejection condition is changed according to the presumed head temperature. This embodiment corresponds to the 10th embodiment.

When the head temperature is high, the ejection quantity is undesirably increased, and pre-ejection may be performed in an unnecessary quantity. In this case, control can be made to decrease the pre-ejection pulse width. FIG. 49 shows the relationship between the presumed head temperature and the pulse width. Since the ejection quantity is increased as the temperature becomes higher, the pulse width is decreased to suppress the ejection quantity.

Since variations in temperature among nozzles are increased as the temperature becomes higher, the distribution of the number of pre-ejection pulses must be optimized. FIG. 50 shows the relationship between the presumed head temperature and the number of pre-ejection pulses. Even at room temperature, the nozzle end portions and the central portions have different numbers of pre-ejection pulses, thus suppressing the influence caused by variations in temperature. Since the temperature difference between the end portion and the central portion is increased as the head temperature becomes higher, the difference between the number of pre-ejection pulses is also increased. In this manner, variations in temperature distribution among the nozzles can be suppressed, and efficient (required minimum) pre-ejections can be performed, thus allowing stable ejection.

Figures 51, 52:
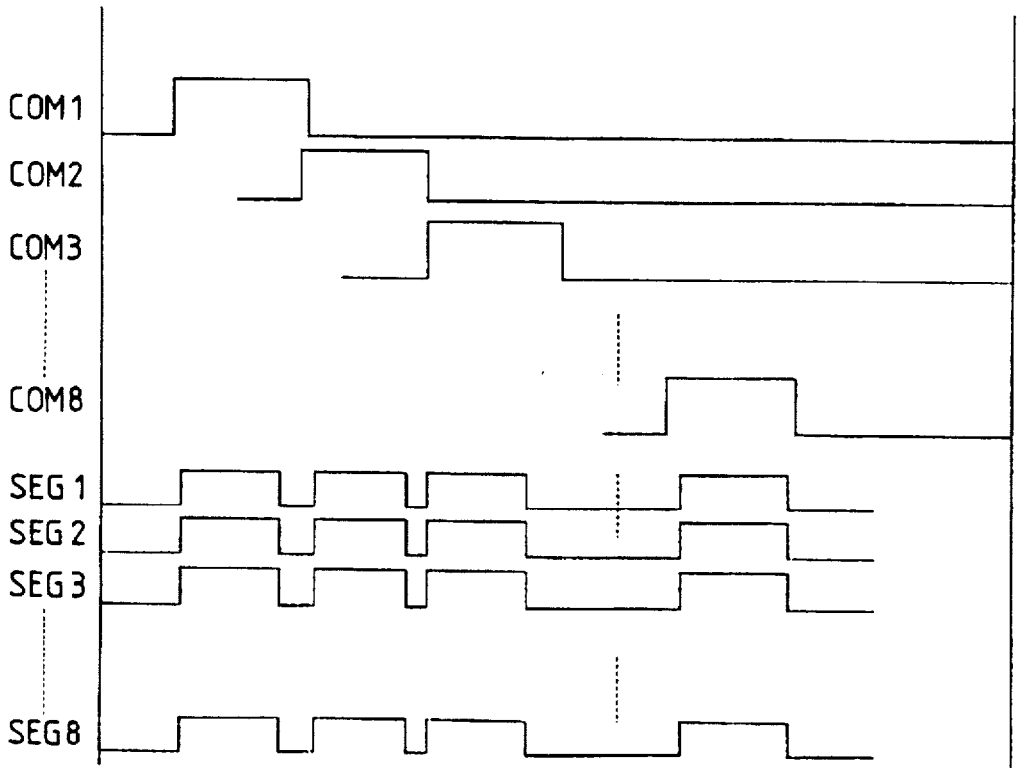
FIG. 51 is a temperature table when pre-ejection temperature tables are changed in units of ink colors.
FIG. 52 is a timing chart showing the relationship between common and segment signals in a minimum ejection driving period of this embodiment.

Furthermore,-when a plurality of heads are used, pre-ejection temperature tables may be changed in units of ink colors. FIG. 51 shows a temperature table. When the head temperature is high, since the viscosity of Bk (black) containing a larger amount of dye than Y (yellow), M (magenta), and C (cyan) tends to be increased, the number of pre-ejection pulses must be relatively increased. Since the ejection quantity is increased as the temperature becomes higher, the number of pre-ejection pulses is decreased.

(25th Embodiment)

In this embodiment, various recovery processing operations are performed according to the head temperature presumed like in the 19th embodiment, thus stabilizing ejection. The various recovery processing operations are the same as those in the 11th to 14th embodiments described previously, and a detailed description thereof will be omitted.

As described above, according to the present invention, since a change in temperature of an object with respect to input energy can be calculated and presumed without providing a temperature sensor to the object, the temperature of the object can be quickly and precisely obtained independently of the error, precision, and response performance of the temperature sensor.

Since a recording apparatus of the present invention comprises, as described above, a modeling means for modeling a recording head constituted by combining a plurality of members having different heat conduction times to be substituted with a smaller number of thermal time constants than that in practice, a calculation algorithm means for individually performing calculations while grouping required calculation intervals and required data hold times in units of models (thermal time constants), and a plural heat source calculation algorithm means for setting a plurality of heat sources, calculating temperature rise widths in units of models for each heat source, and then adding the calculated widths to calculate the head temperature, a change in temperature of the recording head can be processed by calculation processing even in a low-cost recording apparatus without providing a temperature sensor to the recording head. Furthermore, a recording apparatus, which can stabilize recording, e.g., the ejection quantity and ejection according to the precise and quick-response change in temperature of the recording head obtained by the above-mentioned calculations, can be provided.

(26th Embodiment)

The arrangement of this embodiment is the same as that shown in FIGS. 1 to 3 and FIG. 16. This embodiment will be described in detail below with reference to the accompanying drawings.

(Summary of Temperature Prediction)

In this embodiment, upon execution of recording by ejecting ink droplets from a recording head, a surrounding temperature sensor for measuring the surrounding temperature is provided to a main body side, and a change in temperature of an ink in an ejection unit from the past to the present is presumed by calculation processing of ejection energy of the ink, thereby stabilizing ejection according to the ink temperature. More specifically, in this embodiment, no temperature detection member for directly detecting the temperature of the recording head is used.

(27th Embodiment)

A PWM ejection quantity control method in which the number of ON pulses per ejection is 3 (three divided pulses; triple-pulse PWM) will be described below. The driving operation of the recording head is controlled by a multi-pulse PWM driving method using ejection heaters on the basis of the presumed ink temperature. In this embodiment, control is made to obtain a constant ejection quantity by PWM ejection quantity control (to be described below) based on the ink temperature.

(PWM Control)

The PWM ejection quantity control method of this embodiment will be described in detail below with reference to the accompanying drawings. FIG. 52 is a timing chart of common signals and segment signals in a head using a known diode matrix. The command signals are output eight times in turn in a minimum driving period of the recording head regardless of the content of print data, and during the ON period of each common signal, the segment signals whose ON/OFF intervals are determined according to a print signal are turned on. A current flows through the ejection heaters when the command and segment signals are simultaneously turned on. In this embodiment, ejection ON/OFF control of each of 64 nozzles can be performed. In this embodiment, the segment signals are controlled by multi-pulse PWM control based on interval time control, thus realizing ejection quantity control as well as ON/OFF control.

Figure 53A:
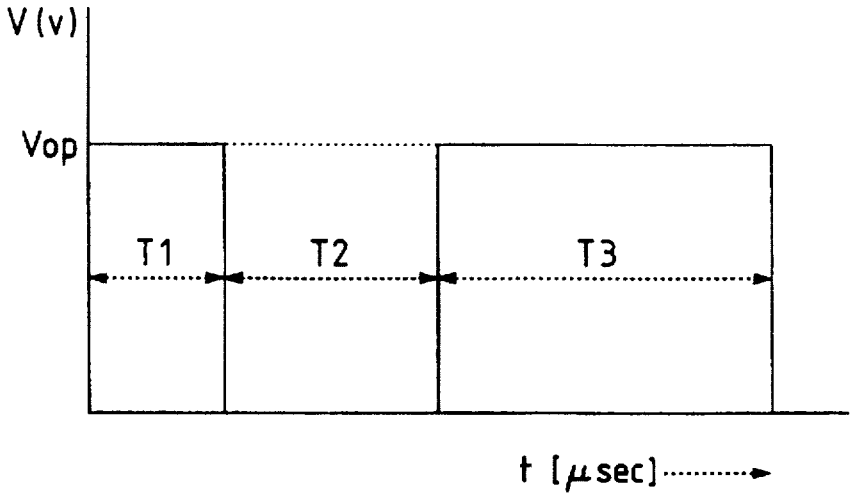
FIGS. 53A and 53B are explanatory views showing multi-pulse waveforms of the segment signal of this embodiment.
Figure 53B:
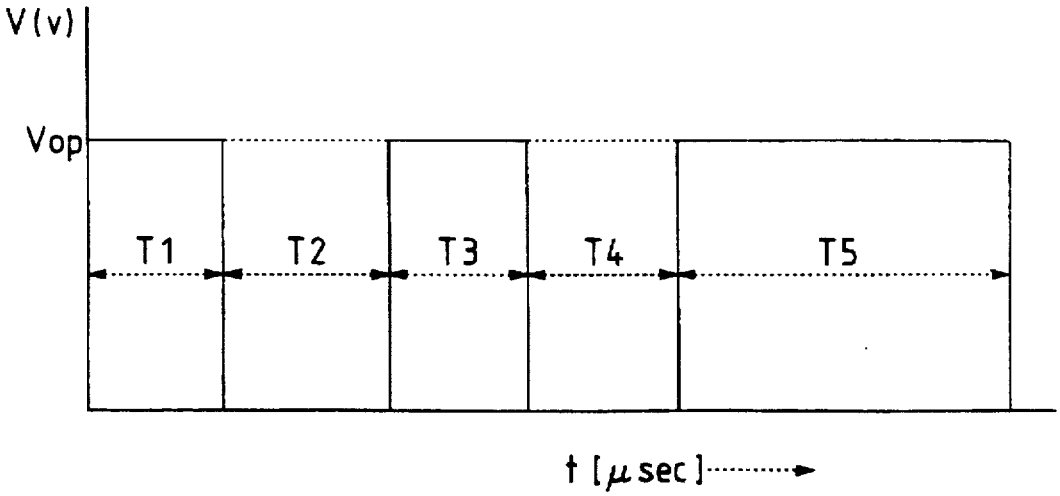

FIGS. 53A and 53B are views for explaining divided pulses according to the embodiment of the present invention. In FIG. 53A, $V_{OP}$ represents the operational voltage, T1 represents the pulse width of the first one of a plurality of divided heat pulses, which pulse does not cause bubble production (to be referred to as a pre-pulse hereinafter), T2 represents the interval time, and T3 is the pulse width of the second pulse, which causes bubble production (to be referred to as a main pulse hereinafter). The operational voltage $V_{OP}$ represents electrical energy necessary for causing an electrothermal converting element applied with this voltage to generate heat energy in the ink in an ink channel constituted by a heater board and a top plate. The value of this voltage is determined by the area, resistance, and film structure of the electrothermal converting element, and the channel structure of the recording head.

The PWM ejection quantity control of this embodiment can also be referred to as an interval time with a modulation driving method. For example, in the case of triple-pulse PWM control, the pulses are applied in turn to have the widths T1, T2, and T3 upon ejection of one ink droplet. At this time, the width of the interval time T2 is modulated according to the ink temperature and an ejection quantity modulation signal. The pre-pulse is a pulse for applying heat energy to the ink temperature in the ink channel so as not to cause bubble production. The interval time controls a time required for conducting the pre-pulse energy to the ink in the ink channel, and plays an important role in this embodiment. The main pulse causes bubble production in the ink in the ink channel, and ejects the ink from an ejection orifice. The width T3 of the main pulse is preferably determined by the area, resistance, and film structure of the electrothermal converting element, and the channel structure of the recording head.

In the PWM control described previously with reference to FIG. 10, when the ejection quantity is to be increased, the pulse width of the pulse T1 must be increased to increase heat energy itself to be supplied to the recording head. For this reason, when a pulse value having large T1 is continuously input, the temperature of the head itself is undesirably increased. As a result, since the temperature of the head itself is increased, when the ejection quantity is to be decreased in turn, the ejection quantity cannot often be decreased to a desired quantity.

Also, in the power supply design at the main body side, when the maximum ejection quantity is to be obtained in the above-mentioned control, extra electrical power of about 40% must be input, and the power supply, flexible circuit board, and the like must be designed using this maximum value from the beginning. An increase in cost for this design is very large. In a portable printer, a battery driving operation is indispensable, and an increase in electrical power decreases the number of printable pages. In particular, at low temperature, since the pulse width is shifted to be larger, the number of printable pages is further decreased in an environment where battery performance is impaired.

In this embodiment, the width T1 of the pre-pulse is left unchanged, and the interval time T2 between the pre-pulse T1 and the main pulse T3 is set to be variable, thus allowing ejection quantity control by controlling the heat conduction time. According to this control, most of the above-mentioned drawbacks can be solved. A PWM control means of this embodiment will be described below.

Figure 54:
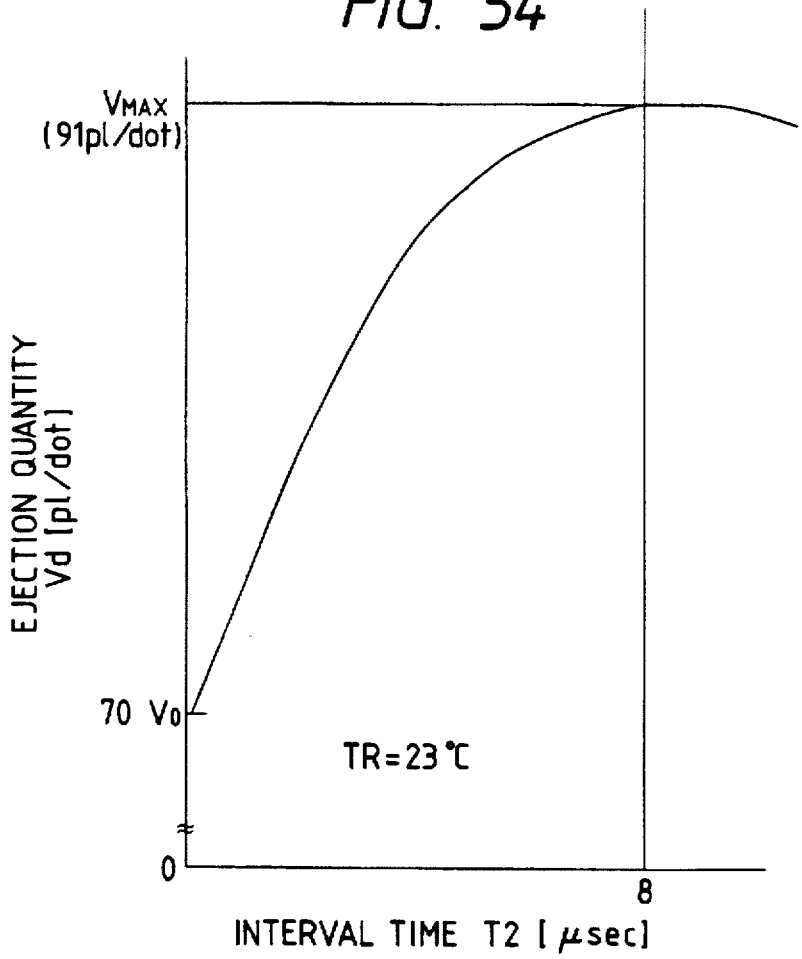
FIG. 54 is a graph showing the interval time dependency of the ejection quantity.

In the recording head shown in FIGS. 8A and 8B, when the operational voltage $V_{OP}$=18.0 (V), the main pulse width T3=4.000 [μsec], and the pre-pulse width T1=1.000 [μsec] are set, and the interval time T2 is changed between 0 and 10 [μsec], the relationship between an ejection quantity Vd [pl/drop] and the interval time T2 [μsec], as shown in FIG. 54, is obtained.

FIG. 54 is a graph showing the pre-pulse width dependency of the ejection quantity in this embodiment. In FIG. 54, $V_0$ indicates the ejection quantity when T2=0 [(sec], and this value is determined by the head structure shown in FIGS. 8A and 8B. In this embodiment, $V_0$=70.0 [pl/drop] when a surrounding temperature TR=23° C. As indicated by the curve shown in FIG. 54, the ejection quantity Vd is nonlinearly increased to a given region up to the saturation point according to an increase in interval time T2, and shows saturated characteristics for a while. Thereafter, the ejection quantity Vd presents a slow descent curve.

In this manner, a range until the change in ejection quantity Vd with respect to the change in interval time T2 is saturated is effective as a range wherein the ejection quantity can be easily controlled by changing the interval time T2. In this embodiment indicated by the curve in FIG. 54, T2 can be used up to T2≈8.00 (μs) in practice. The maximum ejection quantity at this time was 85.0 [pl/drop] in a 15° C. environment, and was 91 [pl/drop] in a 23° C. environment.

However, when the pulse width is still large, the ejection quantity Vd is gradually decreased from the maximum value. This phenomenon occurs for the following reason. In the principle of the ejection quantity control, when the pre-pulse is applied, and the ink at the interface between the electrothermal converting element and the ink is heated within a bubble non-production range, only a portion very close to the surface of the electrothermal converting element is heated since the heat conduction speed of the ink is low, and the degree of activation of this portion is increased. Thus, the evaporation quantity of this portion in response to the next main pulse is changed according to the increased degree of activation, and as a result, the ejection quantity can be controlled. For this reason, when the heat conduction time is too long (when the pulse width is too large), heat is excessively diffused in the ink, and the degree of activation of the ink is decreased in an actual bubble production range in response to the next main pulse.

Figure 55:
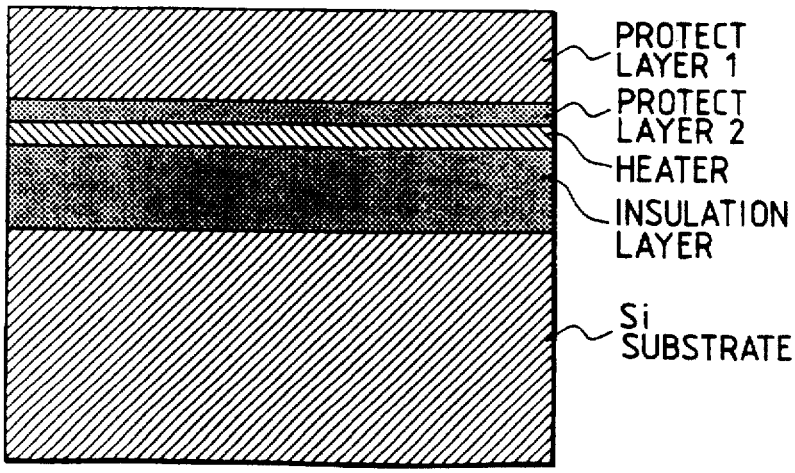
FIG. 55 is a sectional view showing a section of a heater board portion of a recording head.
Figure 56:
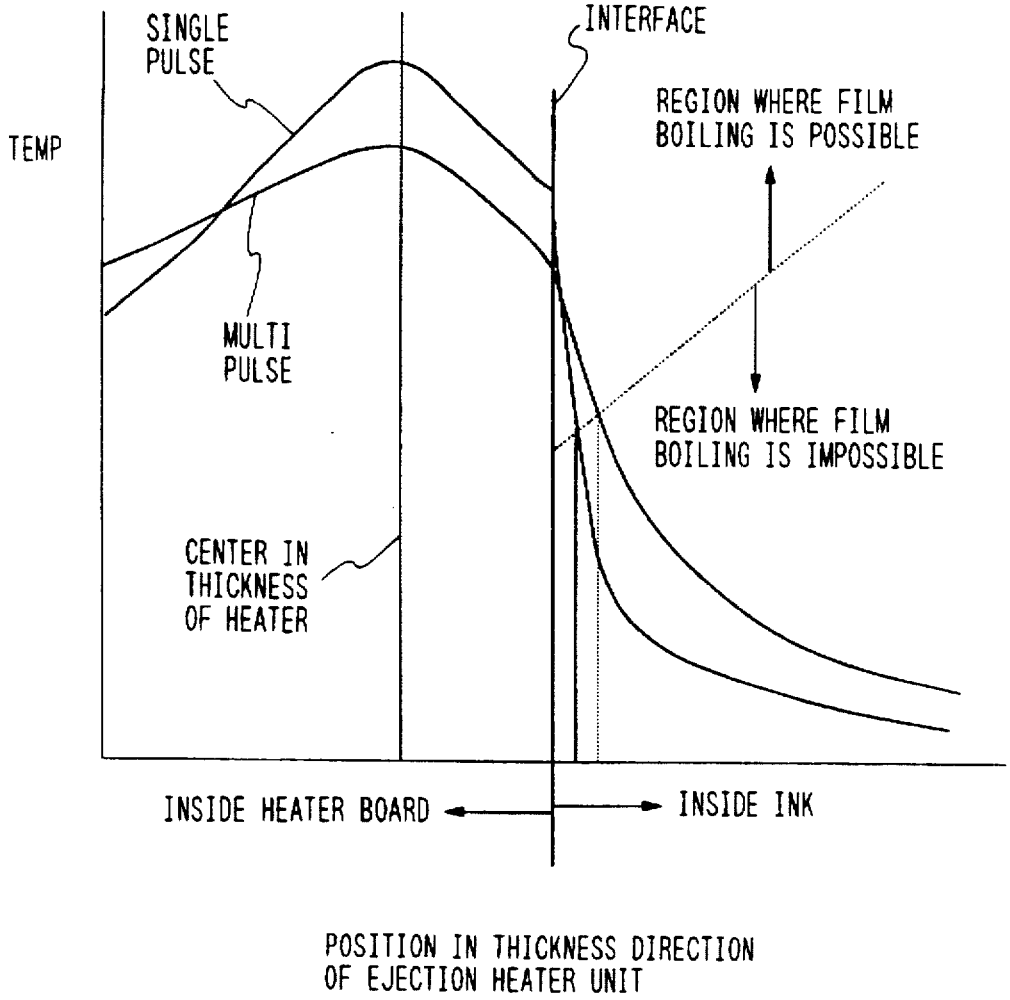
FIG. 56 is a graph showing the one-dimensional temperature distribution of the section near the heater board of the recording head in a direction of perpendicular to the heater board.

An increase in ejection quantity due to an increase in interval time T2 will be described in detail below. As shown in FIG. 55, since a multi-layered coating such as a protection film is formed on the heater surface, the center of the heater exhibits the highest temperature, the temperature is slightly decreased toward the interface with the ink, a temperature distribution representing an abrupt change is formed at the interface with the ink, and thereafter, a moderate distribution is shown. FIG. 56 shows a one-dimensional temperature distribution of a section perpendicular to the heater surface in a conventional single-pulse driving method and the multi-pulse driving method. The temperature distribution shown in FIG. 56 is one after an elapse of the interval time T2 after the pre-pulse T1 is input, and immediately before film boiling in the main pulse T3 occurs. A curve of the single-pulse driving method also represents a temperature distribution after the single pulse is applied and immediately before film boiling occurs.

At this time, the temperature distribution in the ink is as shown in FIG. 56. As can be seen from FIG. 56, the thickness of an ink layer having a high temperature although its peak temperature is low is larger in the multi-pulse method than that in the single-pulse method. When film boiling occurs at the next moment in this state, a portion above a temperature indicated by an oblique dotted line is actually evaporated, and serves as a portion associated with bubble production. More specifically, the ink portion having a thickness indicated by a vertical dotted line in the graph of the temperature inside the ink is evaporated, and the bubble production volume in the multi-pulse method is larger than that in the single-pulse method. As a result, the ejection quantity is increased.

The multi-pulse PWM control based on the interval time control method is characterized in that input energy is set to have a minimum constant value, and the thickness of the ink layer (bubble production volume) to be evaporated is controlled according to a heat conduction time from the input of the pre-pulse T1 until the beginning of film boiling. More specifically, when the interval time is increased, although the peak temperature of the ink is decreased, the region of the (activated) ink layer, which is actually evaporated in response to the next main pulse, and is associated with bubble generation, is increased.

This embodiment is suitable for high-speed driving since a control region varies from the interval time=0 to a value (8 μsec in FIG. 54) corresponding to the saturated ejection quantity. More specifically, a region after the value (8 μsec in FIG. 54) corresponding to the saturated ejection quantity may be used as a control region. However, since a time required for one ejection is increased, the latter region is not suitable for high-speed driving. For example, when the pre-pulse width T1=1.000 [μsec] and the main pulse width T3=4.000 [μsec] are set, and the interval time T2 is changed between 0 and 8 [μsec], a time required for one ejection is a maximum of 13 [μsec]. However, when the interval time T2 is changed from 8 to 20 [μsec], 25 [μsec] are required.

As described above, according to this embodiment, the ejection quantity control is performed by controlling the ejection quantity by changing the interval time T2, i.e., by controlling the thickness of the ink layer at active level according to a heat conduction time after a minimum necessary heat amount is applied, in place of changing the pre-pulse width T1, i.e., in place of forcibly and abruptly applying heat energy to the ink having low heat conductivity with a large temperature gradient up to active level immediately before film boiling occurs.

With the above-mentioned new principle, the following effects are obtained. The first effect is a widened controllable range, as described above. When the pre-pulse width T1 is increased to increase the ejection quantity, the ink temperature approaches a pre-bubble region. However, since this embodiment is free from such a problem, the control range can be widened independently of variations of recording heads.

The second effect is an energy saving effect. In this embodiment, since an increase in bubble production efficiency is realized by increasing heat efficiency based on the heat conduction time, energy supplied to the recording head need not be increased, i.e., a minimum energy level can be set. In other words, in this embodiment, as the ejection quantity is increased, the heat efficiency can be improved, and the required heat amount per unit ejection volume is decreased. Therefore, in the design of the main body power supply, flexible cable, connector, and battery, as described above, only a minimum capacity is required. In the method of controlling the pre-pulse width, since the pulse width must be increased to continuously increase the ejection quantity, input energy is undesirably increased by a maximum of about 40%, and an increase in temperature of the recording head itself is promoted. However, the temperature of the recording head is not increased, and the increase in temperature of the head itself is suppressed by the improved heat efficiency.

Figure 57:
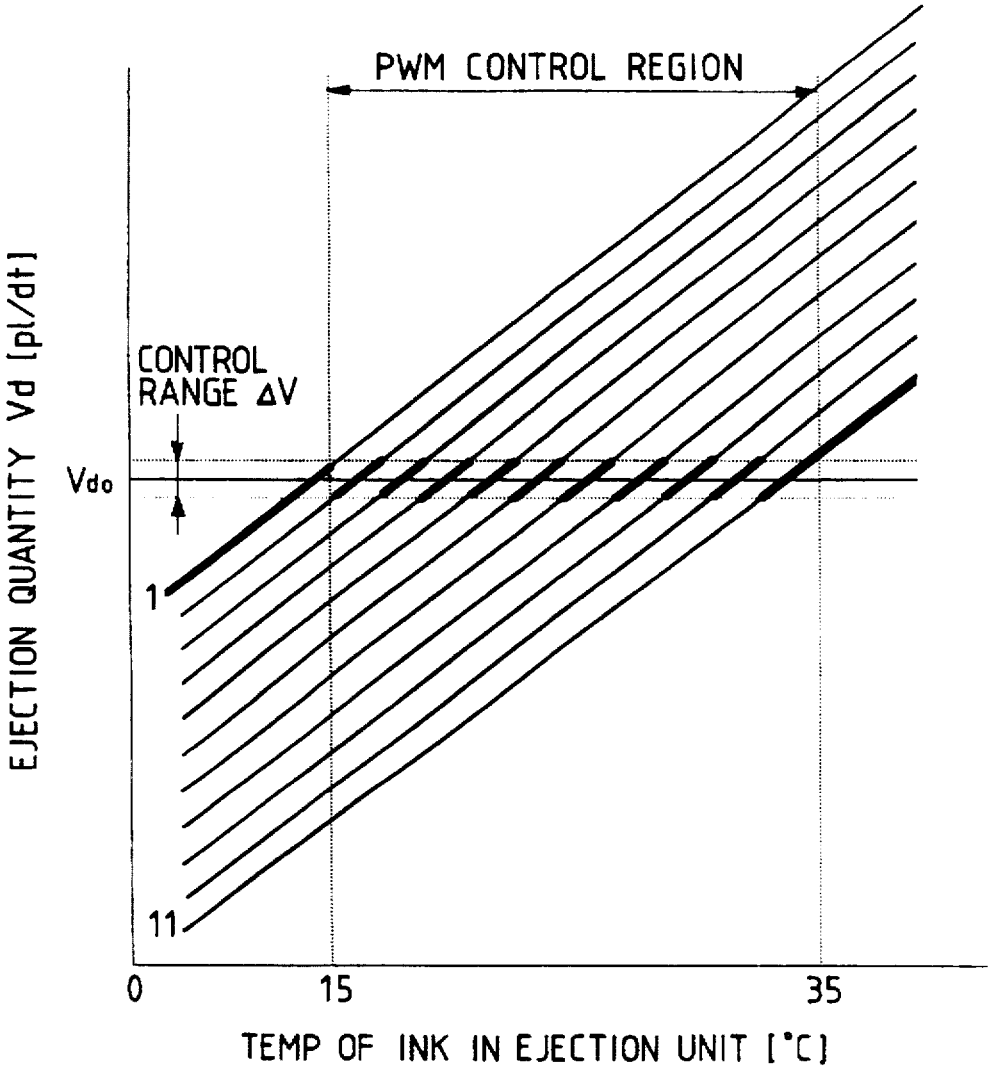
FIG. 57 is an explanatory view associated with ejection quantity control.

In an actual ejection quantity control method, a temperature range described as "PWM control region" in FIG. 57 is a temperature range in which the ejection quantity can be stabilized. In this embodiment, this temperature range corresponds to a range between 15° C. and 35° C. of the ink temperature in the ejection unit. FIG. 57 shows the relationship between the ink temperature in the ejection unit and the ejection quantity when the interval time is changed in 10 steps. Even when the ink temperature in the ejection unit changes, the ejection quantity can be controlled within a width $\Delta V$ with respect to a target ejection quantity Vd0 by changing the interval time at every temperature step width $\Delta T$ according to the ink temperature.

(Temperature Prediction Control)

Operations upon execution of recording using the recording apparatus with the above arrangement will be described below with reference to the flow charts shown in FIGS. 58 and 59.

Figure 17:
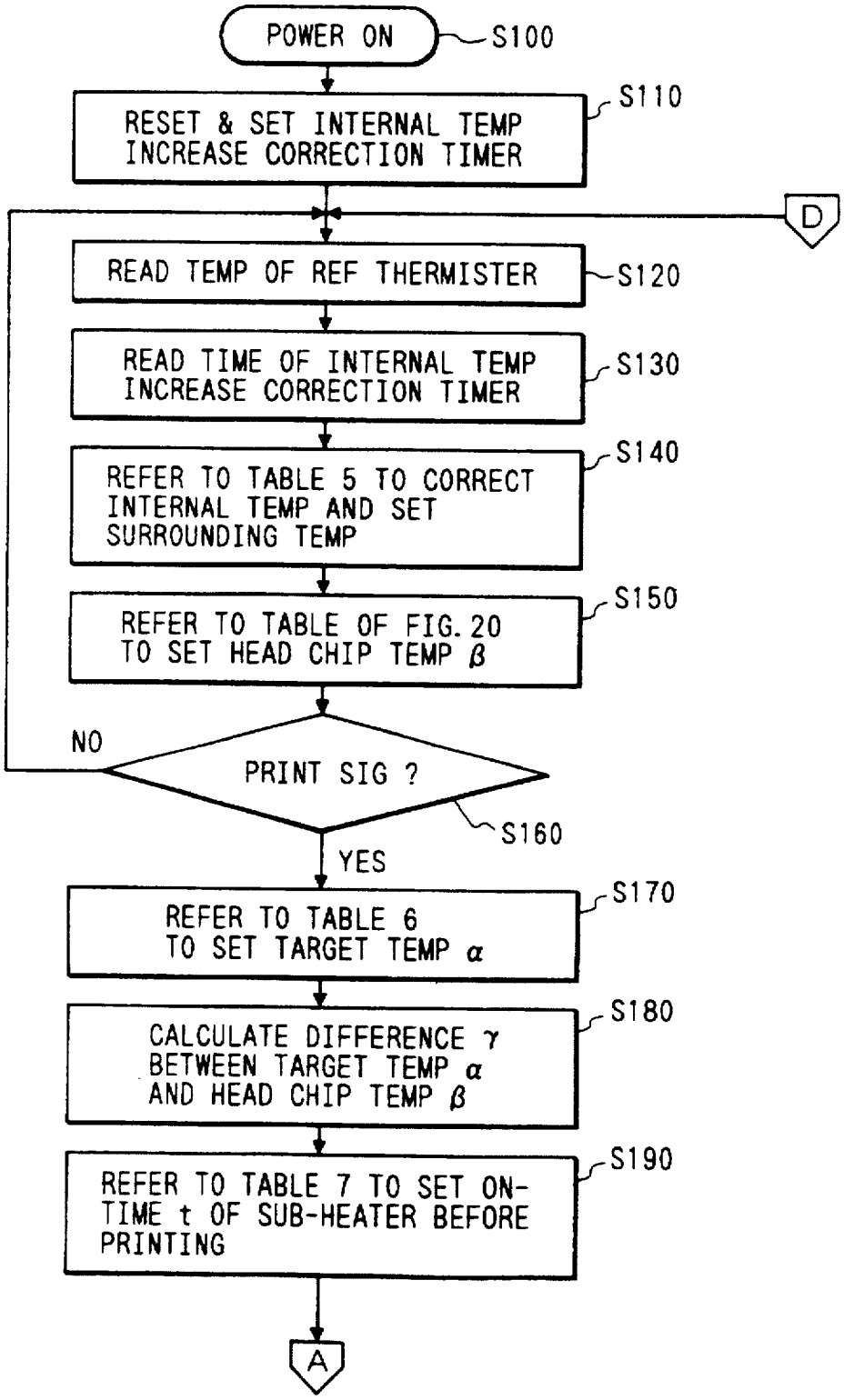
FIGS. 17, 18 and 19 are flow charts associated with temperature prediction control.

Since operations from when the power switch is turned on in step S700 until a print signal is input in step S760 are the same as those in steps S100 to S160 in FIG. 17, a detailed description thereof will be omitted.

Figures 60, 62:
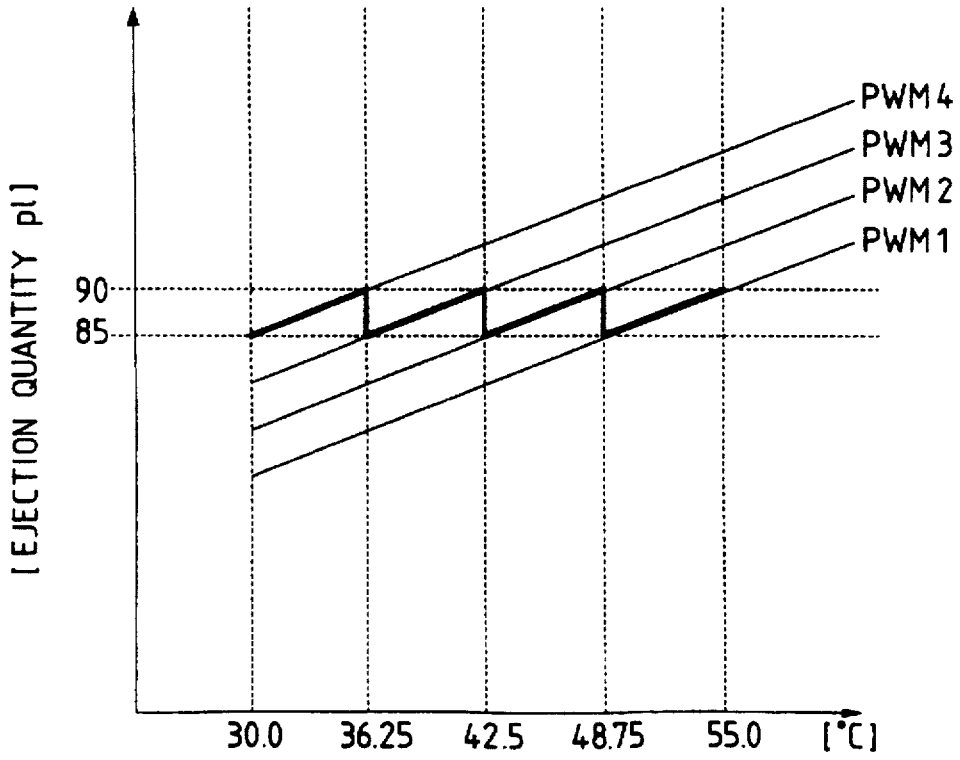
FIG. 60 is a table showing the relationship between the surrounding temperature and the target head temperature.
FIG. 62 is an explanatory view associated with ejection quantity control also using sub-heaters.

When the print signal is input, a target (driving) temperature table (FIG. 60) is referred to, thus obtaining a print target temperature ($\alpha$) of the head chip at which optimal driving is attached at the current surrounding temperature (S770). In FIG. 60, the same table as Table 6 presented previously may be used although the target temperatures are different. In step S780, $\gamma(=\alpha-\beta)$ is calculated.

Then, the interval time T2 is determined with reference to FIG. 61A for the purpose of controlling the ejection quantity using the PWM method (S790).

During a one-line print operation, the chip temperature of the head changes according to its ejection duty. More specifically, since the difference ($\gamma$) sometimes changes even in one line, the interval time is preferably optimized in one line according to the change in $\gamma$. In this embodiment, the one-line print operation requires 1.0 sec. Since the temperature prediction cycle of the head chip is 0.1 sec, one line is divided into 10 areas in this embodiment. The interval time at the beginning of printing, which value is set previously, is an interval time at the beginning of printing of the first area.

A method of determining the interval time at the beginning of printing of each of the second to 10th areas will be described below. In step S800, n=1 is set, and in step S810, n is incremented. In this case, n represents the area, and since there are 10 areas, the control escapes from the following loop when n exceeds 10 (S820).

In the first round of the loop, the interval time at the beginning of printing of the second area is set. More specifically, the power ratio of the first area is calculated based on the number of dots and the PWM value of the first area (S830). The power ratio corresponds to a value plotted along the ordinate when the temperature prediction table is referred to. In this case, the head chip temperature ($\beta$) at the end of printing of the first area (i.e., at the beginning of printing of the second area) is predicted by substituting the power ratio in the temperature prediction table (FIG. 20) (i.e., by referring to the table) (S840). In step S850, the difference ($\gamma$) between the print target temperature ($\alpha$) and the head chip temperature ($\beta$) is calculated again. The interval time T2 for printing the second area is obtained based on the difference ($\gamma$) by referring to FIG. 61, and the interval time of the second area is set on the memory (S860).

Thereafter, the power ratio in the corresponding area is calculated based on the number of dots and the interval time of the immediately preceding area, thereby predicting the head chip temperature ($\beta$) at the end of printing of the corresponding area. Then, the interval time of the next area is set based on the difference ($\gamma$) between the print target temperature ($\alpha$) and the head chip temperature ($\beta$) (S820 to S860). Thereafter, when the interval times for all the 10 areas in one line-are set, the flow advances from step S820 to step S870, and the sub-heaters are heated before printing. Thereafter, the one-line print operation is performed according to the set interval times. Upon completion of the one-line print operation in step S870, the flow returns to step S720 to read the temperature of a reference thermistor, and the above-mentioned control operations are sequentially repeated.

With the above-mentioned control, since the actual ejection quantity can be stably controlled regardless of the ink temperature, a high-quality recorded image having a uniform density can be obtained.

(28th Embodiment)

The 28th embodiment of the present invention, capable of widening a control region of an ejection quantity, will be described below.

In the 27th embodiment, the interval time in the double-pulse PWM driving method is controlled to control the ejection quantity in all the environments. However, in the 28th embodiment, sub-heaters are also used according to the surrounding temperature, so that the temperature range of the recording head, in which the ejection quantity can be controlled, is widened.

The temperature range of the recording head, in which the ejection quantity can be controlled, in the 28th embodiment will be described below. The characteristics of the recording head used in the 27th and 28th embodiments and the ejection quantity per dot suitable for image formation are as follows:

Ejection quantity change width controlled by changing interval time; +30%

Temperature dependency coefficient (KT); 0.8 [pl/°C.]

Optimal ejection quantity: 85 pl

Assuming that the surrounding temperature range, in which the apparatus can be used, and the print density is assured, is a range between 15° C. and 35° C., the recording head must be arranged to obtain an ejection quantity of 85 pl when the surrounding temperature is 15° C. (recording head temperature=15° C.), and the PWM value for maximizing the ejection quantity (to be referred to as PWMmax hereinafter) is set. At this time, an ejection quantity of 65 pl is obtained when the PWM value for minimizing the ejection quantity is set (to be referred to as PWMmin hereinafter). When this head is used at a surrounding temperature of 35° C., since the temperature dependency coefficient is 0.8, the ejection quantity is increased by 16 pl, and 81 pl are obtained by PWMmin. When a difference from the optimal ejection quantity is up to 4 pl, i.e., when an increase in temperature of the recording head itself by the print operation is up to 5° C., the actual ejection quantity can be controlled to be equal to the optimal ejection quantity. However, when the increase in temperature of the recording head itself exceeds 5° C., it is impossible to control the actual ejection quantity. Factors that limit the useable temperature width of the recording head are two factors, i.e., the ejection quantity control width of PWM driving and the temperature dependency coefficient. If the ejection quantity change width is 20, and the temperature dependency coefficient is 0.8, the useable temperature range of the recording head is inevitably limited to 25° C.

Thus, in this embodiment, when the surrounding temperature is low, control for heating the recording head using the sub-heaters is performed in addition to the control in the 27th embodiment. Thus, a low recording head temperature need not be assumed, and the useable temperature range can be shifted toward the upper limit side. For this reason, the condition of a useable temperature can be expanded in a practical use. In this embodiment, although control is made also using the sub-heaters, since the ejection quantity is controlled by the method of the 27th embodiment without increasing the pre-pulse width, input energy conversion efficiency can be improved. For this reason, an increase in temperature can be suppressed, and an ejection quantity control range can be further widened even when print quality equivalent to that in the prior art is to be obtained.

This embodiment will be described in detail below with reference to the accompanying drawings. In this embodiment, an allowable variation range of the actual ejection quantity is a range between 85 and 90 pl, and four ranks of PWM values are set. That is, PWM values PWM1, PWM2, PWM3, and PWM4 are set from a smaller ejection quantity side. The PWM value PWM4 is 1.3 times the ejection quantity ratio of PWM1, and other PWM values are set to have the same ratio. FIG. 63 shows details (pre-pulse widths, interval times, main pulse widths, and the like) of the PWM values. In this embodiment, the PWM values are changed immediately before the print operation of each line.

FIG. 62 shows the relationship between the recording head temperature, the selected PWM value, and the ejection quantity at that time. FIG. 62 does not illustrate setting below 30° C. for the following reason. That is, when the recording head temperature is equal to or lower than 30° C., the sub-heaters are driven to adjust the recording head temperature to be equal to or higher than 30° C. The recording head temperature is presumed by the temperature prediction control means described in the 26th embodiment. When the recording head temperature falls within the range of 30° C. (inclusive) and 36.25° C. (exclusive), the recording head is driven by PWM4 capable of obtaining the maximum ejection quantity. When the recording head temperature exceeds 36.25° C., the PWM value is switched to PWM3. Thereafter, every time an increase in recording head temperature exceeds 6.25° C., the PWM value is switched in the order of PWM2 and PW1.

Figure 64:
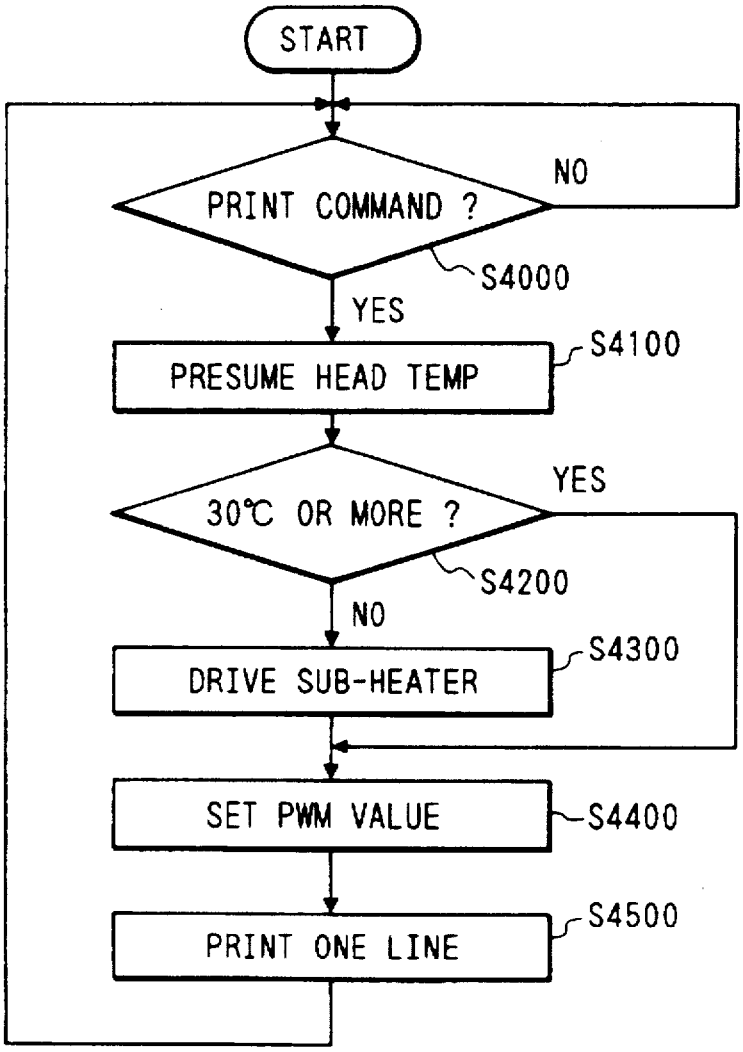
FIG. 64 is a flow chart associated with ejection quantity control in the temperature prediction control method also using the sub-heaters.

Operations upon execution of recording using the recording apparatus with the above-mentioned arrangement will be described below with reference to the flow chart shown in FIG. 64.

When a print command is input in step S4000, the recording head temperature is presumed (S4100). If the recording head temperature is 30° C. or less, the sub-heaters are driven in unit time to increase the recording head temperature. Upon repetition of the above operations, the recording head temperature is adjusted to be 30° C. or more (S4200 and S4300). If it is determined in step S4200 that the recording head temperature exceeds 30° C., the flow advances to step S4400, and the rank of the PWM value is set based on the recording head temperature. The pre-pulse width, interval time, and main pulse width according to the rank are obtained from FIG. 63, and a one-line print operation is performed according to the obtained values (S4500). Thereafter, the control returns to a print standby state.

With the above-mentioned control, the upper limit value of the ejection quantity controllable temperature range of the recording head can be increased as compared to the 27th embodiment. Since a temperature difference between the recording head temperature and the surrounding temperature is increased, the temperature decrease speed of the recording head can also be increased. Thus, even when the ejection quantity controllable temperature range of the recording head remains the same, an increase in temperature of the recording head can be suppressed, and the control range of the recording head temperature with respect to input energy can be widened.

In this embodiment, since four ranks of PWM values are set, the allowable ejection quantity range is set to be 5 pl. However, when the number of ranks of the PWM values is increased, the allowable ejection quantity range can be narrowed. In this embodiment, the switching timing of the PWM values is set immediately before the print operation of each line. Alternatively, control may be made to switch the PWM value a plurality of number of times during the one-line print operation.

In this embodiment, the control method of increasing the temperature of the recording head to be 30° C. or more using the sub-heaters is executed immediately before printing. However, the sub-heaters may be always driven even during printing. The optimal increased/keeping temperature is determined by the arrangement of the recording head, and the ink composition, and is not limited to 30° C. in this embodiment. The arrangement and operations other than the sub-heater driving control means are the same as those in the above embodiment, and a detailed description thereof will be omitted.

(29th Embodiment)

The 29th embodiment for widening the control width of the ejection quantity by PWM driving according to the present invention will be described below.

As described above, factors that limit the useable temperature width of the recording head are two factors, i.e., the ejection quantity control width of PWM driving and the temperature dependency coefficient. In the 28th embodiment, since the ejection quantity change width is +30% (20 pl), and the temperature dependency coefficient is 0.8, the useable temperature range of the recording head is limited to 25° C. (20 pl/0.8). Therefore, the lowest temperature of the recording head is controlled to be 30° C. or more using the sub-heaters, thereby shifting the useable temperature range (25° C.) of the recording head toward the upper limit side to attain effective control.

However, in the control for driving the sub-heaters immediately before recording, and disabling the sub-heaters during printing, the print operation must be delayed until the recording head temperature is increased to a predetermined temperature, i.e., 30° C. As a result, the throughput (recording time) may be decreased, and it is difficult to apply such control to a product that requires high-speed operations. In order to always drive the sub-heaters to control the recording head temperature to be 30° C., the power supply capacity capable of driving the sub-heaters during printing is required, and this may cause an increase in cost. In addition, the energy saving effect as the primary object may be deteriorated.

Thus, in the 29th embodiment, the useable temperature range of the recording head is widened by increasing the ejection quantity control width, thus eliminating the above-mentioned influences upon the rapid temperature rise of the recording head by, e.g., the sub-heaters, and a temperature keeping operation.

This embodiment will be described in detail below. In FIG. 53A, T1 represents a pre-pulse, T3 represents a main pulse, and T2 represents an interval time between the pre-pulse T1 and the main pulse T3. As has been described in the above embodiment, the ejection quantity can be controlled by changing T2 without changing T1. Also, the ejection quantity can be controlled by changing T1 without changing T2. Thus, in this embodiment, both T1 and T2 are optimally controlled according to the recording head temperature to further widen the ejection quantity control width, so that the useable temperature range of the recording head can be widened without utilizing an external assist means such as the sub-heaters.

FIG. 65 shows the ratio of change in ejection quantity when T1 and T2 are changed. As can be seen from FIG. 65, when both T1 and T2 are changed, the ejection quantity can be increased by 50% in this embodiment. The pre-pulse T1 is used for the purpose of increasing the ink temperature around ejection heaters, and the ink temperature is increased to have a correlation with its pulse width. However, when the pre-pulse T1 causes a bubble production phenomenon, since a bubble may be irregularly produced upon application of the main pulse, the upper limit of T1 is determined by the maximum pulse width that does not cause the bubble production phenomenon. Since the pulse width of the pre-pulse T1 is left unchanged in any environment in the 28th embodiment, the value T1 is not set to be an upper limit value for the purpose of energy saving and suppression of an increase in temperature. However, this embodiment also controls T1 to provide the PWM effect with maximum efficiency.

In this embodiment, when the ink temperature is 15° C., T1=3 μs that can attain the maximum ejection quantity control width in FIG. 65 is set, thereby realizing a maximum increase in ejection quantity (by 50%) in the 15° C. environment. Since the ejection quantity can be increased by 50% when the ink temperature is at 15° C., and since the ejection quantity change width is 28 pl (85–85/1.5), and the temperature dependency coefficient is 0.8 in this embodiment, the useable temperature range of the recording head is inevitably set at 35° C. (28/0.8).

With the above-mentioned control, the use range of the recording head temperature, in which the ejection quantity can be controlled to be an optimal ejection quantity, can be widened to a range between 15° C. and 50° C. (35° C. width). The arrangement and operations other than the pre-pulse width control means are the same as those in the above embodiment, and a detailed description thereof will be omitted.

As described above, in the multi-pulse PWM control method of this embodiment, the duration of the OFF time (interval time) between the first pulse (pre-pulse) and the second pulse (main pulse) is set to be variable in place of changing the width of the first pulse. More specifically, heat efficiency is varied by changing the heat conduction time with a minimum energy amount without increasing the energy amount, and the degree of activity of the ink at the interface between the heater and the ink is changed, thus varying the ejection quantity.

In this manner, the control range can be widened without causing an increase in energy or a problem of an increase in temperature, and without causing an ejection error such as irregular bubble production that may easily occur at the limit point, and damage to heaters. Therefore, the ejection quantity can be stably controlled without posing a problem of an increase in power supply capacity or a problem of an overload upon battery driving, or without forming wait time even at a low temperature depending on the method.

Furthermore, when both the first pulse and the interval time are independently controlled, the variable range of the ejection quantity can be greatly widened. When the ink temperature is controlled also using the sub-heaters, the controllable range can also be widened.

Ejection is stabilized according to the ink temperature in the ejection unit in the recording mode, which is presumed prior to recording, thus obtaining a high-quality image having a uniform density. Since the ink temperature is presumed without providing a temperature sensor to the recording head, the recording apparatus main body and the recording head can be simplified.

As described above, in the multi-pulse PWM control method of the present invention, the duration of the OFF time (interval time) between the first pulse (pre-pulse) and the second pulse (main pulse) is set to be variable in place of changing the width of the first pulse. More specifically, heat efficiency is varied by changing the heat conduction time with a minimum energy amount without increasing the energy amount, and the degree of activity of the ink at the interface between the heater and the ink is changed, thus varying the ejection quantity.

In this manner, the control range can be widened without causing an increase in energy or a problem of an increase in temperature, and without causing an ejection error such as irregular bubble production that may easily occur at the limit point, and damaging heaters.

(30th Embodiment)

In the method of varying the interval time between the pulses described in the 29th embodiment, the above-mentioned problems of, e.g., an increase in temperature can be remarkably improved in principle. However, the main pulse as a pulse for actually causing ejection still has room for improvements. For example, when the minimum driving period of the recording head is shortened to increase the recording speed, since the heat conduction characteristics of the members themselves constituting the recording head approach their limits, if any wasteful heat quantity that cannot be converted into ejection energy is applied, local heat accumulation occurs near ejection nozzles. For this reason, a refill error occurs or a bubble cannot satisfactorily disappear due to an extreme increase in ejection quantity Vd, and the next successive bubble production causes a bubble production error, resulting in an ejection disable state.

When the interval time is further increased to widen the ejection quantity controllable range, heat is excessively diffused below the degree of activation necessary for varying the ejection quantity, thus decreasing heat efficiency. Even when the modulation of the first pulse width and the modulation of the interval time are combined, a maximum of the ejection quantity modulation width of about 50% can only be obtained.

For this reason, the above-mentioned embodiment is sufficient for the purpose of stabilizing the ejection quantity, but is insufficient to obtain a halftone image by varying the ejection quantity unless it is combined with a large number of times of multi-scan print operations.

The 30th embodiment of the present invention will be described below.

At a simple low print ratio, the above-mentioned result is obtained. However, when the print operation is performed at a high print ratio, the heat efficiency of the above-mentioned main pulse T3 (FIG. 53A) poses a problem. Furthermore, when the minimum driving ejection period (maximum driving frequency) is shortened (increased) in, e.g., a high-speed mode in units of print modes using a single head, the problem of the heat efficiency cannot often be ignored. For example, a difference shown in FIG. 66 is formed between a case wherein the minimum ejection driving period (maximum driving frequency) is 333 μs (3 kHz) and a case wherein the minimum ejection driving period (maximum driving frequency) is 167 μs (6 kHz).

Figure 66:
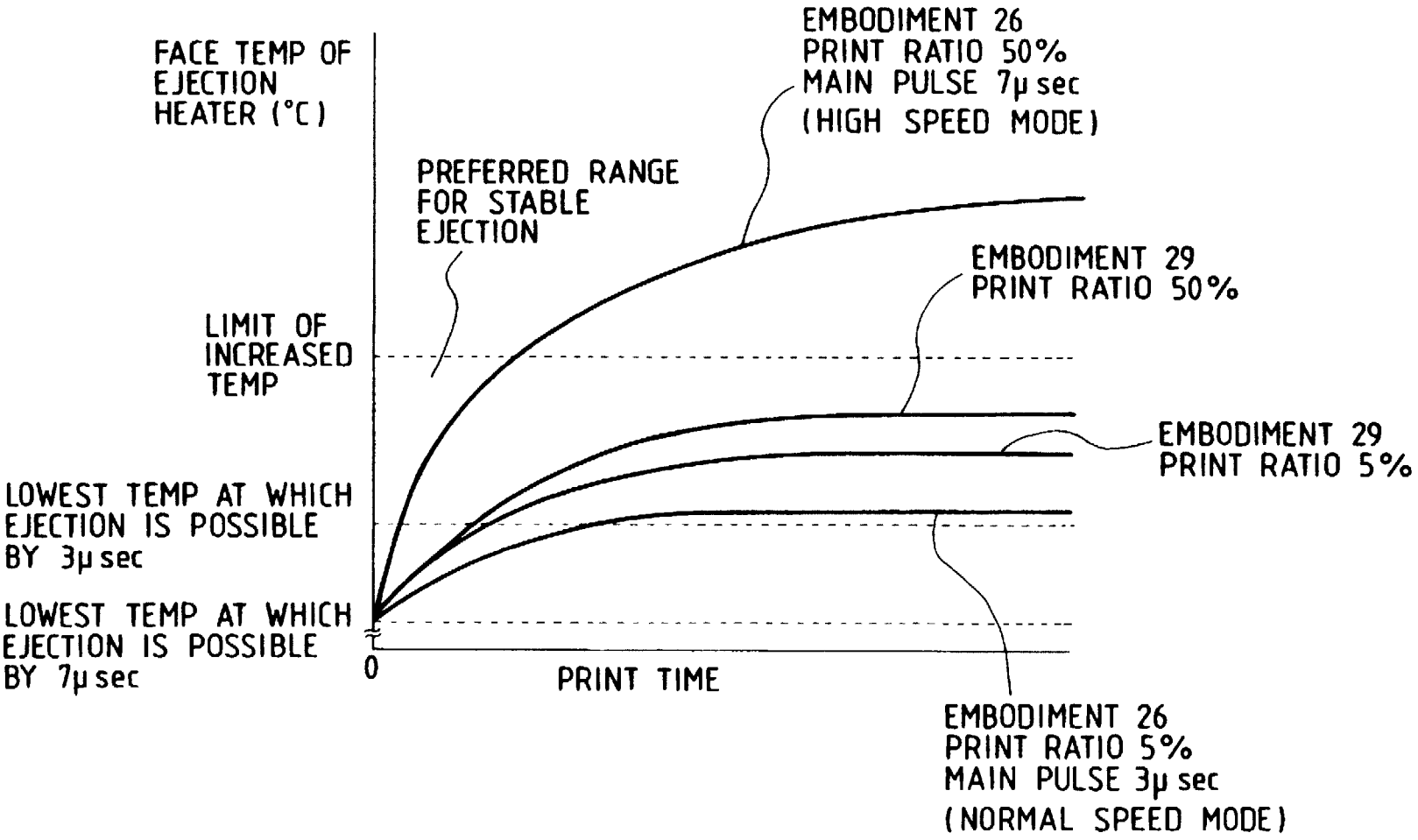
FIG. 66 is a graph showing the temperature rise caused by heat accumulation of the recording head.

FIG. 66 shows a change in temperature of the recording head when the print operations are respectively performed at print ratios of 5% and 50%. The print time is plotted along the abscissa.

The following description will be made mainly with reference to FIG. 66 which best illustrates the features of this embodiment. The graph shown in FIG. 66 shows the degrees of temperature rise of the recording head with respect to the print times when the print operations are respectively performed at the print ratios of 50% and 5% in the 27th and 30th embodiments. In the 27th embodiment, the print operation at the print ratio of 50% is performed to have the main pulse width T3 of 7 μsec, and that at the print ratio 5% is performed to have the main pulse width T3 of 3 μsec. In these cases, the pre-pulse width T1 is fixed to 3 μsec, and the interval time T2 is varied. The minimum driving period of recording is set to be 167 μsec (high-speed mode) in this embodiment, and a recording head, which has a thermal limit in use of 333 μsec in the conventional driving technique, is used. More specifically, when this head is used in driving of 167 μsec, it causes an overheating state in practice. In the latter half of one line, ejection becomes unstable, and when several lines are continuously printed, the ejection disable state occurs at last.

As for the embodiment of the present invention, FIG. 66 also shows data at the print ratios of 50% and 5%. The pre-pulse width T1 is similarly fixed to be 3 μsec, and the interval time T2 is varied. The main pulse width T3 is varied between 3 μsec and 7 μsec. When the continuous print operation is performed in this state, the head shows a change in temperature shown in FIG. 66.

Figure 67:
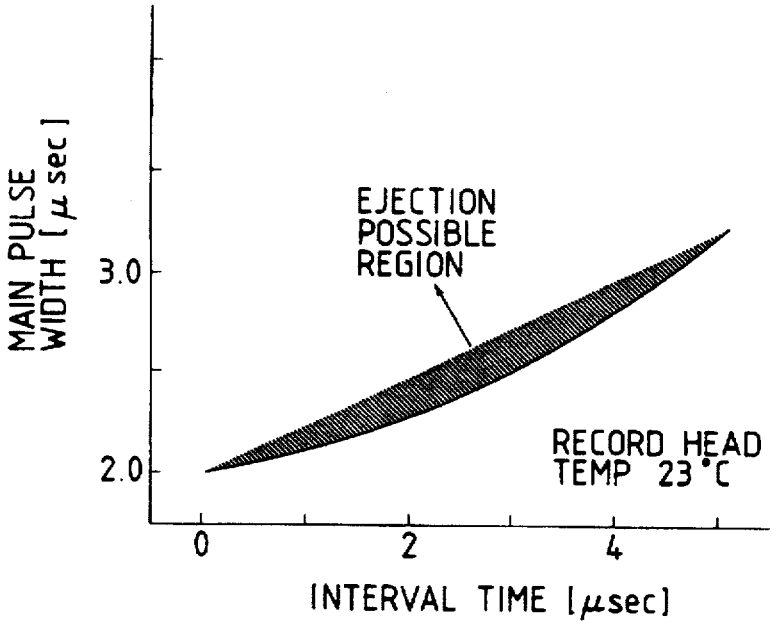
FIG. 67 is a graph showing the relationship between the interval time and the ejection possible minimum main pulse width in the multi-pulse PWM control.

The possible ejection region of the main pulse T3 in the multi-pulse PWM driving mode is influenced by the pre-pulse T1 and the interval time T2. The influence of the interval time T2 will be described first. In contrast to the single-pulse driving mode, in the multi-pulse driving mode, since the temperature at the interface between the heater and the ink immediately before the main pulse is output is maintained at a high activation level, a time after the main pulse T3 is started until film boiling is started is shortened, and as a result, the minimum necessary pulse width of the main pulse T3 is shortened, as shown in FIG. 67.

As has been described above with reference to FIGS. 55 and 56, in the multi-pulse PWM control based on the interval time control method, input energy is set to have a predetermined minimum value, and the thickness (bubble production volume) of the ink layer to be evaporated is controlled by the heat conduction time after the pre-pulse T1 until the beginning of film boiling.

Furthermore, it is important that the thickness of the ink layer capable of causing film boiling changes during the interval time T2, and the time after the main pulse T3 is started until film boiling is actually started changes, as described above.

Figure 68:
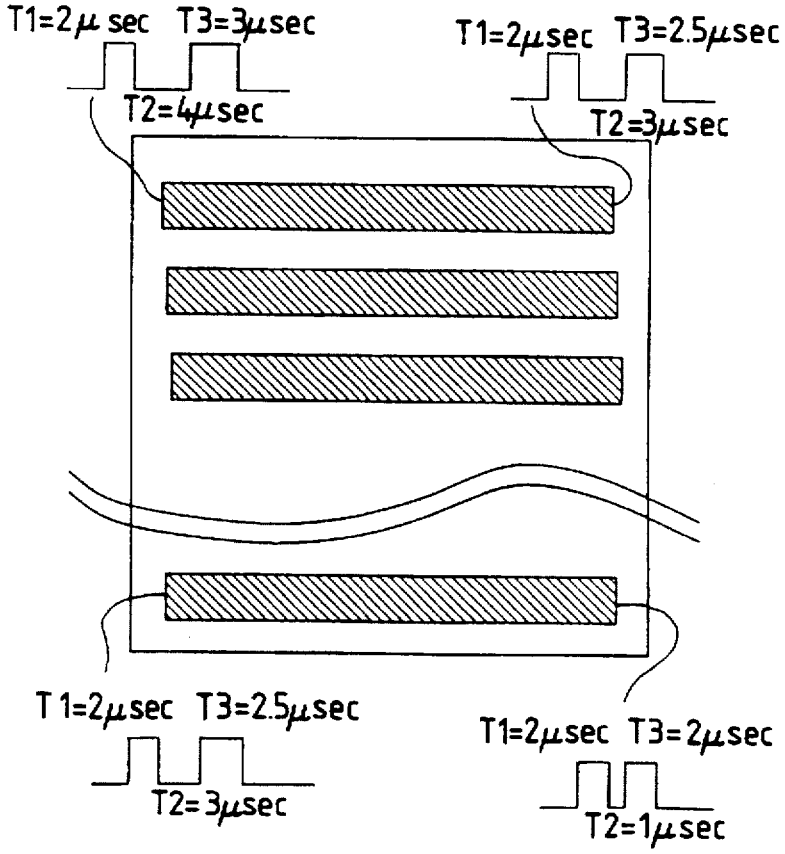
FIG. 68 is a view showing changes in multi-pulse condition at respective position in the 29th embodiment.

By utilizing these characteristics, when the main pulse T3 is PWM-controlled in correspondence with a change in interval time T2, wasteful energy which is generated since a value at which bubble production and ejection can be performed under the worst condition is used although the film boiling start point changes can be greatly decreased. More specifically, problems of, e.g., the heat accumulation and overheating of the recording head due to heating of the heaters in an adiabatic state from the ink after film boiling is already started, scorching and cavitation breakdown of the ink due to an increase in heater peak temperature, and the like, can be solved. Furthermore, since the problem of heat accumulation can be remarkably improved, the minimum driving period of the recording head can be greatly prolonged. In particular, the print operation at a high print ratio can be performed in a driving frequency band in which such a print operation is impossible so far. FIG. 68 shows an actual change in pulse width when several lines at a print ratio of 50% are printed on an A4-size recording sheet.

Figure 69:
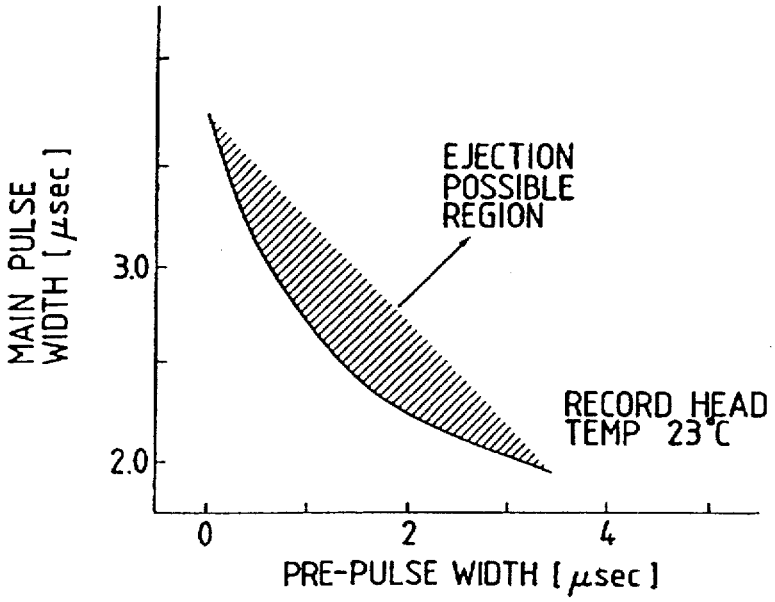
FIG. 69 is a graph showing the relationship between the pre-pulse width and the ejection possible minimum main pulse width in the multi-pulse PWM control.

The influence of the pre-pulse T1 will be explained below. In contrast to the single-pulse driving mode, in the multi-pulse driving mode, since the temperature at the interface between the heater and the ink immediately before the main pulse is output is maintained at a high activation level, a time after the main pulse T3 is started until film boiling is started is shortened, and as a result, the minimum necessary pulse width of the main pulse T3 is shortened, as shown in FIG. 69.

When the pre-pulse width T1 is changed, the same temperature distribution as that obtained when the interval time T2 is changed, as shown in FIG. 56, is obtained. At this time, in the multi-pulse PWM control based on the pre-pulse T1 control, method, the ink temperature at the interface between the heater and the ink is controlled within a bubble non-production range by varying input energy so as to vary the thickness (bubble production volume) of the ink layer to be evaporated, thereby controlling the ejection quantity.

In this case, it is important that the thickness of the ink layer capable of causing film boiling changes according to the pre-pulse width T1, and the time after the main pulse T3 is started until film boiling is actually started changes, as described above.

Figure 70:
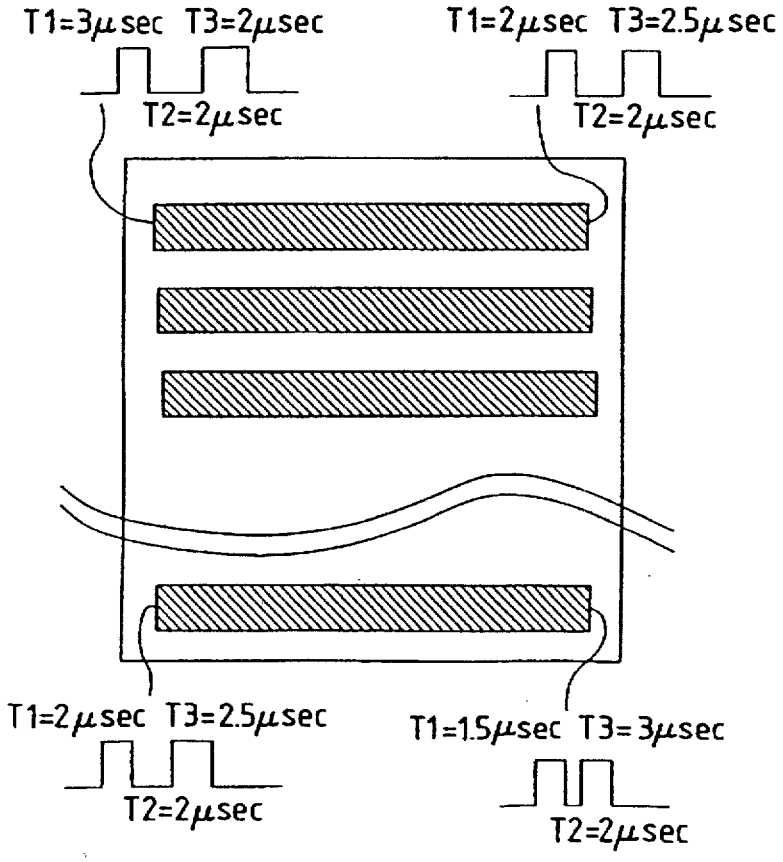
FIG. 70 is a view showing changes in multi-pulse condition at respective position in the 29th embodiment.

By utilizing these characteristics, when the main pulse T3 is PWM-controlled in correspondence with a change in pre-pulse width T1, wasteful energy which is generated since a value at which bubble production and ejection can be performed under the worst condition is used although the film boiling start point changes can be greatly decreased. More specifically, problems of, e.g., the heat accumulation and overheating of the recording head due to heating of the heaters in an adiabatic state from the ink after film boiling is already started, scorching and cavitation breakdown of the ink due to an increase in heater peak temperature, and the like, can be solved. Furthermore, since the problem of heat accumulation can be remarkably improved, the minimum driving period of the recording head can be greatly prolonged. In particular, the print operation at a high print ratio can be performed in a driving frequency band in which such a print operation is impossible so far. FIG. 70 shows an actual change in pulse width when several lines at a print ratio of 50% are printed on an A4-size recording sheet.

As described above, in the method of this embodiment, the main pulse width T3 is controlled to be minimized according to changes in pre-pulse width T1 and in interval time T2 by utilizing a change in film boiling start point of the main pulse T3 in the multi-pulse driving mode. Since the main pulse width T3 is shortened, ejection can be performed by energy about 70% that in the conventional method when the maximum ejection quantity is obtained.

In an actual ejection quantity control method, a temperature range described as "PWM control region" in FIG. 57 is a temperature range in which the ejection quantity can be stabilized. In this embodiment, this temperature range corresponds to a range between 15° C. and 35° C. of the ink temperature in the ejection unit. FIG. 57 shows the relationship between the ink temperature in the ejection unit and the ejection quantity when the interval time is changed in 10 steps. Even when the ink temperature in the ejection unit changes, the ejection quantity can be controlled within a width ΔV with respect to a target ejection quantity Vd0 by changing the interval time at every temperature step width ΔT according to the ink temperature.

(Temperature Prediction Control)

Figure 71:
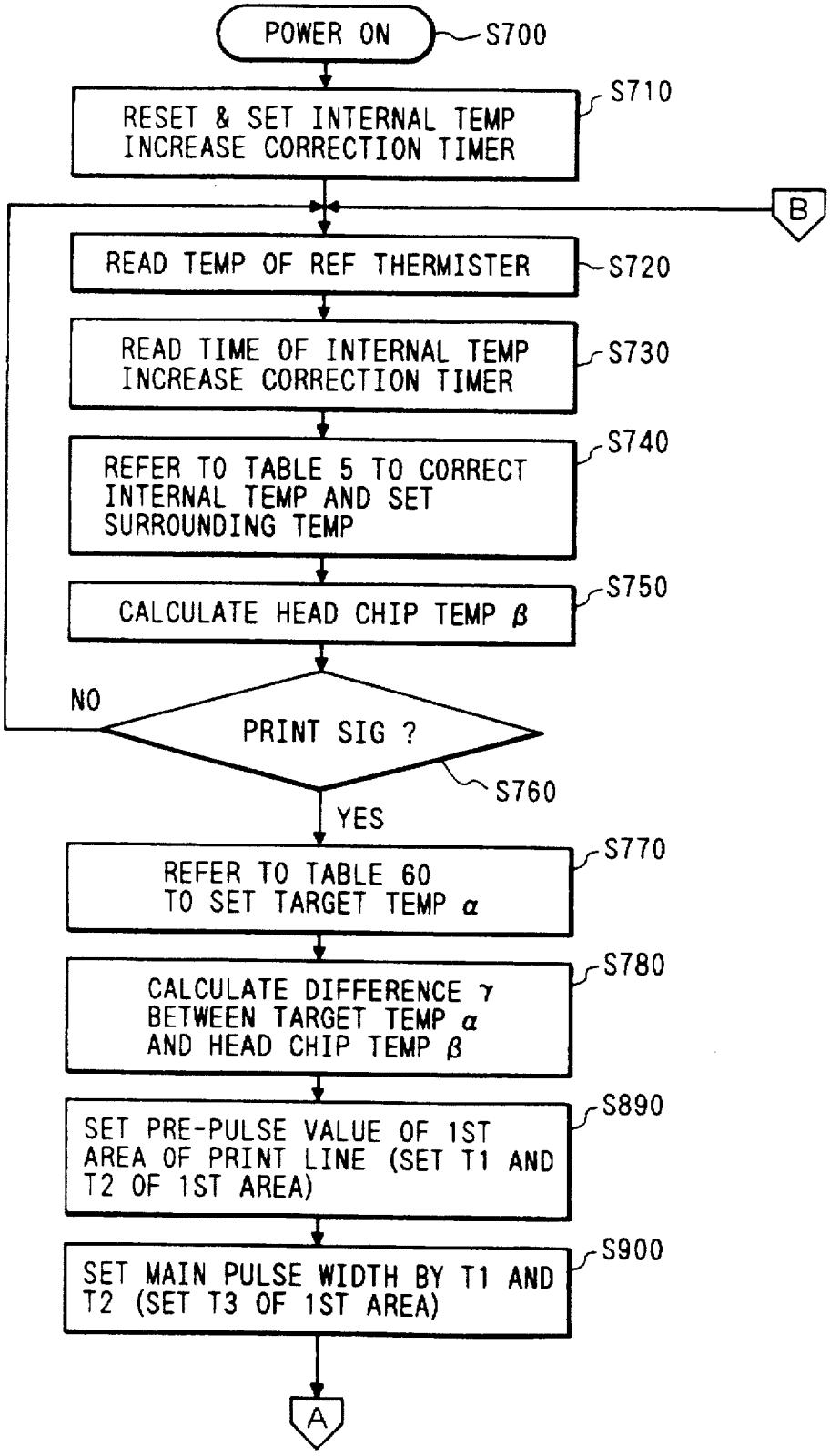
FIGS. 71 and 72 are flow charts associated with ejection quantity control in the temperature prediction method.
Figure 72:
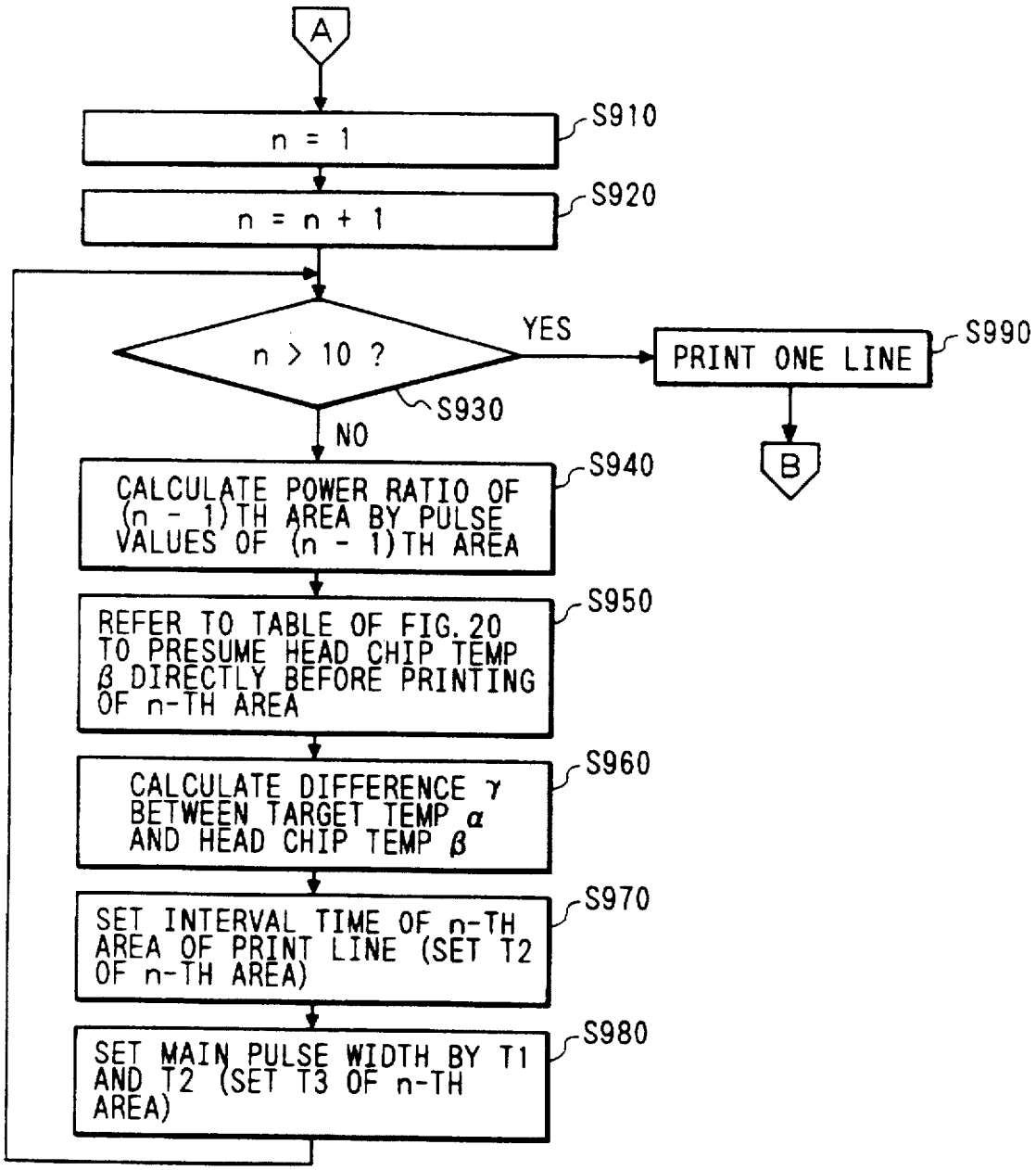

Operations in execution of recording using the recording apparatus with the above arrangement will be described below with reference to the flow charts shown in FIGS. 71 and 72.

Figure 58:
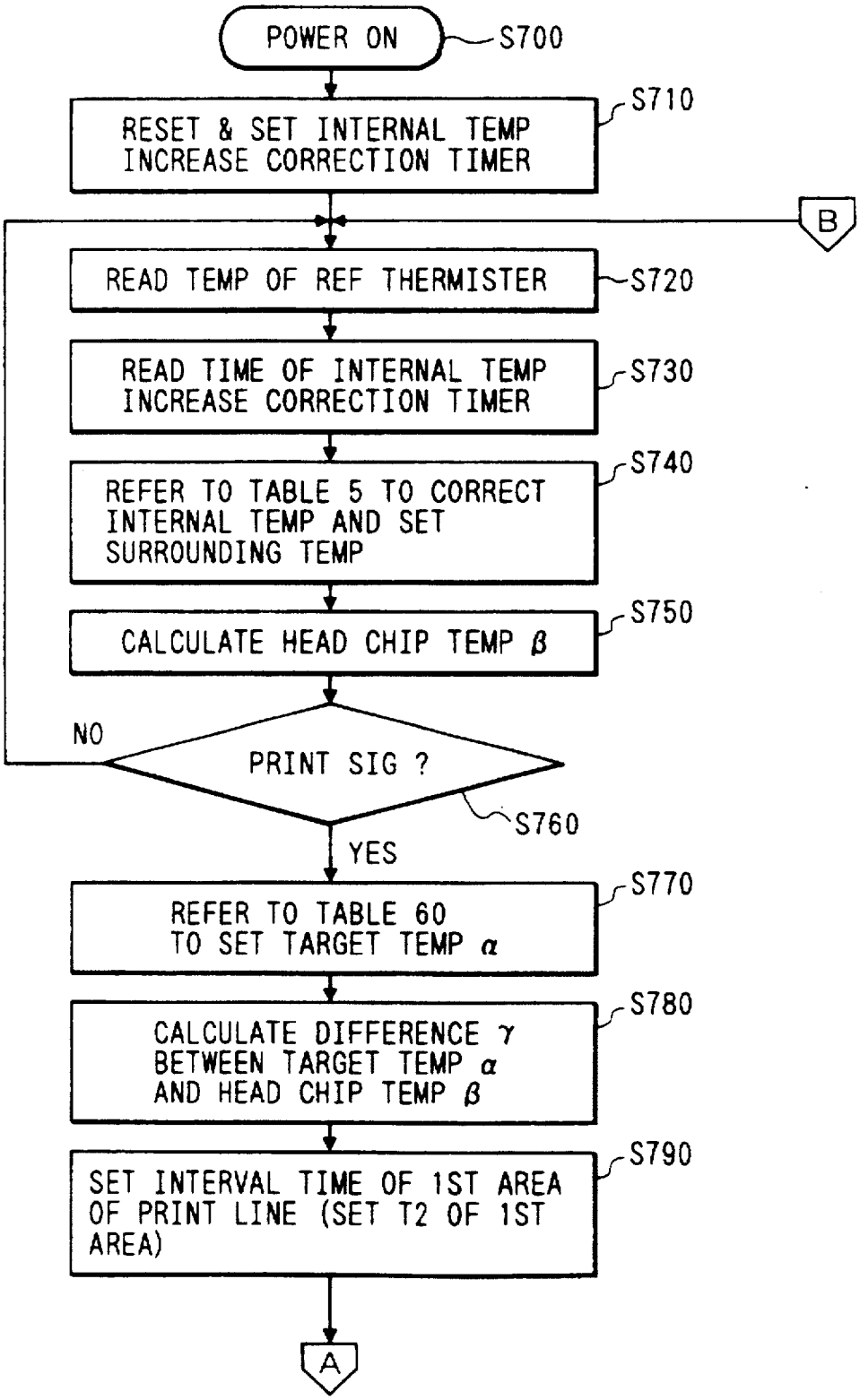
FIGS. 58 and 59 are flow charts associated with ejection quantity control in a temperature prediction control method.

Since steps S700 to S780 are the same as those in FIG. 58, a detailed description thereof will be omitted.

The pre-pulse width T1 or the interval time T2 is determined with reference to FIGS. 61A and 61B for the purpose of controlling the ejection quantity using the PWM method (S890). The main pulse width T3 is determined with reference to FIG. 73 or 74 according to the pre-pulse width T1 or the interval time T2 determined in step S890 (S900).

Figure 59:
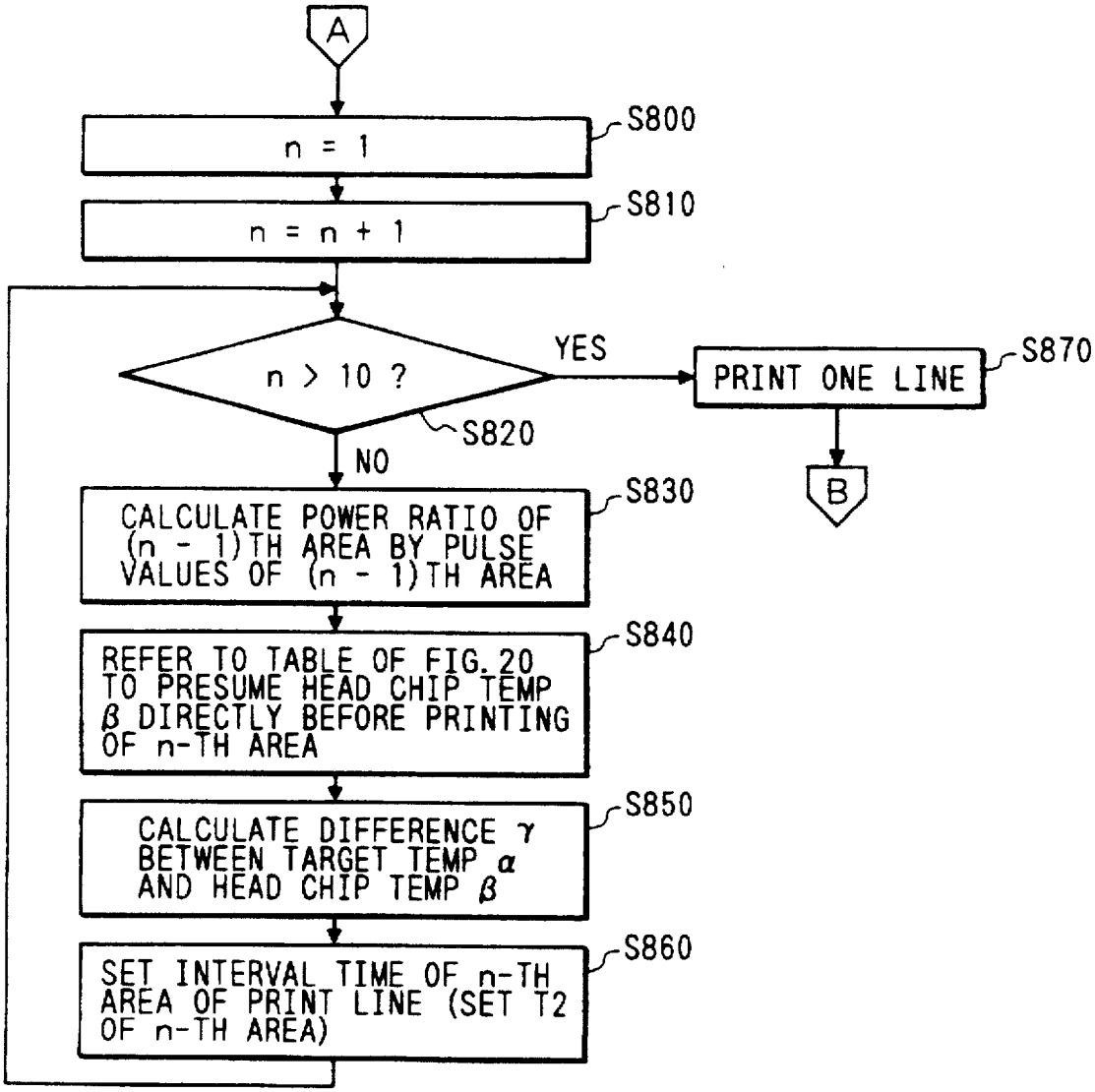

Thereafter, since steps S910 to S960 are the same as steps S800 to S850 in FIG. 59, a detailed description thereof will be omitted.

In step S960, a difference (γ) between a print target temperature (α) and a head chip temperature (β) is calculated again. The pre-pulse value (the pre-pulse width T1 or the interval time T2) for printing the second area is obtained based on the difference (γ) with reference to FIGS. 61A and 61B, and the pre-pulse value of the second area is set on a memory (S970). In step S970, the main pulse width T3 is determined based on the pre-pulse width T1 or the interval time T2 determined in step S970 with reference to FIG. 73 or 74. (S980).

Thereafter, the power ratio in the corresponding area is calculated based on the number of dots and the pre-pulse value of the immediately preceding area, thereby predicting the head chip temperature (β) at the end of printing of the corresponding area. Then, the pre-pulse value of the next area is set based on the difference (γ) between the print target temperature (α) and the head chip temperature (β) (S930 to S980). Thereafter, when the pre-pulse values for all the 10 areas in one line are set, the flow advances from step S930 to step S990, and the sub-heaters are heated before printing. Thereafter, the one-line print operation is performed according to the set pre-pulse values. Upon completion of the one-line print operation in step S990, the flow returns to step S720 to read the temperature of a reference thermistor, and the above-mentioned control operations are sequentially repeated.

With the above-mentioned control, since the actual ejection quantity can be stably controlled regardless of the ink temperature, a high-quality recorded image having a uniform density can be obtained.

(31st Embodiment)

Figure 75:
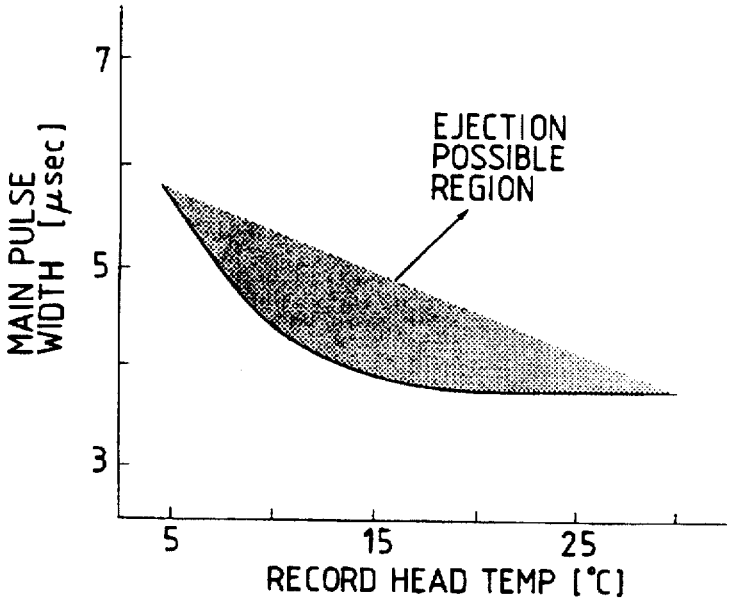
FIG. 75 is a graph showing the relationship between the recording head temperature and the ejection possible minimum main pulse width in a single pulse mode.

The 31st embodiment of the present invention will be described below. This embodiment pays attention to the fact that the ejection possible minimum main pulse width T3 in the single-pulse driving mode in the recording head has dependency on the surrounding temperature and the recording head temperature. FIG. 75 shows the relationship between the temperature of the recording head and the main pulse width that can stably cause bubble production in the first ejection in response to only a single pulse as the main pulse. As can be seen from FIG. 75, as the temperature is decreased, the required pulse width is increased; when the temperature is increased, the required pulse width is decreased. In a range below the ejection possible region, ejection becomes unstable, and the ejection quantity is extremely decreased, resulting in a splash-like printed state. When the temperature is further decreased, ejection cannot be performed at all. This value delicately changes depending on variations of heads, contamination of heaters, and the like.

Therefore, in the single-pulse driving mode of this embodiment, the pulse value is controlled by directly measuring or predicting the temperature of the recording head, thereby preventing the temperature of the recording head from being excessively increased.

The control of the required pulse width based on an increase in temperature of the recording head itself is not to modulate the ejection quantity in real time but to suppress heat that varies over a macroscopic time, i.e., by the increase in temperature of the recording head itself. For this reason, this control is different in concept from control for changing the pulse width of the recording head according to the temperature of the recording head so as to obtain a uniform density by density modulation in real time in, e.g., a thermal transfer printer, a thermal printer, and the like.

Furthermore, the control of the main pulse width for the macroscopic increase in temperature of the recording head can also be applied to multi-pulse PWM control.

When this concept is generalized, the control of the main pulse is performed not only at a macroscopic temperature, i.e., the temperature of the heater board of the recording head, but also at a temperature associated with the degree of activation at the interface between the heater and the ink where film boiling occurs, as described above. Since the surrounding temperature and the increased temperature of the recording head itself have a large difference from a bubble production temperature, the pulse width required for bubble production changes due to the surrounding temperature or the increased temperature of the recording head although the change is not so large. In the apparatus for performing the multi-pulse PWM control, as described in the 30th embodiment, the temperature at the interface between the ink and the heater changes according to the pre-pulse width T1, and the degree of activation is increased very much, thus considerably decreasing the minimum pulse width necessary for bubble production.

As described above, in the 31st embodiment of the present invention, in determination of the main pulse value T3 according to the temperature of the recording head, energy is further decreased as much as possible by, e.g., multiplying a correction coefficient.

As described above, when the pre-pulse width T1 is changed or when the interval time T2 is changed, the temperature distribution shown in FIG. 56 is similarly obtained. At this time, in the multi-pulse PWM control based on the pre-pulse T1 control method, the ink temperature at the interface between the heater and the ink is controlled within a bubble non-production range by varying input energy so as to vary the thickness (bubble production volume) of the ink layer to be evaporated, thereby controlling the ejection quantity. In the multi-pulse PWM control based on the interval time T2 control method, input energy is set to have a predetermined minimum value, and the thickness of the ink layer to be evaporated is controlled by the heat conduction time after the pre-pulse T1 until the beginning of film boiling.

In this case, it is important that the thickness of the ink layer capable of causing film boiling changes according to the pre-pulse width T1 and the interval time T2, and the time after the main pulse T3 is started until film boiling is actually started changes, as described above, and also changes according to the ink tank temperature (equal to the surrounding temperature) and the temperature of the recording head.

By utilizing these characteristics, when the main pulse T3 is PWM-controlled in correspondence with changes in pre-pulse width T1 and interval time T2, which are multiplied with a correction coefficient according to an increase in temperature, wasteful energy supplied when the film boiling start point changes according to the recording head temperature can be further decreased. More specifically, problems of, e.g., the heat accumulation and overheating of the recording head due to heating of the heaters in an adiabatic state from the ink after film boiling is already started, scorching and cavitation breakdown of the ink due to an increase in heater peak temperature, and the like, can be solved. Furthermore, since the problem of heat accumulation can be remarkably improved, the minimum driving period of the recording head can be further greatly prolonged. In particular, the print operation at a high print ratio can be performed in a driving frequency band in which such a print operation is impossible so far.

Figure 76:
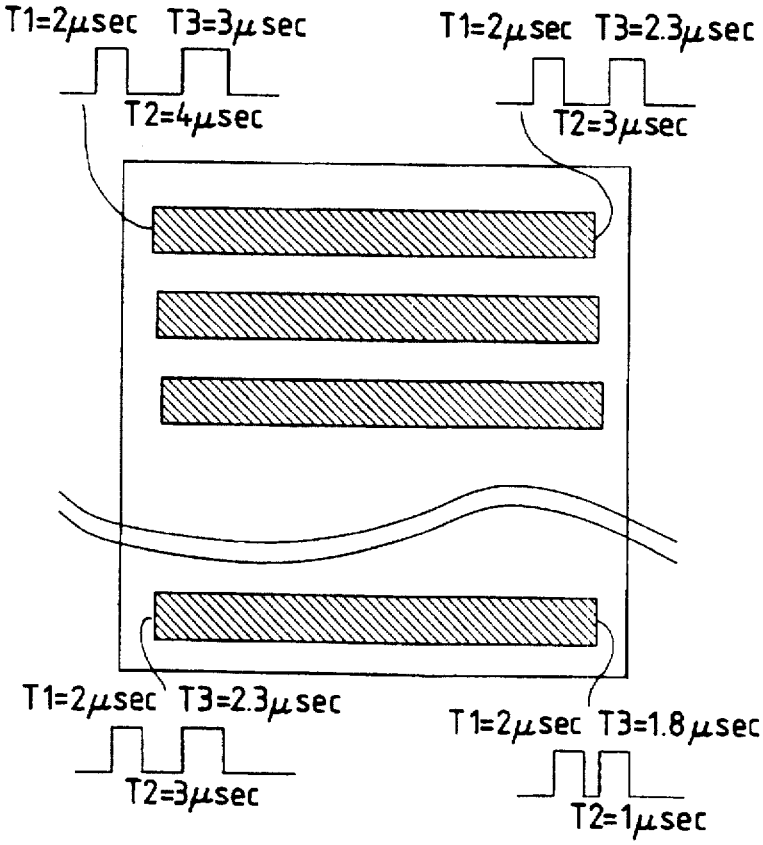
FIG. 76 is a view showing changes in multi-pulse condition at respective positions in the 30th embodiment.
Figure 77:
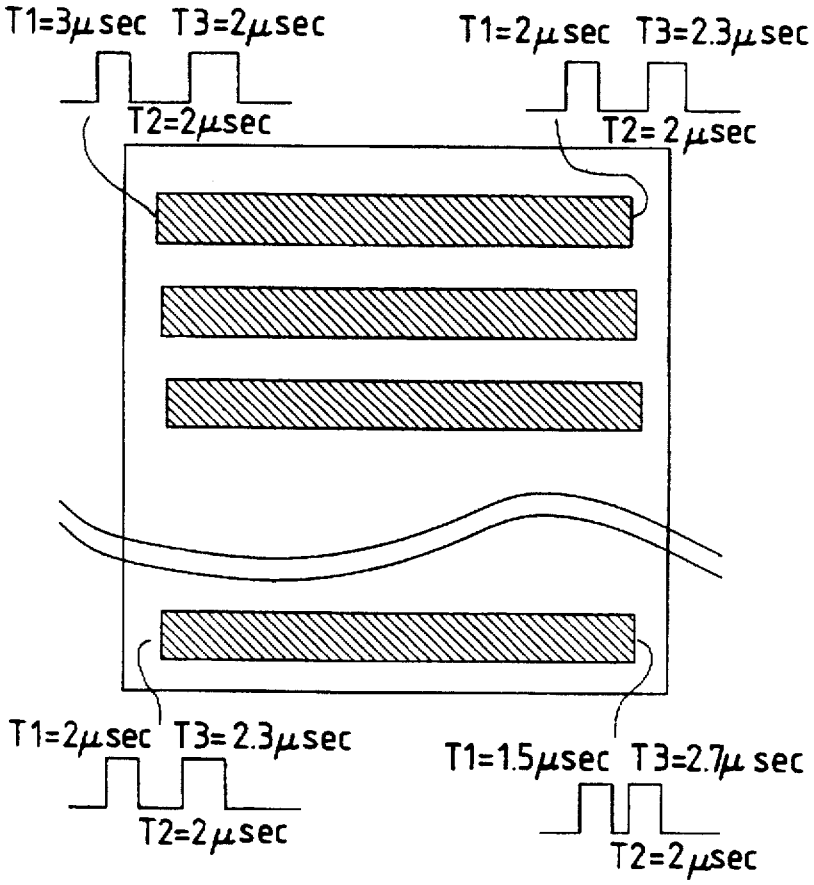
FIG. 77 is a view showing changes in multi-pulse condition at respective positions in the 30th embodiment.

FIGS. 76 and 77 show actual changes in main pulse width T3 when the multi-pulse PWM control based on the interval time T2 or pre-pulse T1 control method is performed when several lines at a print ratio of 50% are printed on an A4-size recording sheet.

As described above, according to this embodiment, the main pulse width T3 is controlled to be minimized according to a change in interval time T2 or pre-pulse width T1 and the temperature of the recording head or the surrounding temperature (=ink tank temperature) by utilizing a change in film boiling start point of the main pulse T3 in the multi-pulse driving mode. When the main pulse width is changed according to the surrounding temperature (=ink tank temperature), the ink temperature is always lower than the temperature of the recording head. For this reason, when the temperature of the recording head is different from the ink temperature in the common ink chamber or nozzles in the recording head, another correction coefficient need only be multiplied.

(32nd Embodiment)

FIG. 53B is a view for explaining divided pulses according to the 32nd embodiment of the present invention. In FIG. 53B, $V_{OP}$ represents an operational voltage, T11 and T13 represent the pulse widths of pulses that do not cause bubble production (to be referred to as pre-pulses hereinafter) of a plurality of divided heat pulses, T12 and T14 represent interval times, and T15 represents the pulse width of a pulse that causes bubble production (to be referred to as a main pulse hereinafter). These pulses have the same functions as described in the 27th embodiment.

In this embodiment, the number of pre-pulses is increased, as shown in FIG. 53B, to increase the energy amount to be applied to the ink, and PWM control of the main pulse is added. Thus, a larger control range can be obtained. Furthermore, in this embodiment, a case will be explained below wherein the present invention is applied not only to stabilization of the ejection quantity but also to an ejection quantity modulation method according to a halftone signal. In this embodiment, a print operation can be performed even in a region wherein overheating occurs due to an increase in input energy, an increase in driving frequency, and an increase in print ratio when the main pulse width T5 is not modulated.

In this embodiment, the pre-pulse widths T11 and T13, and the interval times T12 and T14 between the pre-pulses T11 and T13 and between the pre-pulse T13 and the main pulse T15 are varied to obtain the maximum ejection quantity control range. According to this method, the above-mentioned controllable range can be greatly widened without causing overheating of the recording head.

Figure 78:
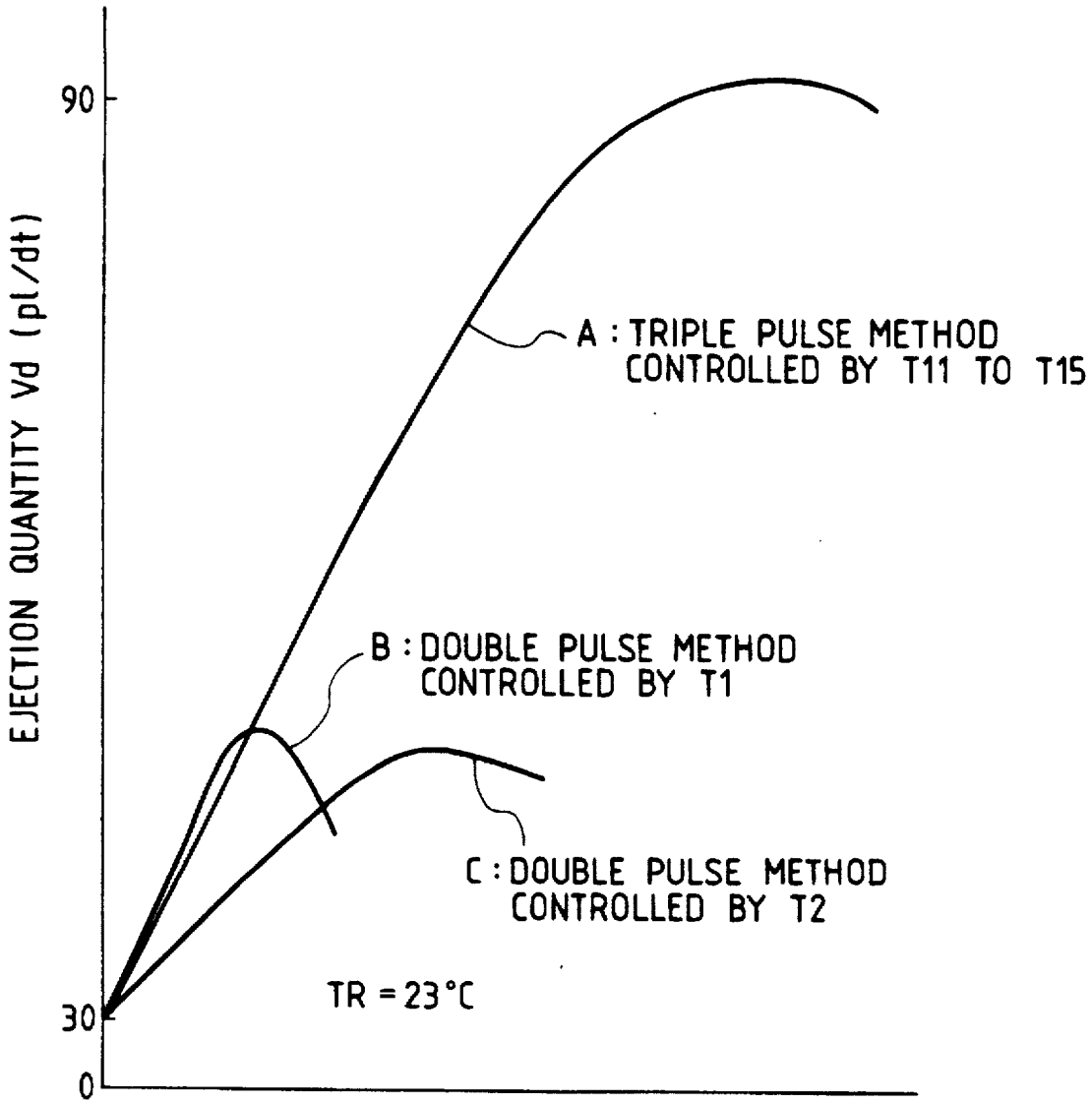
FIG. 78 is a graph for comparing ejection quantity variable ranges of a triple pulse method and other methods.

When the ejection quantity is controlled by the structure of the recording head shown in FIG. 8 like in the first embodiment, if the operational voltage $V_{OP}$=22.0 (V) is set, and the main pulse width T15 is changed between 1.000 and 4.000 [μsec], the pre-pulse widths T11 and T13 are changed between 0 and 3.000 [μsec], and the interval times T12 and T14 are changed between 0 and 10 [μsec] in combination to obtain a linear change in ejection quantity, the characteristic curve of the ejection quantity Vd [pl/drop] shown in FIG. 78 is obtained.

FIG. 78 is a graph showing the pre-pulse width dependency of the ejection quantity in this embodiment. In FIG. 78, $V_0$ indicate the ejection quantity when T11 to T14=0 [μsec], and T15=4 [μsec]. This value is determined by the head structure shown in FIG. 8. In this embodiment, $V_0$=30.0 [pl/drop] when the surrounding temperature TR=23° C. As indicated by the curve in FIG. 78, the ejection quantity Vd is linearly increased to a given region, and exhibits saturated characteristics for a while. Thereafter, the ejection quantity shows a slow descendant curve. In FIG. 78, a practical maximum ejection quantity is 90 [pl/drop] in the 23° C. environment.

As described above, according to this embodiment, when the ejection quantity is controlled by varying the pre-pulse widths and the durations of the interval times in the multi-pulse driving method, the main pulse width is varied, i.e., is set to be a required minimum value according to a change in film boiling start point with respect to the main pulse upon changing of the pre-pulse widths and the interval times, thereby limiting heating of heaters in an adiabatic state from the ink after film boiling is started, and preventing heat accumulation of the recording head, an increase in heater peak temperature, scorching and cavitation breakdown of the ink, and the like as much as possible. Thus, the recording frequency can be greatly increased due to the heat accumulation prevention effect of the recording head.

According to this embodiment, the ejection quantity control range can be greatly widened without causing overheating of the recording head or causing an ejection error such as irregular bubble production that easily occurs at the limit point in the prior art and damage to heaters, and without causing an increase in power supply capacity, and a problem of the overload upon battery driving. In addition, the ejection quantity can be stably controlled without forming the wait time even at low temperature depending a method.

Furthermore, when both the pre-pulse and the interval time are independently controlled, the variable range of the ejection quantity can be greatly widened. When the ink temperature is controlled also using the sub-heaters, the controllable range can also be widened.

Ejection is stabilized according to the ink temperature in the ejection unit in the recording mode, which is presumed prior to recording, thus obtaining a high-quality image having a uniform density. Since the ink temperature is presumed without providing a temperature sensor to the recording head, the recording apparatus main body and the recording head can be simplified.

When the method of controlling the main pulse that does not cause the recording head to accumulate heat is used, the number of pulses per ejection, which do not cause ejection, can be increased in practice. Therefore, the ejection quantity modulation range can be widened to a range which cannot be used in the prior art, and halftone expression is allowed without multi-scan operations or by a very small number of scan operations.

Since heat accumulation is small, the minimum driving period and solid black print continuity can be remarkably improved as compared to the prior art.

The main pulse control in each of the above embodiments may be performed in only the high-speed mode when recording modes include the normal speed mode and the high-speed mode shown in FIG. 66.

As described above, according to the present invention, when the ejection quantity is controlled by varying the pre-pulse widths and the durations of the interval times in the multi-pulse driving method, the main pulse width is varied, i.e., is set to be a required minimum value according to a change in film boiling start point with respect to the main pulse upon changing of the pre-pulse widths and the interval times, thereby limiting heating of heaters in an adiabatic state from the ink after film boiling is started, and preventing heat accumulation of the recording head, an increase in heater peak temperature, scorching and cavitation breakdown of the ink, and the like as much as possible. Thus, the recording frequency can be greatly increased due to the heat accumulation prevention effect of the recording head.

The present invention brings about excellent effects particularly in a recording head and a recording device of the ink jet system using a thermal energy among the ink jet recording systems.

As to its representative construction and principle, for example, one practiced by use of the basic principle disclosed in, for instance, U.S. Pat. Nos. 4,723,129 and 4,740,796 is preferred. The above system is applicable to either one of the so-called on-demand type and the continuous type. Particularly, the case of the on-demand type is effective because, by applying at least one driving signal which gives rapid temperature elevation exceeding nucleate boiling corresponding to the recording information on electrothermal converting elements arranged in a range corresponding to the sheet or liquid channels holding liquid (ink), a heat energy is generated by the electrothermal converting elements to effect film boiling on the heat acting surface of the recording head, and consequently the bubbles within the liquid (ink) can be formed in correspondence to the driving signals one by one. By discharging the liquid (ink) through a discharge port by growth and shrinkage of the bubble, at least one droplet is formed. By making the driving signals into pulse shapes, growth and shrinkage of the bubble can be effected instantly and adequately to accomplish more preferably discharging of the liquid (ink) particularly excellent in accordance with characteristics. As the driving signals of such pulse shapes, the signals as disclosed in U.S. Pat. Nos. 4,463,359 and 4,345,262 are suitable. Further excellent recording can be performed by using the conditions described in U.S. Pat. No. 4,313,124 of the invention concerning the temperature elevation rate of the above-mentioned heat acting surface.

As a construction of the recording head, in addition to the combined construction of a discharging orifice, a liquid channel, and an electrothermal converting element (linear liquid channel or right angle liquid channel) as disclosed in the above specifications, the construction by use of U.S. Pat. Nos. 4,558,333 and 4,459,600 disclosing the construction having the heat acting portion arranged in the flexed region is also included in the invention. The present invention can be also effectively constructed as disclosed in Japanese Laid-Open Patent Application No. 59-123670 which discloses the construction using a slit common to a plurality of electrothermal converting elements as a discharging portion of the electrothermal converting element or Japanese Laid-Open Patent Application No. 59-138461 which discloses the construction having the opening for absorbing a pressure wave of a heat energy corresponding to the discharging portion.

What is claimed is:

1. An ink jet recording apparatus which executes recording by using a recording head provided for a main body, said apparatus comprising:

a head temperature detection member provided for the recording head, the recording head ejecting an ink;

a reference temperature detection member provided for the main body;

timer means for counting time;

correction amount determination means for determining a correction amount of a head temperature detected by said head temperature detection member based on a detected value of said head temperature detection member and a detected value of said reference temperature detection member at a predetermined time counted by said timer means; and calibration means for calibrating a head temperature detected by said head temperature detection member based on the correction amount.

2. An apparatus according to claim 1, wherein said correction amount determination means determines the correction amount when a non-recording period counted by said timer means exceeds a predetermined period of time.

3. An apparatus according to claim 1, further comprising temperature change rate measuring means for measuring a reference temperature change rate of said reference temperature detection member within a predetermined time period, wherein said correction amount determination means determines the correction amount when the temperature change rate is smaller than a predetermined value.

4. An apparatus according to claim 1, wherein said correction amount determination means determines the temperature correction amount by calculating a difference between the head temperature detected by said head temperature detection member and the reference temperature detected by said reference temperature detection member.

5. An apparatus according to claim 1, wherein said recording head causes a change in state in the ink by heat energy, and ejects the ink based on the change in state.

6. An apparatus according to claim 1, further comprising calibration abnormality detection means for, when the temperature correction amount exceeds a predetermined temperature, stopping temperature correction.

7. An apparatus according to claim 1, wherein said correction amount determination means corrects a reference temperature detected by said reference temperature detection member based on an amount of a rise in temperature according to an elapsed time from power-on counted by said timer means.

8. An apparatus according to claim 1, further comprising ejection amount control means for controlling an amount of ink to be ejected from the recording head, wherein said ejection amount control means controls the amount of ink to be ejected based on the head temperature calibrated by said calibration means.

9. An apparatus according to claim 1, further comprising recovery means for recovering ejection of ink from the recording head, wherein said recovery means recovers ejection of ink based on the head temperature calibrated by said calibration means.

10. An ink jet recording method for recording by ejecting ink using a recording head provided for a main body, said method comprising the steps of:

providing a head temperature detection member for the recording head;

providing a reference temperature detection member for the main body;

counting time;

determining a correction amount of a head temperature detected by the head temperature detection member based on a detected value of the head temperature detection member and a detected value of the reference temperature detection member at a predetermined time counted in said counting step; and calibrating a head temperature detected by the head temperature detection member based on the correction amount.

11. A method according to claim 10, wherein said correction amount determining step determines the correction amount when a non-recording period counted in said counting step exceeds a predetermined period of time.

12. A method according to claim 10, further comprising the step of measuring a reference temperature change rate of the reference temperature detection member within a predetermined time period, wherein said correction amount determining step determines the correction amount when the temperature change rate is smaller than a predetermined value.

13. A method according to claim 10, wherein said correction amount determining step determines the temperature correction amount by calculating a difference between the head temperature detected by the head temperature detection member and the reference temperature detected by the reference temperature detection member.

14. A method according to claim 10, wherein the recording head causes a change in state in the ink by heat energy, and ejects the ink based on the change in state.

15. A method according to claim 10, further comprising the step of stopping temperature correction when the temperature correction amount exceeds a predetermined temperature.

16. A method according to claim 10, wherein said correction amount determining step corrects a reference temperature detected by the reference temperature detection member based on an amount of a rise in temperature according to an elapsed time from power-on counted in said counting step.

17. A method according to claim 10, further comprising the step of controlling an amount of ink to be ejected from the recording head, wherein said ejection amount controlling step controls the amount of ink to be ejected based on the head temperature calibrated in said calibrating step.

18. A method according to claim 10, further comprising the step of recovering ejection of ink from the recording head based on a head temperature calibrated in said calibrating step.

* * * * *

UNITED STATES PATENT AND TRADEMARK OFFICE

CERTIFICATE OF CORRECTION

PATENT NO. : 5,751,304 Page 1 of 6

DATED : May 12, 1998

INVENTOR(S) : Hirabayashi et al.

It is certified that error appears in the above-identified patent and that said Letters Patent is hereby corrected as shown below:

ON THE COVER PAGE

AT [56] References Cited:

FOREIGN PATENT DOCUMENTS,

"3024972 2/1991 Japan
3227643 10/1991 Japan" should read

--3-024972 2/1991 Japan
3-227643 10/1991 Japan--.

AT [75] INVENTORS:

Hiromitsu Hirabayashi, Yokohama; Naoji Otsuka, Kawasaki; Kentaro Yano, Yokohama; Hitoshi Sugimoto, Kawasaki, Miyuki Matsubara, Tokyo; Kiichiro Takahashi, Yokohama; Osamu Iwasaki, Tokyo, all of Japan" should read --Hiromitsu Hirabayashi, Yokohama; Hitoshi Sugimoto, Kawasaki; Miyuki Fujita, Tokyo; Kiichiro Takahashi, Yokohama, all of Japan--.

COLUMN 1:

Line 57, "for-performing" should read --for performing--.

UNITED STATES PATENT AND TRADEMARK OFFICE

CERTIFICATE OF CORRECTION

DATED : May 12, 1998

INVENTOR(S) : Hirabayashi et al.

It is certified that error appears in the above-identified patent and that said Letters Patent is hereby corrected as shown below:

COLUMN 4:

Line 32, "change-in" should read --change in--.

COLUMN 8,

Line 26, "IJRA,." should read --IJRA,--.

COLUMN 10:

Line 6, "to" should be deleted.

COLUMN 12:

Line 25, "which" should be deleted.

COLUMN 13:

Line 13, "$V_{1LMT}$=24.0 [pl/drop]." should read --$V_{LMT}$ = 24.0 [pl/drop].--.

COLUMN 16:

Line 64, " "aline" should read --"line--.

COLUMN 19:

Line 10, "wet" should read --wet quantity--.
Line 30, "SB" should read --S8--.

UNITED STATES PATENT AND TRADEMARK OFFICE

CERTIFICATE OF CORRECTION

PATENT NO. : 5,751,304

DATED : May 12, 1998

INVENTOR(S) : Hirabayashi et al.

It is certified that error appears in the above-identified patent and that said Letters Patent is hereby corrected as shown below:

COLUMN 24:

Line 14, "a difference between" should be deleted.

COLUMN 27:

Line 66, "sum" should read --sum of--.

COLUMN 34:

Line 1, "is" (second occurrence) should read --to be--.
Line 43, "in," should read --in--.
Line 59, "unit;" should read --unit,--.

COLUMN 41:

Line 66, "elapse" should read --elapsed--.

COLUMN 42:

Line 27, "elapse" should read --elapsed--.

COLUMN 43:

Line 51, "not" should be deleted.

UNITED STATES PATENT AND TRADEMARK OFFICE

CERTIFICATE OF CORRECTION

PATENT NO. : 5,751,304

DATED : May 12, 1998

INVENTOR(S) : Hirabayashi et al.

It is certified that error appears in the above-identified patent and that said Letters Patent is hereby corrected as shown below:

COLUMN 44:

Line 27, "arrow" should read --arrow 15--.

COLUMN 45:

Line 57, "invention." should read --invention is used.--.

COLUMN 46:

Line 22, "means" should read --Means--.
Line 50, "a change" should read -- → a change--.
Line 55, "control" should read --Control--.

COLUMN 49:

Line 59, "print pattern;" should read --print pattern:--.
Line 61, "FIG. 43A;" should read --FIG. 43A:--.
Line 63, "FIG. 43B;" should read --FIG. 43B:--.

COLUMN 53:

Line 5, "Furthermore,-when" should read --Furthermore, when--.

UNITED STATES PATENT AND TRADEMARK OFFICE

CERTIFICATE OF CORRECTION

PATENT NO. : 5,751,304 Page 5 of 6

DATED : May 12, 1998

INVENTOR(S) : Hirabayashi et al.

It is certified that error appears in the above-identified patent and that said Letters Patent is hereby corrected as shown below:

COLUMN 58:

Line 58, "time;+30%" should read --time: +30%--.
Line 59, "(KT);0.8[pl/°C]" should read --(KT): 0.8[pl/°C]--.

COLUMN 59:

Line 17, "20," should read --20 pl,--.

COLUMN 64,

Line 39, "control," should read --control--.

COLUMN 65:

Line 7, "70%" should read --70% of--.

COLUMN 70:

Line 44, "reference" (first occurrence) should be deleted and "reference" (second occurrence) should read --head--.

COLUMN 71:

Line 35, "reference" should be deleted.

UNITED STATES PATENT AND TRADEMARK OFFICE

CERTIFICATE OF CORRECTION

PATENT NO. : 5,751,304 Page 6 of 6

DATED : May 12, 1998

INVENTOR(S) : Hirabayashi et al.

It is certified that error appears in the above-identified patent and that said Letters Patent is hereby corrected as shown below:

COLUMN 72:

Line 1, "reference" should read --head--.

Signed and Sealed this

Fifth Day of October, 1999

*Attest:*

*Attesting Officer*

Q. TODD DICKINSON

*Acting Commissioner of Patents and Trademarks*